US009348259B2

(12) United States Patent
Nagayama et al.

(10) Patent No.: US 9,348,259 B2
(45) **Date of Patent: *May 24, 2016**

(54) TONER HOUSING CONTAINER AND IMAGE FORMING APPARATUS

(71) Applicant: RICOH COMPANY, LTD., Tokyo (JP)

(72) Inventors: Masashi Nagayama, Shizuoka (JP); Hisashi Nakajima, Shizuoka (JP); Yoshitaka Sekiguchi, Hyogo (JP); Saori Yamada, Shizuoka (JP); Shinya Hanatani, Kanagawa (JP); Mariko Takii, Kanagawa (JP); Hiroshi Hosokawa, Kanagawa (JP); Shunji Katoh, Kanagawa (JP); Shinji Tamaki, Tokyo (JP); Hiroshi Ikeguchi, Saitama (JP); Kenji Kikuchi, Kanagawa (JP); Michiharu Suzuki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/278,119

(22) Filed: May 15, 2014

(65) Prior Publication Data

US 2014/0348550 A1 Nov. 27, 2014

(30) Foreign Application Priority Data

May 21, 2013 (JP) ..... 2013-107364

(51) Int. Cl.
*G03G 15/08* (2006.01)
*G03G 9/087* (2006.01)

(52) U.S. Cl.
CPC ..... *G03G 15/0839* (2013.01); *G03G 9/08755* (2013.01); *G03G 9/08795* (2013.01); *G03G 9/08797* (2013.01); *G03G 15/0877* (2013.01); *G03G 15/0872* (2013.01)

(58) Field of Classification Search
CPC ..... G03G 15/0839; G03G 15/0877
USPC ..... 399/260, 262
See application file for complete search history.

(56) References Cited

U.S. PATENT DOCUMENTS 5,495,323 A * 2/1996 Meetze, Jr. ..... 399/120
5,547,798 A * 8/1996 Suzuki et al. ..... 430/109.3

(Continued)

FOREIGN PATENT DOCUMENTS

JP 2004-61757 2/2004
JP 2010-2613 1/2010

(Continued)

OTHER PUBLICATIONS

U.S. Appl. No. 14/186,417, filed Feb. 21, 2014.

*Primary Examiner* — Benjamin Schmitt
(74) *Attorney, Agent, or Firm* — Cooper & Dunham LLP

(57) ABSTRACT

A toner housing container includes a container body housing a toner; a conveying portion conveying the toner from one end of the container body, in a longer direction of the container body, to its other end at which a container opening portion is provided; a pipe receiving port receiving a conveying pipe fixed to a toner conveying device; and an uplifting portion moving the toner toward a toner receiving port of conveying pipe. Such toner has a molecular weight distribution having a peak in a range of $10^3$ to $10^4$, and has C/R of from 0.03 to 0.55 between peak height C attributed to crystalline polyester resin and R attributed to non-crystalline resin when measured by FT-IR after stored at 45° C. for 12 hours.

12 Claims, 30 Drawing Sheets

(56) References Cited

U.S. PATENT DOCUMENTS

| | | | | |
|---|---|---|---|---|
| 5,576,816 | A * | 11/1996 | Staudt et al. | 399/262 |
| 6,169,864 | B1 | 1/2001 | Baxendell et al. | |
| 2004/0223790 | A1 | 11/2004 | Hosokawa et al. | |
| 2007/0177905 | A1 | 8/2007 | Hosokawa et al. | |
| 2007/0238042 | A1 | 10/2007 | Yasunaga et al. | |
| 2009/0075195 | A1 * | 3/2009 | Shu et al. | 430/109.4 |
| 2009/0317144 | A1 | 12/2009 | Koido | |
| 2012/0163877 | A1 | 6/2012 | Kikuchi et al. | |
| 2012/0195645 | A1 | 8/2012 | Takami et al. | |
| 2012/0213555 | A1 | 8/2012 | Komatsu et al. | |
| 2012/0219330 | A1 | 8/2012 | Kikuchi et al. | |
| 2012/0321341 | A1 | 12/2012 | Hori et al. | |
| 2013/0011166 | A1 | 1/2013 | Yamaguchi et al. | |
| 2013/0260307 | A1 | 10/2013 | Nagayama et al. | |
| 2013/0272750 | A1 | 10/2013 | Matsumoto et al. | |
| 2013/0330105 | A1 | 12/2013 | Komatsu et al. | |
| 2014/0348545 | A1 * | 11/2014 | Shiba et al. | 399/258 |
| 2014/0348546 | A1 * | 11/2014 | Kojima et al. | 399/258 |
| 2014/0348551 | A1 * | 11/2014 | Yamabe et al. | 399/263 |
| 2014/0348552 | A1 * | 11/2014 | Iwatsuki et al. | 399/263 |

FOREIGN PATENT DOCUMENTS

| | | |
|---|---|---|
| JP | 2012-133349 | 7/2012 |
| JP | 2013-231945 | 11/2013 |
| JP | 5435380 | 12/2013 |
| WO | WO 2013/077474 | 5/2013 |

* cited by examiner

TONER HOUSING CONTAINER AND IMAGE FORMING APPARATUS

BACKGROUND OF THE INVENTION

1. Field of the Invention

The present invention relates to a toner housing container and an image forming apparatus.

2. Description of the Related Art

In electrophotographic image forming apparatuses, a powder conveying device supplies (or replenishes) a toner serving as a developer from a toner container, which is a powder housing container housing the developer in the powder form, into a developing device.

For example, there is proposed a toner housing container that includes a rotatable tubular powder housing member, a conveying pipe receiving member fixed to the powder housing member, an opening provided in the conveying pipe receiving member, and an uplifting portion configured to uplift the toner upward in the container along with rotation of the container body (e.g., see Japanese Patent Application Laid-Open (JP-A) No. 2012-133349). According to this proposed technique, the toner is uplifted by the uplifting portion along with rotation of the container body, and the toner falls from the uplifting portion during the rotation and is supplied into the conveying pipe.

However, in the system employing the mechanism of uplifting the toner by the uplifting portion and supplying the toner into the conveying pipe, there is a problem that when the amount of toner remaining in the toner bottle becomes low, it is difficult for the toner to be replenished into the developing device depending on the type of the toner, particularly when the toner has low temperature fixability, in which case, the toner may form aggregates.

SUMMARY OF THE INVENTION

The present invention aims to solve the conventional problems described above, and achieve the following object. That is, an object of the present invention is to provide a toner housing container that prevents occurrence of toner aggregates even when a toner having low temperature fixability is used.

Means for solving the problems described above is as follows.

A toner housing container according to the present invention includes:

a container body mountable on a toner conveying device and housing a toner to be supplied into the toner conveying device;

a conveying portion provided in the container body and configured to convey the toner from one end of the container body in a longer direction thereof to the other end thereof at which a container opening portion is provided;

a pipe receiving port provided at the container opening portion and capable of receiving a conveying pipe fixed to the toner conveying device; and an uplifting portion configured to uplift the toner conveyed by the conveying portion from a lower side of the container body to an upper side thereof and move the toner into a toner receiving port of the conveying pipe, wherein the toner contains a crystalline polyester resin (A) and a non-crystalline resin (B), wherein the toner has a molecular weight distribution having a main peak in a range of from 1,000 to 10,000, when measured by gel permeation chromatography (GPC) of a THF soluble content thereof, wherein the toner has a peak height ratio (C/R) of from 0.03 to 0.55 between a peak height C of a characteristic spectrum attributed to the crystalline polyester resin (A) and a peak height R of a characteristic spectrum attributed to the non-crystalline resin (B), when the toner is measured with a Fourier-transform infrared spectroscopic analyzer according to total reflection method after stored in a thermostatic bath of 45° C. for 12 hours, wherein the container body includes a protruding portion protruding from a container body interior side of the container opening portion toward the one end, wherein the uplifting portion includes an uplifting wall surface extending from an internal wall surface of the container body toward the protruding portion, and a curving portion curving so as to conform to the protruding portion, and wherein the protruding portion is provided such that when the toner housing container is mounted on the toner conveying device, the protruding portion is present between the curving portion and the toner receiving port of the conveying pipe being inserted.

The present invention can provide a toner housing container that can solve the conventional problems described above and prevents occurrence of toner aggregates even when a toner having low temperature fixability is used.

DETAILED DESCRIPTION OF THE INVENTION

Figure 1:
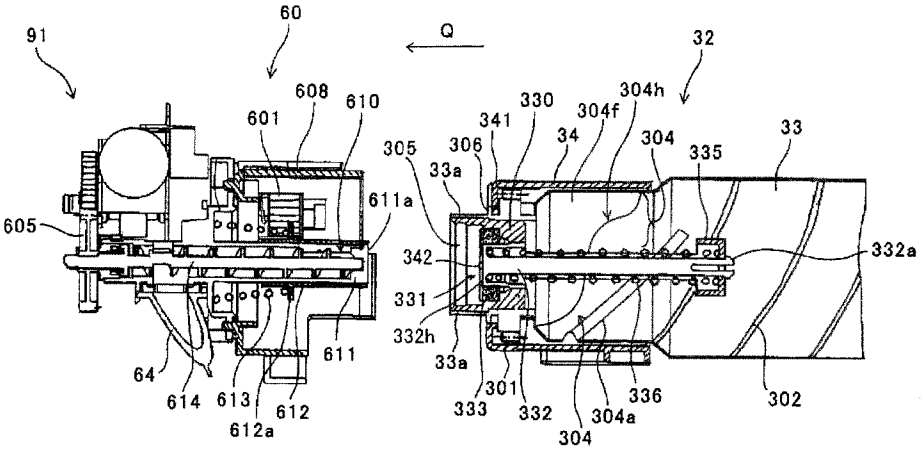
FIG. 1 is a cross-sectional explanatory diagram of a toner conveying device before mounted with a toner housing container according to an example of the present invention and of the toner housing container.

A first toner housing container of the present invention includes at east a toner, a container body, a conveying portion, a pipe receiving port, and an uplifting portion, and further contains other members according to necessity.

The toner is used for image formation. The toner contains a crystalline polyester resin (A) and a non-crystalline resin (B). The toner has a molecular weight distribution having a main peak in a range of from 1,000 to 10,000 when measured by gel permeation chromatography (GPC) of a THF soluble content thereof. The toner has a peak height ratio (C/R) of from 0.03 to 0.55 between a peak height C of a characteristic spectrum attributed to the crystalline polyester resin (A) and a peak height R of a characteristic spectrum attributed to the non-crystalline resin (B), when the toner is measured with a Fourier-transform infrared spectroscopic analyzer according to total reflection method after stored in a thermostatic bath of 15° C. for 12 hours.

The container body is mountable on a toner conveying device, and houses the toner, which is to be supplied into the toner conveying device.

The conveying portion is provided in the container body, and conveys the toner from one end of the container body in a longer direction thereof to the other end thereof at which a container opening portion is provided.

The pipe receiving port is provided at the container opening portion, and capable of receiving a conveying pipe fixed to the toner conveying device.

The uplifting portion (also referred to as toner transporting portion) uplifts the toner conveyed by the conveying portion from a lower side of the container body to an upper side thereof and moves the toner into a toner receiving port of the conveying pipe.

The container body includes a protruding portion protruding from a container body interior side of the container opening portion toward the one end.

The uplifting portion includes an uplifting wall surface extending from an internal wall surface of the container body toward the protruding portion, and a curving portion curving so as to conform to the protruding portion.

The protruding portion is provided such that when the toner housing container is mounted on the toner conveying device, the protruding portion is present between the curving portion and the toner receiving port of the conveying pipe being inserted.

The protruding portion is preferably a plate-shaped member and provided such that a flat side surface of the plate-shaped member is present between the curving portion and the toner receiving port of the toner conveying pipe being inserted. This makes it easier for the flat side surface of the plate-shaped member to receive the toner, and facilitates passing of the toner from the uplifting portion into the toner conveying pipe.

The flat side surface is a side surface intersecting approximately perpendicularly with such a surface of the plate-shaped member as facing the uplifting portion.

The uplifting portion includes a rising portion rising from an internal wall surface of the container body toward the protruding portion. The rising portion includes a curving portion curving so as to conform to the protruding portion.

The protruding portion is provided such that when the toner housing container is mounted on the toner conveying device, the protruding portion is present between the curving portion and the toner receiving port of the conveying pipe being inserted.

It is preferable that the toner housing container include two uplifting portions, and that when the toner housing container is mounted on the toner conveying device, the protruding portion be present between the curving portions of the respective ones of the two uplifting portions and the toner receiving port of the conveying pipe being inserted. This leads to efficient uplifting of the toner, and facilitates passing of the toner from the uplifting portions into the toner conveying pipe.

Two protruding portions may or may not be provided to face each other by sandwiching therebetween a longer direction center axis of the toner housing container.

(Image Forming Apparatus)

In an image forming apparatus of the present invention, the toner housing container is demountably set in the body of the image forming apparatus.

Figure 2:
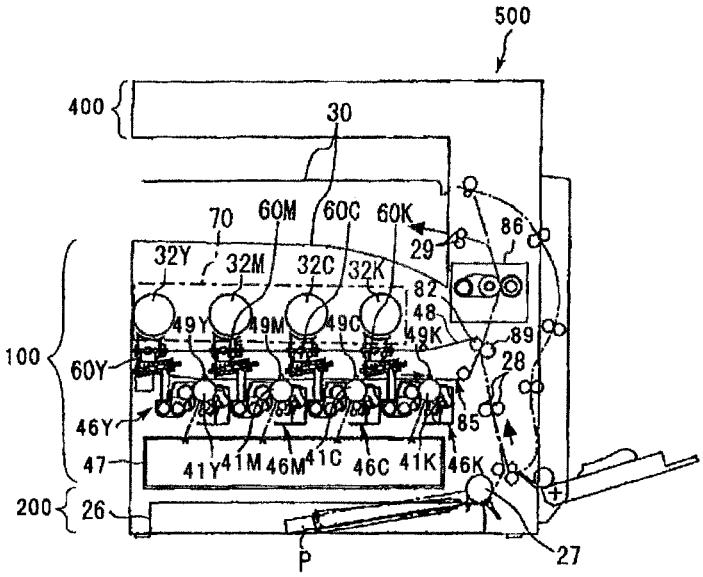
FIG. 2 is a schematic configuration diagram showing an example image forming apparatus of the present invention.

An embodiment of the present invention will be explained below with reference to the drawings. FIG. 2 explains one embodiment of the present invention applied to a copier (hereinafter referred to as copier 500) as the image forming apparatus.

FIG. 2 is a schematic configuration diagram of the copier 500 of the present embodiment. The copier 500 includes a copier body (hereinafter referred to as printer section 100), a sheet feeding table (hereinafter referred to as sheet feeding section 200), and a scanner (hereinafter referred to as scanner section 400) mounted on the printer section 100.

Four toner housing containers 32 (Y, M, C, and K) corresponding to respective colors (yellow, magenta, cyan, and black) are demountably (replaceably) set in a toner housing container accommodating section 70 provided in an upper portion of the printer section 100. An intermediate transfer unit 85 is provided below the toner housing container accommodating section 70.

The intermediate transfer unit 85 includes an intermediate transfer belt 48 as an intermediate transfer member, four first transfer bias rollers 49 (Y, M, C, and K), a second transfer backup roller 82, a plurality of tension rollers, an unillustrated intermediate transfer cleaning device, and the like. The intermediate transfer belt 48 is tensed and supported by a plurality of roller members, and endlessly moves in the arrow direction of FIG. 2 by being rotatably driven by the second transfer backup roller 82, which is one of these plurality of roller members.

In the printer section 100, four image forming units (Y, M, C, and K) corresponding to the respective colors are provided side by side so as to face the intermediate transfer belt 48. Four toner replenishing devices 60 (Y, M, C, and K) as toner conveying devices corresponding to the toner containers of the respective colors are provided below the four toner housing containers 32 (Y, M, C, and K). Toners, which are powder developers housed in the toner housing containers 32 (Y, M, C, and K), are supplied (replenished) by corresponding ones of the toner replenishing devices 60 (Y, M, C, and K) into developing devices of the image forming units 46 (Y, M, C, and K) corresponding to the respective colors.

As shown in FIG. 2, the printer section 100 includes an exposing device 47 as a latent image forming unit below the four image forming units 46. The exposing device 47 scans the surface of photoconductors 41 (Y, M, C, and K) by exposing the surface to light based on image information of a document image captured with the scanner section 400, and forms an electrostatic latent image on the surface of the respective photoconductors. Image information may be image information not captured through the scanner section 400 but input from an external device such as a personal computer connected to the copier 500.

In the present embodiment, a laser beam scanner system using a laser diode is employed as the exposing device 47. However, other systems such as one using a LED array may be used as an exposing unit.

Figure 3:
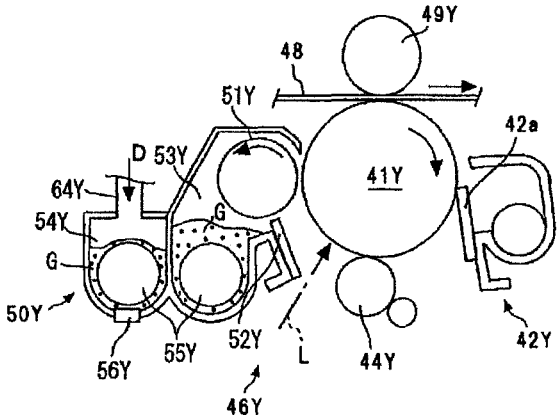
FIG. 3 is an exemplary diagram showing one configuration of an image forming unit of the image forming apparatus shown in FIG. 2.

FIG. 3 is an exemplary diagram showing one configuration of the image forming unit 46Y corresponding to yellow.

The image forming unit 46Y includes a drum-shaped photoconductor 41Y as an image bearing member. The image forming unit 46Y is configured such that a charging roller 44Y as a charging unit, a developing device 50Y as a developing unit, a photoconductor cleaning device 42Y, an unillustrated charge eliminating device, and the like are provided around the photoconductor 41Y. Through an image forming process (a charging step, an exposing step, a developing step, a transfer step, and a cleaning step) performed on the photoconductor 41Y, a yellow toner image is formed on the photoconductor 41Y.

The other three image forming units 46 (M, C, and K) have substantially the same configuration as the image forming unit 46Y corresponding to yellow, except for using different colors of toners. Toner images corresponding to the respective colors of toners are formed on the photoconductors 41 (M, C, and K). In the following, the image forming unit 46Y corresponding to yellow will only be explained, by appropriately skipping explanation of the other three image forming units 46 (M, C, and K).

The photoconductor 41Y is driven to rotate in the clockwise direction of FIG. 3 by an unillustrated driving motor. The surface of the photoconductor 41Y is electrically charged uniformly at a position facing the charging roller 44Y (charging step). After this, the surface of the photoconductor 41Y reaches a position at which it is irradiated with laser light L emitted by the exposing device 47, and has an electrostatic latent image corresponding to yellow formed thereon by being scanned and exposed at this position (exposing step). After this, the surface of the photoconductor 11 reaches a position at which it faces the developing device 50Y, and has the electrostatic latent image developed with the yellow toner at this position and a yellow toner image formed thereon (developing step).

Each of the four first transfer bias rollers 49 (Y, M, C, and K) of the intermediate transfer unit 85 forms a first transfer nip by sandwiching the intermediate transfer belt 48 between itself and the photoconductor 41 (Y, M, C, and K). A transfer bias inverse to the polarity of the toner is applied to the first transfer bias rollers 49 (Y, M, C, and K).

The surface of the photoconductor 41Y on which a toner image is formed through the developing step reaches the first transfer nip facing the first transfer bias roller 49Y across the intermediate transfer belt 48, and has the toner image on the photoconductor 41Y transferred onto the intermediate transfer belt 48 by this first transfer nip (first transfer step). At this time, although slightly, the toner remains un-transferred on the photoconductor 41Y. The surface of the photoconductor 41Y having transferred the toner image onto the intermediate transfer belt 48 by the first transfer nip reaches a position facing the photoconductor cleaning device 42Y. The un-transferred toner remained on the photoconductor 41Y is mechanically collected by a cleaning blade 42*a* of the photoconductor cleaning device 42Y at this facing position (cleaning step). Finally, the surface of the photoconductor 41Y reaches a position facing the unillustrated charge eliminating device, and has a residual potential on the photoconductor 41Y eliminated at this position. In this way, the series of image forming process performed on the photoconductor 41Y is completed.

Such an image forming process is performed in the other image forming units 46 (M, C, and K) in the same manner as in the yellow image forming unit 46Y. That is, the exposing device 47 provided below the image forming units 46 (M, C, and K) emits laser light L based on image information to the photoconductors 41 (M, C, and K) of the image forming units 46 (M, C, and K). Specifically, the exposing device 47 emits laser light L from a light source, and irradiates the photoconductors 41 (M, C, and K) with the laser light through a plurality of optical elements while scanning the laser light L with a polygon mirror being driven to rotate. After this, toner images of the respective colors formed on the photoconductors 41 (M, C, and K) through the developing step are transferred onto the intermediate transfer belt 48.

At this time, the intermediate transfer belt 48 passes through the first transfer nips of the respective first transfer bias rollers 49 (Y, M, C, and K) sequentially by running in the arrow direction of FIG. 2. Through this, the toner images of the respective colors on the photoconductors 41 (Y, M, C, and K) are first-transferred onto the intermediate transfer belt 48 and overlaid, and thereby a color toner image is formed on the intermediate transfer belt 48.

The intermediate transfer belt 48 on which the color toner image is formed with the toner images of the respective colors transferred and overlaid reaches a position facing the second transfer roller 89. At this position, the second transfer backup roller 82 forms a second transfer nip by sandwiching the intermediate transfer belt 48 between itself and the second transfer roller 89. Then, the color toner image formed on the intermediate transfer belt 48 is transferred by the effect of, for example, a transfer bias applied to the second transfer backup roller 82 onto a recording medium P such as a transfer sheet transferred to the position of the second transfer nip. At this time, un-transferred toner that has not been transferred onto the recording medium P remains on the intermediate transfer belt 48. The intermediate transfer belt 48 having passed through the second transfer nip reaches the position of the unillustrated intermediate transfer cleaning device, and has the un-transferred toner on the surface thereof collected. In this way, the series of transfer process performed on the intermediate transfer belt 48 is completed.

Next, the behavior of the recording medium P will be explained.

The recording medium P conveyed to the second transfer nip described above is transferred thereto via a sheet feeding roller 27, a registration roller pair 28, etc., from a sheet feeding tray 26 provided in the sheet feeding section 200 provided below the printer section 100. Specifically, a plurality of sheets of recording media P are overlaid and stocked in the sheet feeding tray 26. When the sheet feeding roller 27 is driven to rotate in the counterclockwise direction FIG. 2, the topmost recording medium P is conveyed to a roller nip formed by the two rollers of the registration roller pair 28.

The recording medium P conveyed to the registration roller pair 28 stops once at the position of the roller nip of the registration roller pair 28 stopped from being driven to rotate. Then, by the registration roller pair 28 being started to rotate so as to be in time for the color toner image on the intermediate transfer belt 48 to arrive at the second transfer nip, the recording medium P is conveyed to the second transfer nip. In this way, a desired color toner image is transferred onto the recording medium P.

The recording medium P onto which the color toner image is transferred at the second transfer nip is conveyed to the position of a fixing device 86. Through the fixing device 86, the color toner image transferred onto the surface is fixed on the recording medium P with heat and pressure applied by a fixing belt and a pressurizing roller. The recording medium P passed through the fixing device 86 is discharged to the outside of the apparatus through the gap between the rollers of a sheet discharging roller pair 29. The recording medium P discharged to the outside of the apparatus by the sheet discharging roller pair 29 is stacked sequentially on a stacking section 30 as an output image. In this way, the series of image forming process in the copier 500 is completed.

Next, the configuration and operation of the developing device 50 in the image forming unit 46 will be explained in greater detail. The explanation will be given by taking the age forming unit 46Y corresponding to yellow for example. However, the image forming units 46 (M, C, and K) corresponding to the other colors have also the same configuration and operation.

As shown in FIG. 3, the developing device 50Y includes a developing roller 51Y as a developer bearing member, a doctor blade 52Y as a developer regulating plate, two developer conveying screws 55Y, a toner concentration detecting sensor 56Y, etc. The developing roller 51Y faces the photoconductor 41Y, and the doctor blade 52Y faces the developing roller 51Y. The two developer conveying screws 55Y are provided in two developer receptacles (53Y and 54Y). The developing roller 51Y is constituted by a magnet roller fixed thereinside, a sleeve rotating along the circumference of the magnet roller, etc. The first developer receptacle 53 and the second developer receptacle 54Y contain a two-component developer G composed of a carrier and a toner. The second developer receptacle 54Y communicates with a toner fall-down conveying path 64Y through an opening formed at the top thereof. The toner concentration detecting sensor 56Y detects the toner concentration in the developer G in the second developer receptacle 54Y.

The developer G in the developing device 50 circulates to and from the first developer receptacle 53Y and the second developer receptacle 54Y while being stirred by the two developer conveying screws 55Y. The developer G in the first developer receptacle 53Y is conveyed by one of the developer conveying screws 55Y, and supplied onto and borne by the surface of the sleeve of the developing roller 51Y by the effect of a magnetic field formed by the magnet roller in the developing roller 51Y. The sleeve of the developing roller 51Y is driven to rotate in the counterclockwise direction as indicated by an arrow in FIG. 3, and the developer G borne on the developing roller 51Y moves over the developing roller 51Y along with the rotation of the sleeve. At this time, the toner in the developer G is frictioned with the carrier in the developer G to be electrically charged to a potential of an opposite polarity to the carrier and electrostatically adsorbed to the carrier, to be thereby borne on the developing roller 51Y together with the carrier attracted to the magnetic field formed on the developing roller 51Y.

The developer G borne on the developing roller 51Y is conveyed in the arrow direction of FIG. 3 and reaches a doctor region at which the doctor blade 52Y and the developing roller 51Y face each other. When the developer G on the developing roller 51Y passes the doctor region, the amount of the developer is regulated and optimized. After this, the developer G is conveyed to a developing region, which is a position at which the developer faces the photoconductor 41Y. In the developing region, the toner in the developer G is adsorbed to a latent image that is formed on the photoconductor 41Y by a developing electric field formed between the developing roller 51Y and the photoconductor 41Y. The developer G remained on the surface of the developing roller 51Y passed through the developing region reaches above the first developer receptacle 53Y along with the rotation of the sleeve, and is detached from the developing roller 51Y at this position.

The toner concentration of the developer G in the developing device 50Y is adjusted to a certain range. Specifically, the toner housed in a toner housing container 32Y is replenished into the second developer receptacle 54Y through the toner replenishing device 60Y according to the amount of consumption of the toner contained in the developer G in the developing device 50Y along with development. The toner replenished into the second developer receptacle 54Y is mixed and stirred with the developer G by the two developer conveying screws 55Y, and circulates to and from the first developer receptacle 53Y and the second developer receptacle 54Y.

Next, the toner replenishing device 60 (Y, M, C, and K) will be explained.

Figure 4:
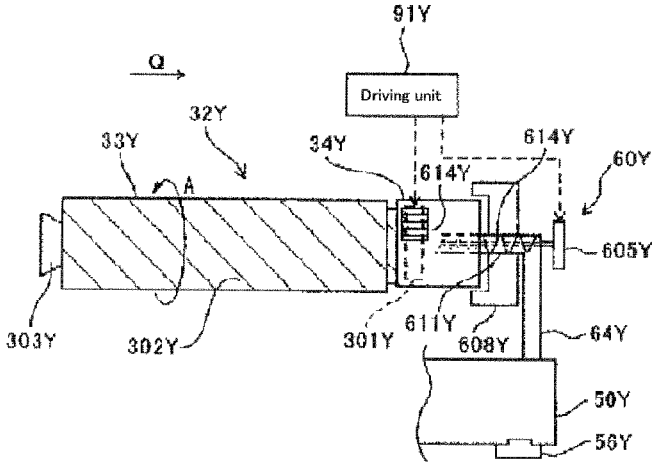
FIG. 4 is an exemplary diagram showing a state that a toner housing container is set in a toner replenishing device of the image forming apparatus shown in FIG. 2.
Figure 5:
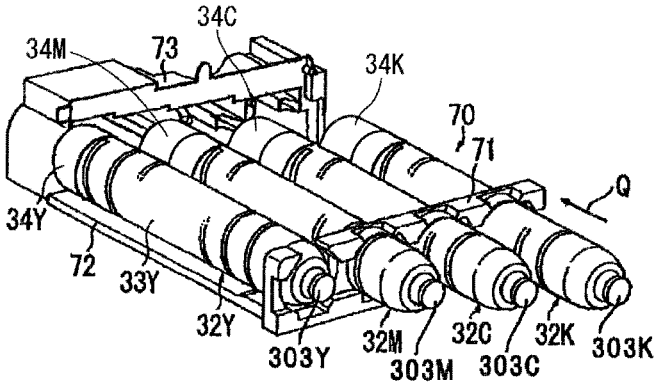
FIG. 5 is a schematic perspective diagram showing an example state that a toner housing container is set in a toner replenishing device.

FIG. 4 is an exemplary diagram showing a state that the toner housing container 32Y is mounted on the toner replenishing device 60Y. FIG. 5 is a schematic perspective diagram showing a state that four toner housing containers 32 (Y, M, C, and K) are mounted in the toner housing container accommodating section 70.

The toners in the toner housing containers 32 (Y, M, C, and K) mounted in the toner housing container accommodating section 70 of the printer section 100 are appropriately replenished into the developing devices 50 (Y, M, C, and K) according to the consumption of the toners in the developing devices 50 (Y, M, C, and K) for the respective colors, as shown in FIG. 4. At this time, the toners in the toner housing containers 32 (Y, M, C, and K) are replenished by the corresponding toner replenishing devices 60 (Y, M, C, and K) provided per toner color. The four toner replenishing devices 60 (Y, M, C, and K) and four toner housing containers 32 (Y, M, C, and K) have substantially the same configuration, except for using toners of different colors for the image forming process. Therefore, in the following, explanation will be given only on the toner replenishing device 60Y and toner housing container 32Y corresponding to yellow, and explanation on the toner replenishing devices 60 (M, C, and toner housing containers 32 (M, C, and K) corresponding to the other three colors will be skipped appropriately.

The toner replenishing device 60 (Y, M, C, and K) is constituted by the toner housing container accommodating section 70, a conveying nozzle 611 (Y, M, C, and K) as a conveying pipe, a conveying screw 614 (Y, M, C, and K) as a conveying member, a toner fall-down conveying path 64 (Y, M, C, and K), a container rotation driving unit 91 (Y, M, C, and K), etc.

For the expediency of explanation, a later-described container opening portion 33*a* side of a container body 33 of the toner housing container 32Y is defined as the container leading end side, and the side opposite to the container opening portion 33*a* (i.e., a later-described gripping portion 303 side) is defined as a container rear end side, based on the direction in which the toner housing container 32Y is mounted onto the toner replenishing device 60Y. When the toner housing container 32Y is moved in the direction of an arrow Q in FIG. 4 and mounted in the toner housing container accommodating section 70 of the printer section 100, in conjunction with this mounting motion, the conveying nozzle 611Y of the toner replenishing device 60Y is inserted into the toner housing container 32Y through the container leading end side thereof. As a result, the interior of the toner housing container 32Y and the interior of the conveying nozzle 611Y come into communication with each other. The mechanism of this establishment of communication in conjunction with the mounting motion will be described later in detail.

As for the form of the toner housing container, the toner housing container 32Y is an approximately cylindrical toner bottle. The toner housing container 32Y is mainly constituted by a container leading end side cover 34Y held non-rotatably on the toner housing container accommodating section 70, and a container body 33Y as a toner housing member with which a container gear 301Y is formed integrally. The container body 33Y is held rotatably relative to the container leading end side cover 34Y.

As shown in FIG. 5, the toner housing container accommodating section 70 is mainly constituted by a container cover receiving section 73, a container receiving section 72, and an insertion port forming section 71. The container cover receiving section 73 is a section in which the container leading end side cover 34Y of the toner housing container 32Y is held. The container receiving section 72 is a section on which the container body 33Y of the toner housing container 32Y is supported. The insertion port forming section 71 is a section that constitutes an insertion port for an operation of mounting the toner housing container 32Y onto the container receiving section 72. When an unillustrated body cover provided at the front side (i.e., a front side in the direction perpendicular to the sheet in which FIG. 2 is drawn) of the copier 500 is opened, the insertion port forming section 71 of the toner housing container accommodating section 70 appears. Then, while keeping the longer direction of the toner housing containers 32 (Y, M, C, and K) extending in the horizontal direction, an operation of mounting or demounting the toner housing containers 32 (Y, M, C, and K) (i.e., a mounting/demounting operation oriented in the longer direction of the toner housing containers 32 as a mounting/demounting direction) is performed from the front side of the copier 500. A set cover 608Y in FIG. 4 is part of the container cover receiving section 73 of the toner housing container accommodating section 70.

The container receiving section 72 is formed such that the length thereof in the longer direction is substantially the same as the length of the container body 33Y in the longer direction. The container cover receiving section 73 is provided at the container leading end side of the container receiving section 72 in the longer direction (mounting/demounting direction) thereof, and the insertion port forming section 71 is provided at one end side of the container receiving section 72 in the longer direction thereof. In FIG. 5, grooves, of which longer direction extends in the axial direction of the container bodies 33, are formed immediately below the four toner housing containers 32 so as to extend from the insertion port forming section 71 to the container cover receiving section 73. A pair of slide guides 361 (FIG. 7) are provided at the lower portion of the container leading end side cover 34 on both sides of the container leading end side cover, in order to allow the container body to fit with the groove and make a sliding move. The groove of the container receiving section 72 is provided with a pair of slide rails that protrude from both sides thereof. So as to sandwich the pair of slide rails from above and below respectively, slide grooves 361*a* are formed in the slide guides 361 in parallel with the axis of rotation of the container body 33. The container leading end side cover 34 includes a container locking portion 339 that engages with a replenishing device side locking member provided on the set cover 608 upon mounting on the toner replenishing device 60.

Hence, along with the operation of mounting the toner housing container 32Y, the container leading end side cover 34Y slides over the container receiving section 72 for a while after passing through the insertion port forming section 71, and after this, gets mounted on the container cover receiving section 73.

Figure 6:
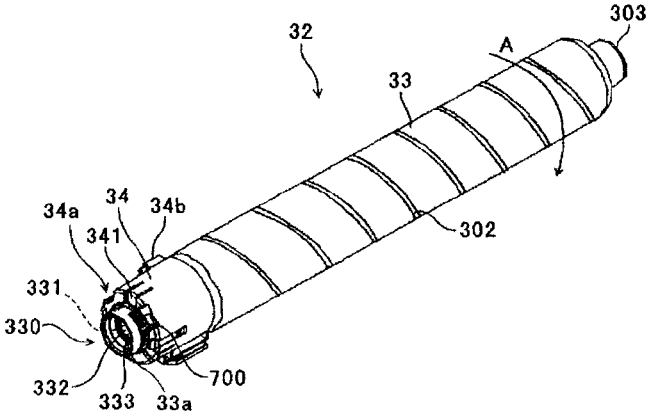
FIG. 6 is a perspective explanatory diagram showing an example configuration of a toner housing container of the present invention.

As shown in FIG. 6, the container leading end side cover 34 is provided with an ID tag (ID chip) 700 in which usage context of the toner housing container 32 and such data are recorded. The container leading end side cover 34 is also provided with a color-incompatible rib 34*b* that prevents a toner housing container 32 housing a toner of a given color from being mounted on the set cover 608 for a different color. The posture of the container leading end side cover 34 on the replenishing device 60 is determined when the slide guides 361 engage with the slide rails of the container receiving section 72 in the mounting operation. This allows the container locking portion 339 to be positionally aligned with the replenishing device side locking member 609 smoothly and the ID tag 700 to be positionally aligned with a connector on the apparatus body smoothly. The ID tag is an electronic substrate provided with a memory element for storing information of the toner housing container (the color of the toner housed, how many times the container is used, etc.), and is not limited to as described in the present embodiment. The system may not include the ID tag.

Figure 8:
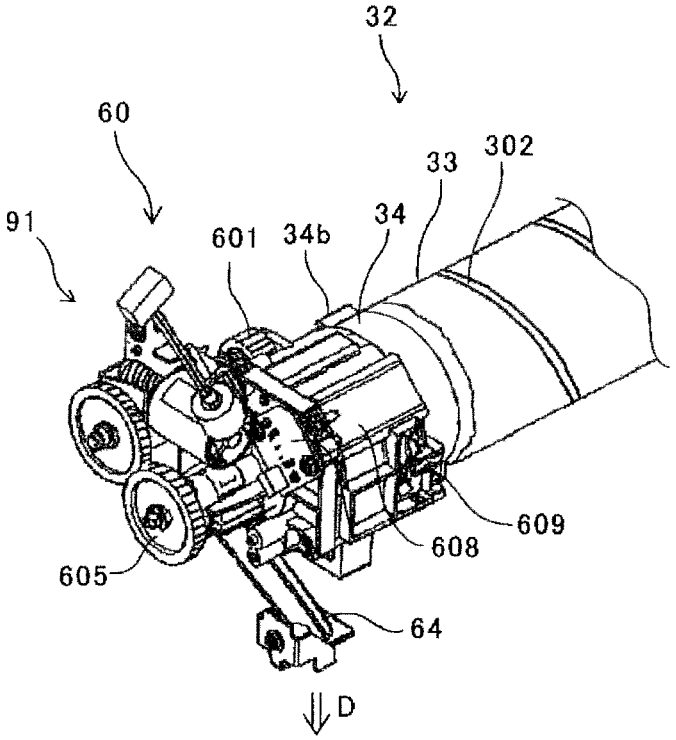
FIG. 8 is a perspective explanatory diagram of an example of a toner conveying device mounted with a toner housing container and the toner housing container.

In the state that the container leading end side cover 34Y is mounted on the container cover receiving section 73, rotation driving is input to the container gear 301Y (FIG. 10) provided on the container body 33Y from the container rotation driving unit 91Y constituted by a driving motor, a driving gear, etc. through a container driving gear 601Y as shown in FIG. 8. As a result, the container body 33Y is driven to rotate in the direction of the arrow A in FIG. 4. The rotation of the container body 33Y causes rotation of also a spiral projection 302Y (rotary conveying portion) formed in a spiral form on the internal circumferential surface of the container body 33Y, to thereby convey the toner housed in the container body 33Y along the longer direction of the container body from one end (i.e., the gripping portion 303 side) located at the left-hand side of FIG. 4 to the other end (i.e., the container opening portion 33*a* side) located at the right-hand side. As a result, the toner is supplied into the conveying nozzle 611Y from the container leading end side cover 34Y provided at the other end 33. In other words, the rotation of the spiral projection 302Y causes the toner to be supplied into the conveying nozzle 611Y inserted into a nozzle receiving port 331Y.

A conveying screw 614Y is provided in the conveying nozzle 611Y. The conveying screw 614Y rotates upon input of rotation driving into a conveying screw gear 605Y from the container rotation driving unit 91Y, and conveys the toner supplied into the conveying nozzle 611Y. The conveying direction downstream end of the conveying nozzle 611Y is cc connected to the toner fall-down conveying path 64Y. The toner conveyed by the conveying screw 614Y falls through the toner fall-down conveying path 64Y by its own weight and is replenished into the developing device 50Y (the second developer receptacle 54Y).

When the toner housing containers 32 (Y, M, C, and K) have expired (i.e., when the containers have become empty with almost all of the housed toner consumed), they are replaced with new ones respectively. The toner housing container 32 is provided with the gripping portion 303 at a longer-direction one end thereof that is opposite to the container leading end side cover 34. For the replacement, the replacement personnel can remove the mounted toner housing container 32 by gripping the gripping portion 303 and withdrawing the container.

The toner replenishing device 60Y controls the amount of toner to be supplied into the developing device 50Y based on the rotation speed of the conveying screw 614Y. Hence, the toner having passed through the conveying nozzle 611Y is directly conveyed into the developing device 50Y through the toner fall-down conveying path 64Y with the amount of supply into the developing device 50 uncontrolled. Even the toner replenishing device 60Y, of which conveying nozzle 611Y is inserted into the toner housing container 32Y as in the present embodiment, may be provided with a first toner reservoir such as a toner hopper.

The toner replenishing device 60Y of the present embodiment is configured to convey the toner supplied into the conveying nozzle 611Y by the conveying screw 614Y. However, the conveying member for conveying the toner supplied into the conveying nozzle 611Y is not limited to a screw member. For example, a mechanism for imparting a conveying force by means of a member other than a screw member may also be employed, such as a mechanism for generating a negative pressure at the opening of the conveying nozzle 611Y by means of a well-known powder pump.

Next, the toner housing containers 32 (Y, M, C, and K) and the toner replenishing devices 60 (Y, M, C, and K) of the present embodiment will be explained in greater detail. As described above, the toner housing containers 32 (Y, M, C, and K) and the toner replenishing devices 60 (Y, M, C, and K) have substantially the same configuration, except for using different colors of toners. Hence, the following explanation will be given by omitting the suffixes Y, M, C, and K representing the colors of the toners.

Figure 7:
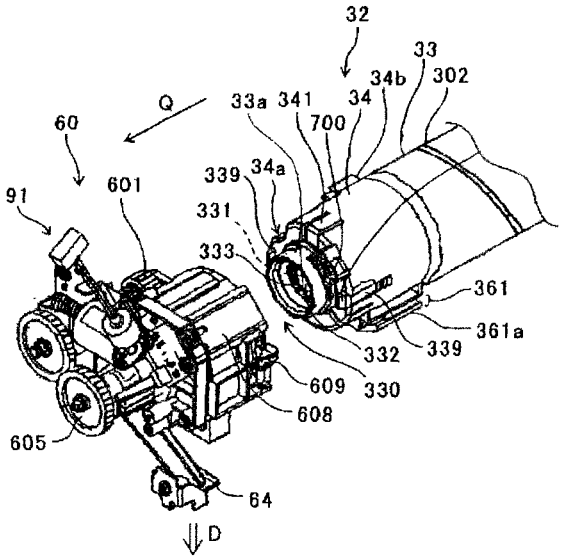
FIG. 7 is a perspective explanatory diagram of an example of a toner conveying device before mounted with a toner housing container and the toner housing container.

FIG. 6 is a perspective diagram explaining the toner housing container 32. FIG. 7 is a perspective diagram explaining the toner replenishing device 60 before mounted with the toner housing container 32 and the leading end of the toner housing container 32. FIG. 8 is a perspective diagram explaining the toner replenishing device 60 mounted with the toner housing container 32, and the container leading end of the toner housing container 32.

Figure 9:
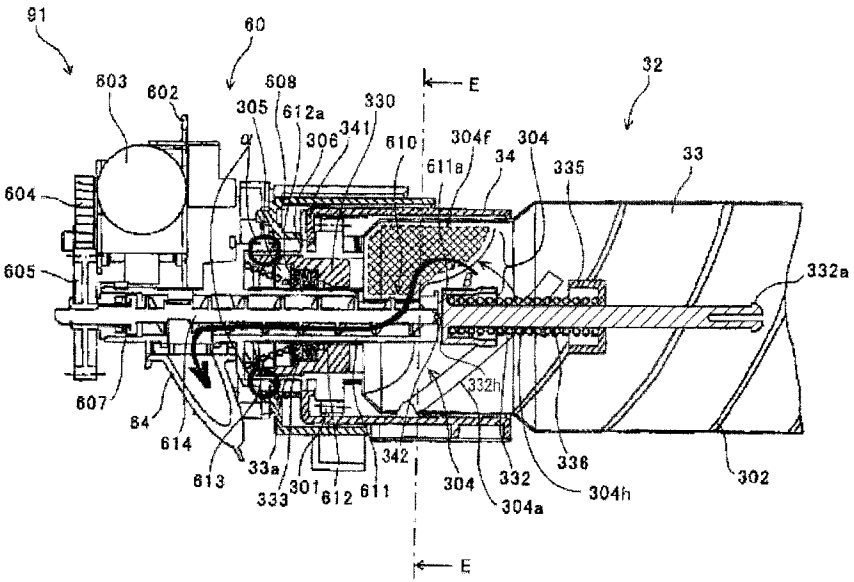
FIG. 9 is a cross-sectional explanatory diagram of an example of a toner conveying device mounted with a toner housing container and the toner housing container.

FIG. 1 is a cross-sectional diagram explaining the toner replenishing device 60 before mounted with the toner housing container 32 and the container leading end of the toner housing container 32. FIG. 9 is a cross-sectional diagram explaining the toner replenishing device 60 mounted with the toner housing container 32 and the container leading end of the toner housing container 32.

The toner replenishing device 60 includes the conveying nozzle 611 in which the conveying screw 614 is provided, and a nozzle shutter 612. The nozzle shutter 612 closes a nozzle opening 610 formed in the conveying nozzle 611 while in a non-mounted state (the state of FIG. 1 and FIG. 7) before mounted with the toner housing container 32, and opens the nozzle opening 610 while in a mounted state (the state of FIG. 8 and FIG. 9) after mounted with the toner housing container 32. On the other hand, a nozzle receiving port 331 as a pipe insertion port into which the conveying nozzle 611 is inserted while in the mounted state is formed in the center of the leading end surface of the toner housing container 32, and there is provided a container shutter 332 as an opening/closing member for closing the nozzle receiving port 331 while in the non-mounted state.

First, the toner housing container 32 will be explained.

Figure 10:
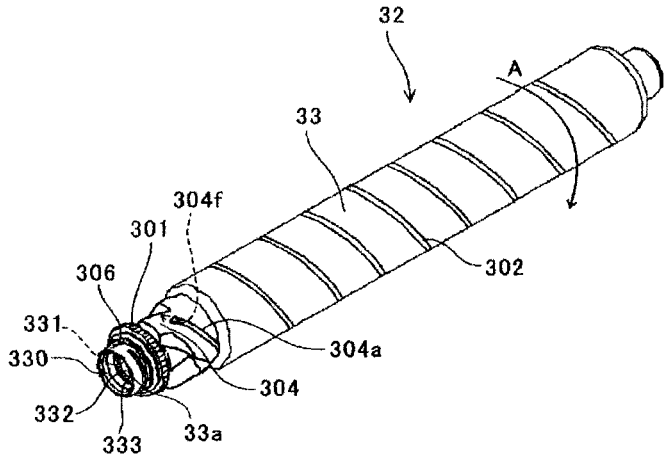
FIG. 10 is a perspective explanatory diagram of an example toner housing container in a state that a cover at the leading end is removed.

As described above, the toner housing container 32 is mainly constituted by the container body 33 and the container leading end side cover 34. FIG. 10 is a perspective diagram explaining a state of the toner housing container 32 from which the container leading end side cover 34 is removed from the state of FIG. 6. Note that the toner housing container 32 of the present invention is not limited to one that is mainly constituted by the container body 33 and the container leading end side cover 34. For example, when omitting the functions of the container leading end side cover 34 such as the slide guides 361 and the ID tag 700, the toner housing container may be used in the state of FIG. 10 in which there is no container leading end side cover 34. Further, the toner housing container can be free from the container leading end side cover by having such functions as the slide guides 361 and the ID tag 700 on the toner housing container.

Figure 11:
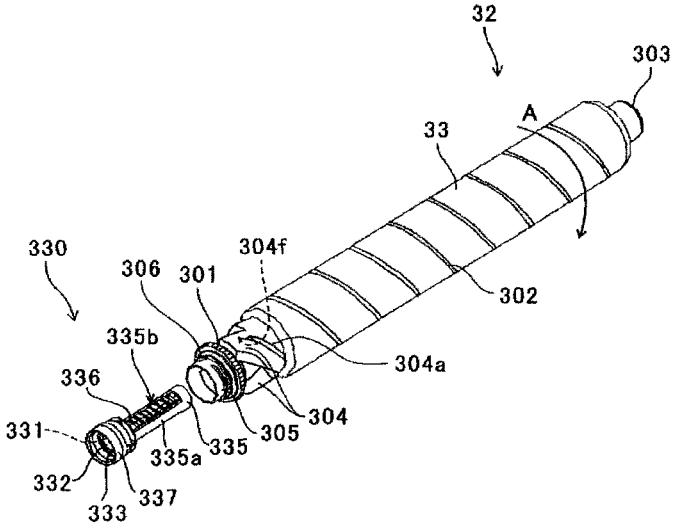
FIG. 11 is a perspective explanatory diagram of an example toner housing container in a state that a nozzle receiving member is removed from a container body.
Figure 12:
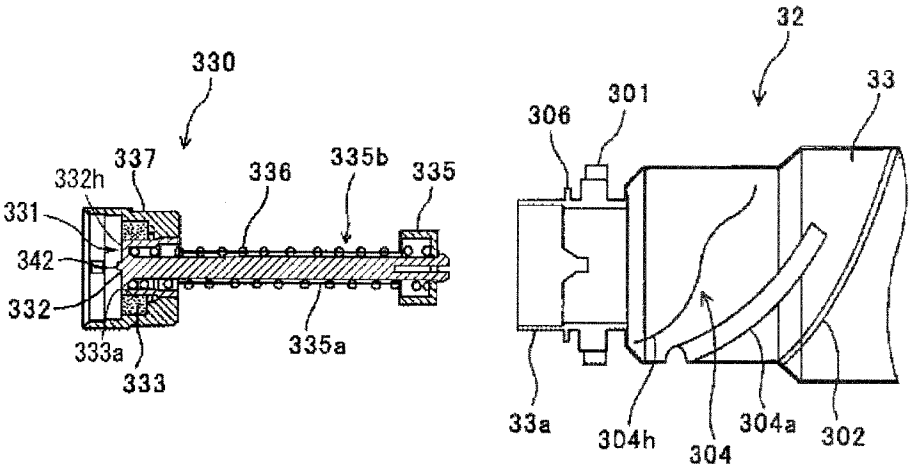
FIG. 12 is a cross-sectional explanatory diagram of an example toner housing container in a state that a nozzle receiving member is removed from a container body.
Figure 13:
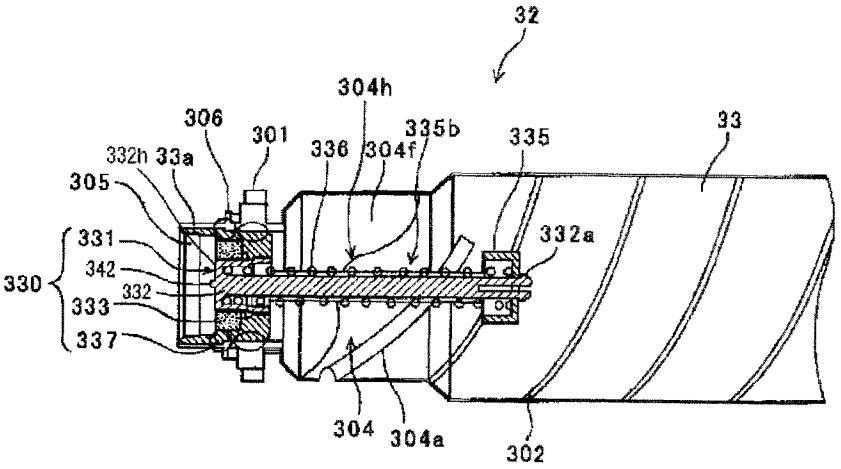
FIG. 13 is a cross-sectional explanatory diagram of an example toner housing container in a state that the nozzle receiving member is mounted on the container body from the state of FIG. 12.

FIG. 11 is a perspective diagram explaining a state of the toner housing container 32 from which a nozzle receiving member 330 as a pipe insertion member is removed from the container body 33 from the state of FIG. 10. FIG. 12 is a cross-sectional diagram explaining the state of the toner housing container 32 from which the nozzle receiving member 330 is removed from the container body 33. FIG. 13 is a cross-sectional diagram explaining a state of the toner housing container 32 mounted with the nozzle receiving member 330 on the container body 33 from the state of FIG. 12 (a state of the toner housing container 32 from which the container leading end side cover 34 is removed as in FIG. 10).

As shown in FIG. 10 and FIG. 11, the container body 33 is approximately cylindrical, and configured to rotate about the center axis of the cylinder as the rotation axis. Hereinafter, a direction parallel with this rotation axis will be referred to as "rotation axis direction", and a side in the rotation axis direction at which the nozzle receiving port 331 of the toner housing container 32 is formed (i.e., a side at which the container leading end side cover 34 is provided) will be referred to as "container leading end side". A side at which the gripping portion 303 of the toner housing container 32 is provided (i.e., a side opposite to the container leading end side) will be referred to as "container rear end side". The aforementioned longer direction of the toner housing container 32 is the rotation axis direction. When the toner housing container 32 is mounted on the toner replenishing device 60, the rotation axis direction is a horizontal direction. A portion of the container body 33 that is on the container rear end side from the container gear 301 has an external diameter greater than the container leading end side, and the spiral projection 302 is formed on the internal circumferential surface of this portion. When the container body 33 rotates in the direction of the arrow A in the drawing, a conveying force to move from the rotation axis direction one end side (the container rear end side) to the other end side (the container leading end side) is imparted to the toner in the container body 33 by the effect of the spiral projection 302. That is, the spiral projection as a conveying portion is provided inside the container body.

Figure 32:
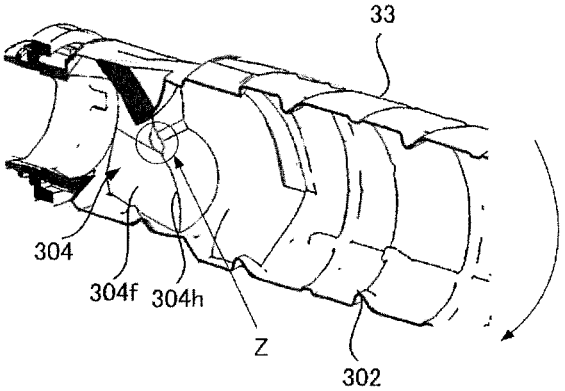
FIG. 32 is a perspective cross-sectional diagram showing a configuration of a toner housing container of the present invention.

An uplifting portion 304 is formed on the internal wall of the container body 33 at the container leading end side. When the toner is conveyed to the container leading end side by the spiral projection 302 along with rotation of the container body 33 in the direction of the arrow A of FIG. 10 and FIG. 11, the uplifting portion 304 uplifts the conveyed toner upward by means of the rotation of the container body 33. The uplifting portion 304 is constituted by a boss **304*h* and an uplifting wall surface 304*f* as shown in FIG. 13 and FIG. 32**.

The boss **304*h* is a portion (rising portion) that rises inward in the container body 33 toward the center of rotation of the container body 33 while forming a spiral like a ridge line of a mountain. The uplifting wall surface 304*f* is a wall surface that connects the boss 304*h* with the internal circumferential wall of the container body 33 and that is on the container-rotation-direction downstream side of the boss 304*h***.

When the toner comes into an internal space facing the uplifting portion 304 by the conveying force of the spiral projection 302 while the uplifting wall surface **304*f* is located at the lower side, the uplifting wall surface 304*f* uplifts the toner upward along with rotation of the container body 33. This enables the toner to be uplifted above the inserted conveying nozzle 611**. That is, the toner is uplifted from the lower side to the upper side.

When the rotation advances further, the toner uplifted by the uplifting wall surface **304*f*** slips off from the uplifting wall surface due to the gravity force, or collapses and falls down.

The conveying nozzle 611, which is a later-described conveying pipe on the apparatus body, is present at here the toner slips off to. Therefore, the toner is moved into a nozzle opening of the conveying pipe.

Figure 30:
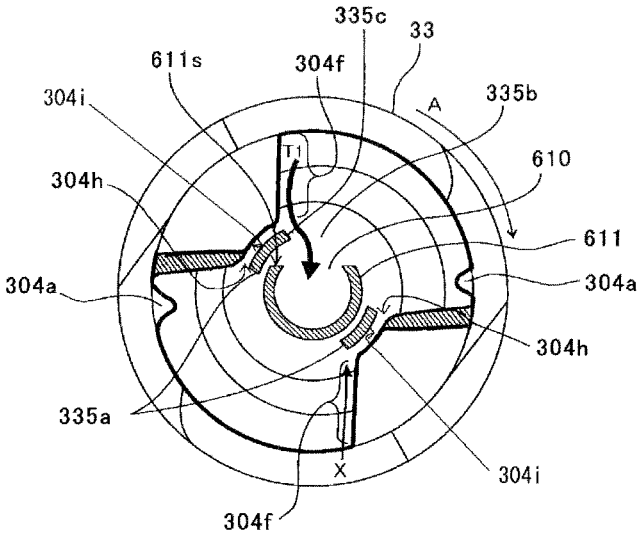
FIG. 30 is a cross-sectional diagram of FIG. 9 taken along a line E-E.

FIG. 30 is a cross-sectional diagram taken along a line E-E of FIG. 9. As shown in FIG. 30, a boss **304*h* is shaped like a gentle mountain as influenced by the container body 33** being formed by blow molding.

In FIG. 9, etc., a boss **304*h* is expressed with a curve for the convenience of distinguishing the uplifting portion 304. An uplifting wall surface 304*f* is a region expressed with grating as in FIG. 9, and so as to be in a point symmetry with respect to the rotation axis of the container body 33 as shown in FIG. 30, there are a pair of inclined surfaces constituting uplifting wall surfaces 304*f* connecting the bosses 304*h* with the internal circumferential surface of the container body 33. The boss 304*h* is provided so as to protrude from the container internal wall surface from which it rises toward the opposite internal wall surface facing this internal wall surface, and so as to extend continuously in the direction toward the opening portion. In the region represented by the cross-section taken along the line E-E of FIG. 9, an internal wall surface on the container-rotation-direction upstream side of the boss 304*h* appears as a thick wall as in FIG. 30, since the direction along the line E-E for sectioning FIG. 9 to obtain the cross-section and the extending direction of this internal wall surface are roughly the same. The boss 304***h* is located at this seemingly thick portion.

Figure 33:
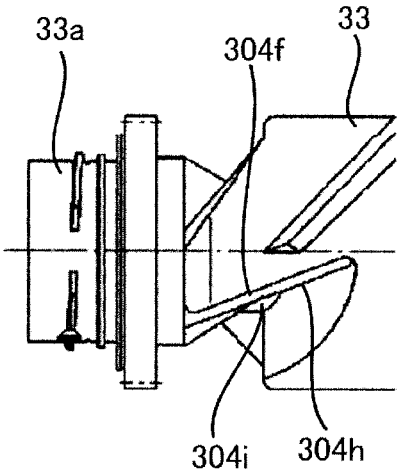
FIG. 33 is a side elevation showing a configuration of a toner housing container of the present invention.

Because of a further necessity of conveying the toner in the direction toward the container opening portion 33*a*, the uplifting wall surface 304*f* is inclined so as to be farther from the longer direction axial line (i.e., the dashed-dotted line in FIG. 33) of the container body 33 as the uplifting wall surface extends more from the boss 304*h* toward the container opening portion 33*a* as shown in FIG. 33. With this configuration, when the uplifting wall surface uplifts the toner by rotating, the uplifting wall surface inclines toward the opening portion (i.e., a direction extending from the boss to the opening portion becomes not horizontal but oblique downward; to elaborate, the uplifting wall surface inclines outward in the radial direction of the container from the longer-direction axial line). This makes it easier for the toner to be conveyed in the direction toward the container opening portion.

The container gear 301 is formed at a more container leading end side of the container body 33 than the uplifting portion 304. The container leading end side cover 34 is provided with a gear exposing opening 34*a* from which a portion (at a deeper side of FIG. 6) of the container gear 301 is exposed when the container leading end side cover is mounted on the container body 33. When the toner housing container 32 is mounted on the toner replenishing device 60, the container gear 301 exposed from the gear exposing opening 34*a* engages with the container driving gear 601 of the toner replenishing device 60.

The container opening portion 33*a* having a cylindrical shape is formed at a more container leading end side of the container body 33 than the container gear 301. By press-fitting a receiving member fixing portion 337 of the nozzle receiving member 330 into the container opening portion 33*a*, it is possible to fix the nozzle receiving member 330 into the container body 33. The method for fixing the nozzle receiving member 330 is not limited to press fitting, but may be fixing with an adhesive and fixing by screwing.

The toner housing container 32 is configured such that a toner is filled into the container body 33 thereof from the opening of the container opening portion 33*a*, and after this, the nozzle receiving member 330 is fixed into the container opening portion 33*a* of the container body 33.

A cover claw hooking portion 306 is formed at the container gear 301 side end of the container opening portion 33*a* of the container body 33. The container leading end side cover 34 is mounted on the toner housing container 32 (container body 33) being in the state shown in FIG. 10, from the container leading end side (the lower-left side of FIG. 10). As a result, the container body 33 extends through the container leading end side cover 34 in the rotation axis direction, and a cover claw 341 provided on the top portion of the container leading end side cover 34 is hooked in the cover claw hooking portion 306. The cover claw hooking portion 306 is formed so as to extend round the external circumferential surface of the container opening portion 33*a*. By the cover claw 341 being hooked, the container body 33 and the container leading end side cover 34 can be mounted on each other rotatably relative to each other.

The container body 33 is formed by biaxial stretching blow molding process. This biaxial stretching blow molding process is typically a two-stage process including a pre-form molding step and a thing blow molding step. In the pre-form molding step, a resin is injection-molded into a pre-form having a test tube shape. By this injection molding, the container opening portion 33*a*, the cover claw hooking portion 306, and the container gear 301 are formed at the mouth portion of the test tube shape. In the stretching blow molding step, the pre-form that has been cooled after the pre-form molding step and released from the molding die is heated and softened, and after this, blow-molded and stretched.

The portions of the container body 33 that are on the container rear end side of the container gear 301 are molded in the stretching blow molding step. That is, the uplifting portion 304, the portion where the spiral projection 302 is formed, and the gripping portion 303 are molded in the stretching blow molding step.

The portions of the container body 33 that are on the container leading end side of the container gear 301, such as the container gear 301, the container opening portion 33*a*, the cover claw hooking portion 306, etc. remain as their shapes on the pre-form obtained by the injection molding, which ensures them a molding precision. On the other hand, the uplifting portion 304, the portion where the spiral projection 302 is formed, and the gripping portion 303 are stretched and molded in the stretching blow molding step after injection-molded, which results in a poorer molding precision than the portions obtained by the pre-form molding.

Next, the nozzle receiving member 330 fixed into the container body 33 will be explained.

Figure 14:
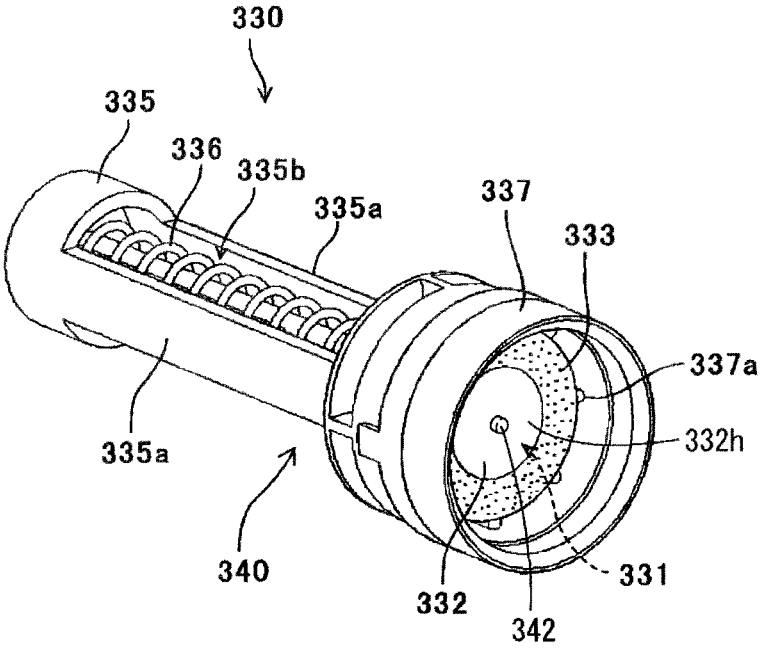
FIG. 14 is a perspective explanatory diagram of an example nozzle receiving member seen from a container leading end side.
Figure 15:
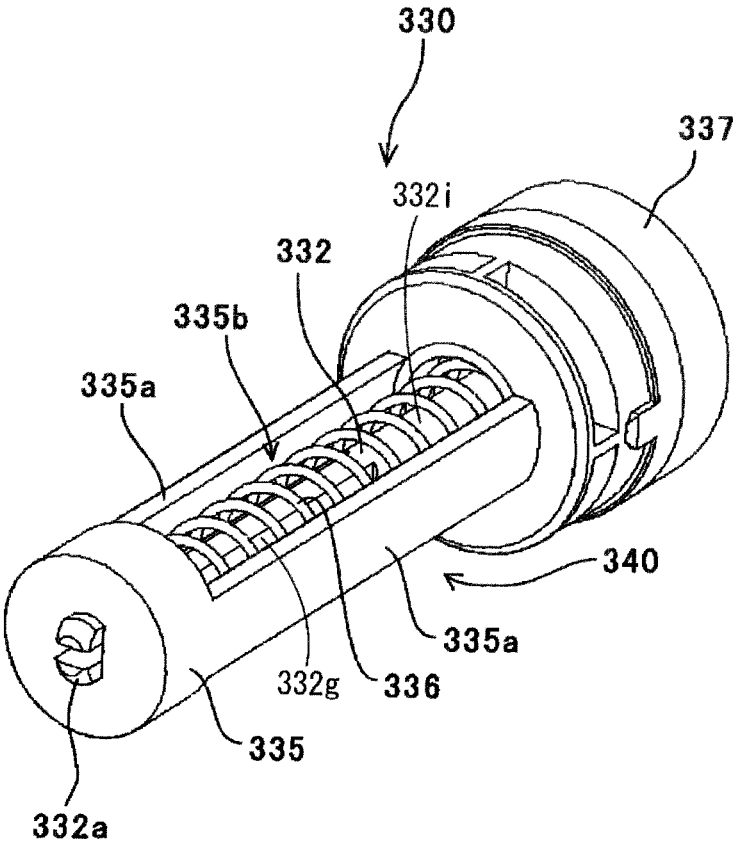
FIG. 15 is a perspective explanatory diagram of an example nozzle receiving member seen from a container rear end side.
Figure 16:
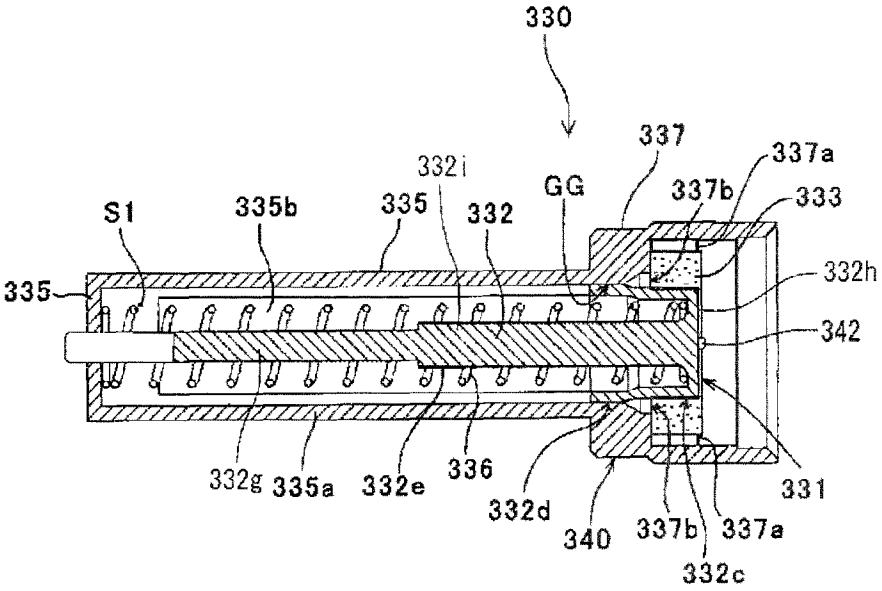
FIG. 16 is a cross-sectional diagram of an example nozzle receiving member in the state shown in FIG. 13.
Figure 17:
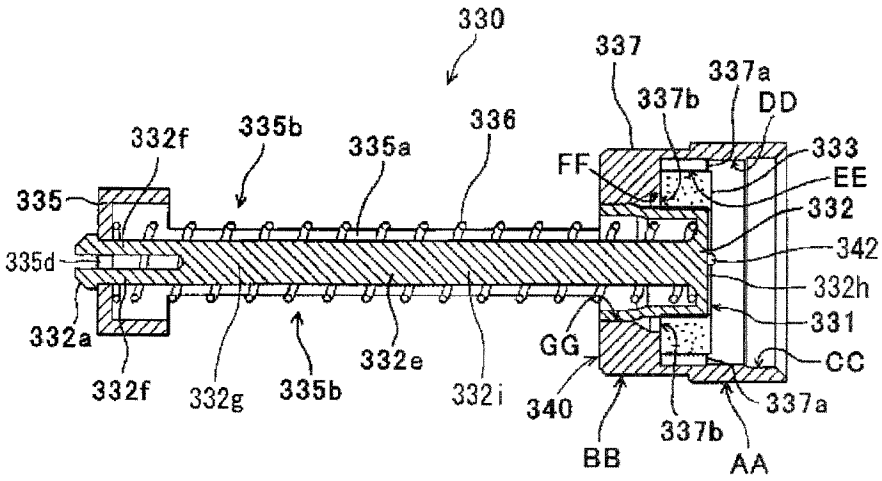
FIG. 17 is a cross-sectional diagram of an example nozzle receiving member in the state shown in FIG. 13.
Figure 18:
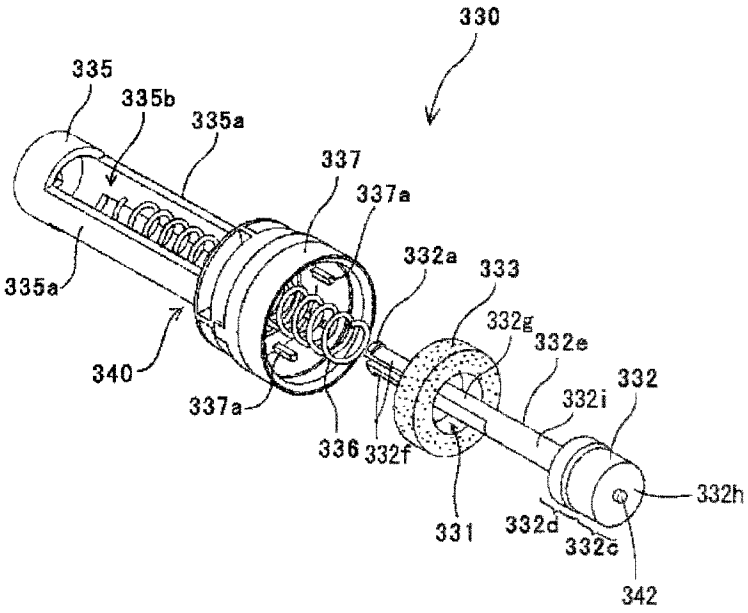
FIG. 18 is an exploded perspective diagram of an example nozzle receiving member.

FIG. 14 is a perspective diagram explaining the nozzle receiving member 330 seen from the container leading end side. FIG. 15 is a perspective diagram explaining the nozzle receiving member 330 seen from the container rear end side. FIG. 16 is a top cross-sectional diagram of the nozzle receiving member 330 in the state of FIG. 13 seen from the top. FIG. 17 is a lateral cross-sectional diagram of the nozzle receiving member 330 in the state of FIG. 13 seen from a lateral side (a deeper side of FIG. 13). FIG. 18 is an exploded perspective diagram of the nozzle receiving member 330.

The nozzle receiving member 330 is constituted by a container shutter support member 340 as a support member, a container shutter 332, a container seal 333 as a sealing member, a container shutter spring 336 as a biasing member, and a receiving member fixing portion 337. The container shutter support member 340 is constituted by a shutter rear end support portion 335 as a rear end portion, shutter side surface support portions 335*a* (protruding portions) as a side surface portions having a flat plate shape, shutter support opening portions 335*b* as side surface opening portions, and the receiving member fixing portion 337. The container shutter spring 336 is constituted by a coil spring.

A shutter side surface support portion 335*a* (protruding portion) serving as a protruding portion, and a shutter support opening portion 335*b*, which are provided on the container shutter support member 340, are provided side by side with each other in the rotation direction of the toner housing container. Two shutter side surface support portions 335*a* (protruding portions) facing each other form part of a cylindrical shape. The cylindrical shape is largely cut out at the positions of the shutter support opening portions 335*b* (two positions). With this configuration, a circular-columnar space S1 (FIG. 16) is formed in the cylindrical shape, and the container shutter 332 can be guided to move through this space in the inserting direction of the conveying nozzle 661 i.e., so as to move to an opening position to open the nozzle receiving port 331 and to move to a closing position to close the nozzle receiving port 331.

To sum up, the container body includes the protruding portions that protrude from the container body interior side of the container opening portion toward the container rear end side.

The nozzle receiving member 330 fixed into the container body 33 rotates together with the container body 33 when the container body 33 rotates. At this time, the shutter side surface support portions 335*a* (protruding portions) of the nozzle receiving member 330 rotate around the conveying nozzle 611 of the toner replenishing device 60. Therefore, the shutter side surface support portions 335*a* (protruding portions) and the shutter support opening portions 335*b* that are rotating alternately pass the region immediately above the nozzle opening 610 formed at the top portion of the conveying nozzle 611. Therefore, even if a toner deposition occurred above the nozzle opening 610 for an instant, the shutter side surface support portion 335*a* (protruding portion) would go across and collapse the toner deposition. This would prevent aggregation of toner deposition while in an idle state, and hence prevent a toner conveying failure upon resume. On the other hand, at the timing at which the shutter side surface support portions 335*a* (protruding portions) are located on the lateral sides of the conveying nozzle 611, and the shutter support opening portion 3356 faces the nozzle opening 610, the toner will pass through the shutter support opening portion 335*b* as indicated by an arrow β in FIG. 9. Hence, the toner in the container body 33 will be supplied into the conveying nozzle 611.

The container shutter 332 is constituted by a leading end cylindrical portion 332*c* as a closing portion, a sliding portion 332*d*, a so guide rod 332*e*, and shutter slip-off preventing claws 332*a*. The leading end cylindrical portion 332*c* is a portion that is on the container leading end side and hermetically contacts a cylindrical opening (the nozzle receiving port 331) of the container seal 333. The sliding portion 332*d* is a cylindrical portion that is on a more container rear end side than the leading end cylindrical portion 332*c*, has a greater external diameter than the leading end cylindrical portion 332*c*, and slides on the internal circumferential surfaces of the pair of shutter side surface support portions 335*a* (protruding portions).

The guide rod 332*e* is a rod member that rises from the cylinder interior of the leading end cylindrical portion 332*c* toward the container rear end side, and is a rod portion that, by being inserted into the coil of the container shutter spring 336, restricts the container shutter spring 336 so as not to allow the spring to buckle.

A guide rod sliding portion 332*g* is a pair of planer surfaces formed on both sides of the center axis of the guide rod 332*e* from a middle portion of the circular-columnar guide rod 332*e*. The container rear end side of the guide rod sliding portion 332*g* branches into two and forms a pair of cantilevers 332*f*.

The shutter slip-off preventing claws 332*a* are a pair of claws that are provided at an end of the guide rod 332*e* opposite from the base end thereof from which the guide rod rises, and at the end of the cantilevers 332*f*, and prevent the container shutter 332 from slipping off from the container shutter support member 340.

As shown in FIG. 16 and FIG. 17, the leading end side end of the container shutter spring 336 abuts on the internal wall surface of the leading end cylindrical portion 332*c*, and the rear end side end of the container shutter spring 336 abuts on the wall surface of the shutter rear end support portion 335. At this time, the container shutter spring 336 is compressed. Therefore, the container shutter 332 receives a biasing force in a direction to be away from the shutter rear end support portion 335 (the rightward direction in FIG. 16 and FIG. 17: a direction toward the container leading end). However, the shutter slip-off preventing claws 332*a* formed on the container rear end side end of the container shutter 332 hook on the external wall surface of the shutter rear end support portion 335. This prevents the container shutter 332 from being moved in the direction to be away from the shutter ear end support portion 335 by more than the state shown in FIG. 16 and FIG. 17.

Positioning is effected by this hooking of the shutter slip-off preventing claws 332*a* on the shutter rear end support portion 335, and by the biasing force of the container shutter spring 336. Specifically, the leading end cylindrical portion 332*c* and the container seal 333, which exert the toner leakage preventing function of the container shutter 332, are positioned with respect to the container shutter support member 340 in the axial direction. They are positioned so as to hermetically contact each other, to thereby make it possible to prevent leakage of the toner.

The receiving member fixing portion 337 has a tubular shape, of which diameters on the external circumferential surface and the internal circumferential surface decrease stepwise toward the container rear end side. The diameters gradually decrease from the container leading end side to the contain ear end side. As shown in FIG. 17, the external circumferential surface thereof has two external diameter portions (external circumferential surfaces AA and BB from the container leading end), and the internal circumferential surface thereof has five internal diameter portions (internal circumferential surfaces CC, DD, EE, FF, and GG from the container leading end). The boundary between the external circumferential surface AA and the external circumferential surface BB of the external circumference is a taper surface. The boundary between the fourth internal diameter portion FF and the fifth internal diameter portion GG of the internal circumferential surface is also a taper surface. The internal diameter portion FF of the internal circumferential surface and the taper surface connecting with this portion correspond to a seal member roll-in preventing space 337*b* described later, and the edge lines of these surfaces correspond to the sides of a pentagonal cross-section described later.

As shown in FIG. 16 to FIG. 18, the pair of shutter side surface support portions 335*a* (protruding portions) facing each other and having a form of a piece obtained by cutting a cylinder in the axial direction thereof protrude from the receiving member fixing portion 337 toward the container rear end side. Ends of the two shutter side surface support portions 335*a* (protruding portions) on the container rear end side connect with the shutter ear end support portion 335 having a cup shape provided with a circular hole in the center of the bottom thereof. By facing each other, the two shutter side surface support portions 335*a* (protruding portions) internally have a circular-columnar space S1 that is recognized with their cylindrical internal wall surfaces and imaginary cylindrical surfaces extended from these surfaces. The cylindrical shape defining the receiving member fixing portion 337 has an internal diameter that is the same as the diameter of the circular-columnar space S1, and has the fifth internal diameter portion GG counted from the leading end as the internal circumferential surface thereof. The sliding portion 332*d* of the container shutter 332 slides in this circular-columnar space S1 and on the cylindrical internal circumferential surface GG. The third internal circumferential surface EE of the receiving member fixing portion 337 is a circumferential surface of an imaginary circle that passes longer-direction tops of nozzle shutter striking ribs 337*a* arranged at 45[°] intervals equiangularly. The cylindrical (circular-tubular) container seal 333, of which cross-section (i.e., cross-section in the cross-sectional diagrams of FIG. 16 and FIG. 17) is a quadrangle, is provided to conform to this internal circumferential surface EE. The container seal 333 is fixed on a vertical surface that connects the third internal circumferential surface EE with the fourth internal circumferential surface FF with an adhesive, a double-face tape, or the like. The exposed surface of the container seal 333, which is on the opposite side (the right-hand side in FIG. 16 and FIG. 17) from this adhesive surface, constitutes the inner bottom of a cylindrical opening of the cylindrical receiving member fixing portion 337 (or of the container opening portion).

As shown in FIG. 16 and FIG. 17, a seal member roll-in preventing space 337*b* (a tucking preventing space) is formed so as to correspond to the internal circumferential surface FF of the receiving member fixing portion 337 and the taper surface extending from this surface. The seal member roll-in preventing space 337*b* is a ring-shaped sealed space enclosed by three different members. That is, it is a ring-shaped space enclosed by the internal circumferential surface (the fourth internal circumferential surface FF and the taper surface extending from this) of the receiving member fixing portion 337, the vertical surface of the container seal 33 at which it is adhesively fixed, and the external circumferential surface of the container shutter 332 from the leading end cylindrical portion 332*c* to the sliding portion 332*d*. The cross-section (i.e., the cross-section in the cross-sectional diagram of FIG. 16 and FIG. 17) of this ring-shaped space is a pentagonal shape. The angle formed between the internal circumferential surface of the receiving member fixing portion 337 and the end surface of the container 333, and the angle formed between the external circumferential surface of the container shutter 332 and the end surface of the container seal 333 are both 90[°].

The function of the seal member roll-in preventing space 337*b* will be described. When the container shutter 332 is moved from a state of closing the nozzle receiving port 331 toward the container rear end, the internal circumferential surface of the container seal 333 slides relative to the leading end cylindrical portion 332*c* of the container shutter 332. Hence, the internal circumferential surface of the container seal 333 is dragged by the container shutter 332 and elastically deformed so as to move toward the container rear end.

At this time, if there is no seal member roll-in preventing space 337*b*, and the vertical surface (the adhesive surface of the container seal 333) connecting with the third internal circumferential surface connects with the fifth internal circumferential surface GG orthogonally, there is a risk of the following state. Specifically, the elastically deformed portion of the container seal 333 is tucked in and rolled in between the internal circumferential surface of the receiving member fixing portion 337 sliding relative to the container shutter 332 and the external circumferential surface of the container shutter 332. If the container seal 333 is rolled in between the sliding portions of the receiving member fixing portion 337 and container shutter 332, i.e., between the internal circumferential surface GG and the leading end cylindrical portion 332*c*, the container shutter 332 is locked to the receiving member fixing portion 337 and cannot open or close the nozzle receiving port 331.

Compared with this, the nozzle receiving member 330 of the present embodiment has the seal member roll-in preventing space 337*b* formed at the internal circumference thereof. The internal diameters of the seal member roll-in preventing space 337*b* (i.e., the internal diameters of the internal circumferential surface EE and of the taper surface extending from this surface) are smaller than the external diameter of the container seal 333. Therefore, the container seal 333 as a whole would not enter the seal member roll-in preventing space 337*b*. Further, there is a limit to a range of the container seal 333 that may be dragged by the container shutter 332 and elastically deformed, and the container seal will return by its own elasticity before reaching the internal circumferential surface GG and getting rolled in. With this effect, it is possible to prevent making it impossible to perform opening or closing of the nozzle receiving port 331 due to the container shutter 332 being locked to the receiving member fixing portion 337.

As shown in FIG. 16 to FIG. 18, a plurality of nozzle shutter striking ribs 337*a* are formed on the internal circumferential surface of the receiving member fixing portion 337 adjoining the external circumference of the container seal 333 such that the ribs extend radially. As shown in FIG. 16 and FIG. 17, when the container seal 333 is fixed on the receiving member fixing portion 337, a vertical surface of the container seal 333 on the container leading end side slightly sticks out from the container leading end side end of the nozzle shutter striking ribs 337*a* in the rotational axis direction.

When the toner housing container 32 is mounted on the toner replenishing device 60 as shown in FIG. 9, a nozzle shutter flange 612*a* of the nozzle shutter 612 of the toner replenishing device 60 is biased by a nozzle shutter spring 613 and crushes the stuck-out portion of the container seal 333. The nozzle shutter flange 612*a* goes further inward, strikes on the container leading end side end of the nozzle shutter striking ribs 337*a*, and covers the leading end side end surface of the container seal 33 to thereby provide a shield from the outside of the container. This ensures hermetical seal around the conveying nozzle 611 in the nozzle receiving port 331 while in the mounted state, and can prevent toner leakage.

The rotational axis direction position of the nozzle shutter 612 relative to the toner housing container 32 is determined by the nozzle shutter striking ribs 337*a* being struck by such a surface of the nozzle shutter flange 612*a* biased by the nozzle shutter spring 613 as is opposite to a nozzle shutter spring receiving surface 612*f* thereof. As a result, a rotational axis direction positional relationship among the container leading end side end surface of the container seal 333, the container leading end side end surface of a leading end opening 305 (a later-described internal space of the cylindrical receiving member fixing portion 337 provided in the container opening portion 33*a*), and the nozzle shutter 612 is determined.

Figure 19A:
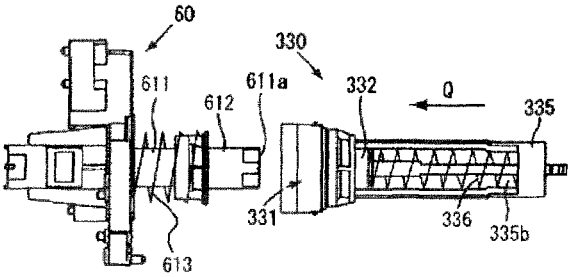
FIG. 19A is a top plan view of an example for explaining a state of an opening/closing member and a conveying pipe being mounted on each other.
Figure 19B:
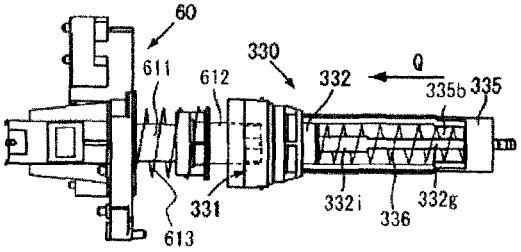
FIG. 19B is a top plan view of an example for explaining a state of an opening/closing member and a conveying pipe being mounted on each other.
Figure 19C:
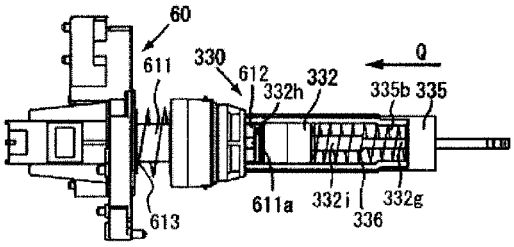
FIG. 19C is a top plan view of an example for explaining a state of an opening/closing member and a conveying pipe being mounted on each other.
Figure 19D:
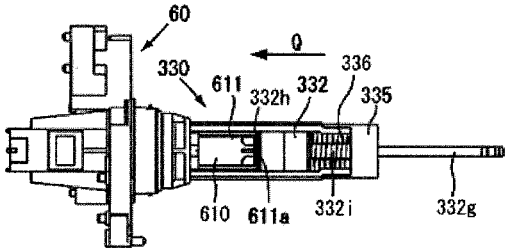
FIG. 19D is a top plan view of an example for explaining a state of an opening/closing member and a conveying pipe being mounted on each other.

Next, the operation of the container shutter 332 and the conveying nozzle 611 will be explained with reference to FIG. 1, FIG. 9, and FIG. 19A to FIG. 19D. Before the toner housing container 32 is mounted on the toner replenishing device 60, the container shutter 332 is biased by the container shutter spring 336 to a closing position of closing the nozzle receiving port 331 as shown in FIG. 1. FIG. 19A shows the appearance of the container shutter 332 and the conveying nozzle 611 in this state. When the toner housing container 32 is mounted on the toner replenishing device 60, the conveying nozzle 611 is inserted into the nozzle receiving port 331 as shown in FIG. 19B. When the toner housing container 32 is pushed further into the toner replenishing device 60, an end surface 332*h* of the leading end cylindrical portion 332*c*, which is the end surface of the container shutter 332 (hereinafter referred to as "container shutter end surface 332*h*"), and an end surface 611*a* of the conveying nozzle 611 located at a side from which the nozzle is inserted (hereinafter referred to as conveying nozzle end surface 611*a*") contact each other. When the toner housing container 32 is pushed further from this state, the container shutter 332 is thrust down as shown in FIG. 19C, and the conveying nozzle 611 is inserted into the shutter rear end support portion 335 through the nozzle receiving port 331 as shown in FIG. 19D. As a result, the conveying nozzle 611 is inserted into the container body 33 and comes to the set position as shown in FIG. 9. At this time, the nozzle opening 610 is at a position coinciding with the shutter support opening portion 335*h* as shown in FIG. 19D.

After this, when the container body 33 rotates, the toner uplifted above the conveying nozzle 611 by the uplifting portion 304 falls into and is introduced into the conveying nozzle 611 from the nozzle opening 610. The toner introduced into the conveying nozzle 611 is conveyed through the conveying nozzle 611 toward the toner fall-down conveying path 64 along with rotation of the conveying screw 614, and falls through the toner fall-down conveying path 64 to be supplied into the developing device 50.

Figure 34:
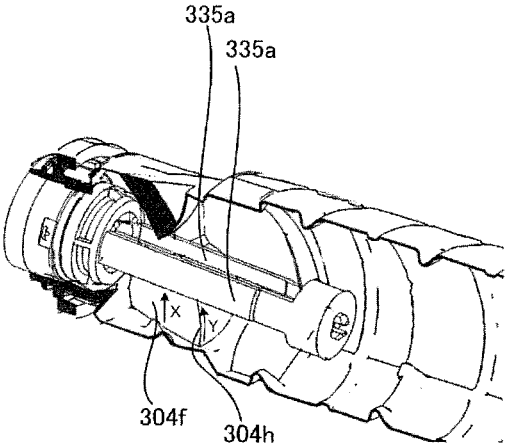
FIG. 34 is a perspective cross-sectional diagram showing a configuration of a toner housing container of the present invention.

In the region of the cross-section along the line E-E of FIG. 9 (which is the leading end side of the conveying nozzle 611 and a position of an end surface of a bearing of the conveying screw 614), the bosses 304*h* and the shutter side surface support portions 335*a* (protruding portions) are at positions facing each other. The uplifting wall surfaces 304*f* rise from the internal wall surface of the container so as to extend in the direction X of FIG. 30 (and the direction represented by the arrow X in FIG. 34), i.e., toward the shutter side surface support portions 335*a*. The bosses 304*h* rise in the direction represented by the arrow Y in FIG. 34, i.e., toward the shutter side surface support portions 335*a*.

Further, at the region where the shutter side surface support portion 335*a* and the boss face each other, the boss 304*h* curves outward in the radial direction of the container so as to conform to the contour of the shutter side surface support portion 335*a* (a curving portion 304*i*). In other words, the boss dents from the internal side toward the external side in the radial direction.

This denting portion of the boss is referred to as curving portion 304*i*.

The curving portion 304*i* is gentler than other portions of the boss 304*h* and conforms to the shutter side surface support portion 335*a* also in the longer direction.

In FIG. 32, the portion in the enclosure indicated by a sign Z curves toward the deeper side of the drawing, and the curving portion 304*i* is formed at this portion.

Likewise, the uplifting wall surface 304*f* also faces the shutter side surface support portion 335*a*. When seen from the container rotation direction downstream side, there are the uplifting wall surface 304*f*, a rotation direction downstream side end surface 335*c* (a flat side surface) of the shutter side surface support portion 335*a* (protruding portion), and a rotation direction upstream side lateral edge portion 611*s* of the nozzle opening 610. When the conveying nozzle 611 is inserted, the shutter side surface support portions 335*a* as the protruding portions extend along the conveying nozzle 611

Also by means of the uplifting portion 304 formed by the uplifting wall surfaces 304*f* of the container body 33 shown in FIG. 30 likewise by means of the uplifting effect explained earlier, the toner moves as indicated by an arrow T1 into the nozzle opening 610, which is an opening of the conveying nozzle 611 as a conveying pipe.

At this time, the external circumferential surface and rotation direction downstream side end surface 335*c* (flat side surface) of the shutter side surface support portion 335*a* (protruding portion) function as a toner pass-down portion for passing the toner from the uplifting portion 304 into the nozzle opening 610.

FIG. 30 also shows the flow of the toner in the container body 33 including the shutter side surface support portions 335*a* (protruding portions) functioning as the toner pass-down portion.

Along with the rotation of the container body 33 in the direction of the arrow A in the drawing, the toner uplifted by the uplifting wall surface 304*f* along the circumferential direction of the container body flows toward the direction of the nozzle opening 610 due to the gravity force (the arrow T1 in the drawing). In the configuration shown in FIG. 30, the shutter side surface support portions 335*a* (protruding portions) are arranged so as to fill the gaps between the conveying nozzle 611 and the bosses 304*h* (the bosses rising toward the center of rotation of the uplifting wall surfaces 3040. So as to realize this arrangement, the rotation direction downstream side end surface 335*c* (flat side surface) of the shutter side surface support portion 335*a* (protruding portion) and the boss 304*h* of the uplifting portion 304 are arranged in this order as seen from the downstream side in the direction of rotation of the container body 33.

The presence of the curving portion 304*i* of the boss 304*h* enables the boss 304*h* and the uplifting wall surface 304*f* to conform even more to the shutter side surface support portion 335*a* to thereby make the shutter side surface support portion 335*a* effectively function in passing the toner from the uplifting wall surface into the nozzle opening.

With this arrangement, the uplifted toner efficiently enters the nozzle opening 610.

Further, when the toner satisfies the conditions of containing a crystalline polyester resin (A) and a non-crystalline resin (B); having a molecular weight distribution having a main peak in the range of from 1,000 to 10,000 when measured by gel permeation chromatography (GPC) of a THF soluble content thereof, and having a peak height ratio (C/R) of from 0.03 to 0.55 between a peak height C of a characteristic spectrum attributed to the crystalline polyester resin (A) and a peak height R of a characteristic spectrum attributed to the non-crystalline resin (B) when the toner is measured with a Fourier transform infrared spectroscopic analyzer according to total reflection method after stored in a thermostatic bath of 45° C. for 12 hours, it is possible to prevent occurrence of toner aggregates.

It is better to make the shutter side surface support portion 335*a* (protruding portion) and the boss 304*h* closely contact each other. However, to save the manufacturing costs, the boss 304*h*, the uplifting wall surface 304*f*, and the curving portion 304*i* are often manufactured with blow molding, which cannot be as dimensionally precise as injection molding. With blow molding, it is difficult to form a complete close contact with the shutter side surface support portion, and it is preferable to manufacture them with a slight gap in terms of mass productivity. In the present embodiment, the distance between the curving portion and the shutter side surface support portion facing the curving portion is from about 0.3 mm to 1 mm.

To sum up, the present embodiment includes the following useful features:

- suppressing scatter, etc. of the toner with the configuration of inserting the nozzle on the apparatus body into the container; and
- improving the toner replenishing efficiency with the utilization of the shutter side surface support portion as a bridge to pass the toner from the uplifting wall surface into the nozzle.

However, as described above, the boss 304*h* and the uplifting wall surface 304*f* are often manufactured with blow molding, which cannot be as dimensionally precise as injection molding. Therefore, it is difficult to make them completely closely contact the shutter side surface support portion 335*a*. Then, when they are configured as described above, it may be impossible for the toner to be conveyed well toward the conveying nozzle. Furthermore, even when the shape of the uplifting wall surface is configured so as to improve the toner conveying function, it has been sometimes impossible for the toner to be conveyed well toward the conveying nozzle.

This problem is remarkable in case of blow molding. Even by means of other than blow molding, it is difficult to realize high dimensional precision of the boss and the shutter side surface support portion. Therefore, the container body of the present invention is not limited to a product obtained by blow molding.

The present inventors consider it due to the following factors to be impossible for the toner to be conveyed well toward the conveying nozzle as described above.

Figure 35:
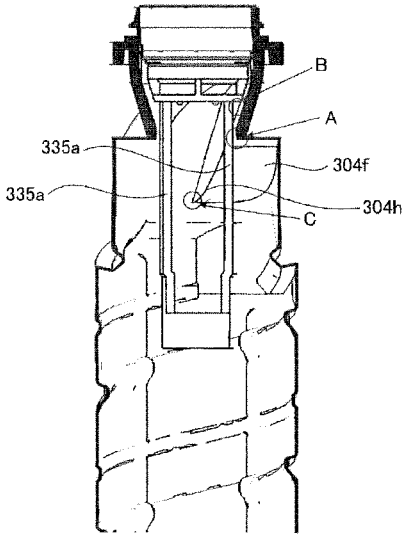
FIG. 35 is a cross-sectional diagram showing a configuration of a toner housing container of the present invention.

For the first factor, when the toner has a high flowability, it is considered that the toner may flow down from between the shutter side surface support portion 335*a* and the rising portion (boss 304*h*) (the portion indicated by A in FIG. 35). Hence, the amount of toner to be supplied into the conveying nozzle 611 is considered to become low. This factor is considered remarkable for a toner having a high flowability.

For the second factor, when seen in the longer direction, the uplifting wall surface 304*f* is provided so as to incline toward the opening portion (so as to incline outward from the direction of the axial line of the container body), so as to be gradually away from the boss 304*h*, which is the closest to the conveying nozzle 611 (the portion indicated by B in FIG. 35). This configuration is effective for uplifting the toner and conveying it to the vicinity of the nozzle opening. However, with this configuration, the gap between the conveying nozzle 611 and the boss 304*h* becomes broader toward the container leading end side. This causes the toner to fall off from between the shutter side surface support portion 335*a* and the uplifting wall surface 304*f*. The amount of toner to be supplied into the conveying nozzle 611 is considered to become low as a result. This factor is considered remarkable for a toner having a high flowability.

For the third factor, when seen in the longer direction likewise, the toner moves from the container rear end side of the uplifting wall surface 304*f* toward the leading end side thereof (the portion indicated by C in FIG. 35) up to the vicinity of the shutter side surface support portion 335*a*. During this process, there is considered to be some toner that may fall from the uplifting wall surface 304*f*. If the toner falls from the uplifting wall surface 304*f*, the fallen toner will not be conveyed to the conveying nozzle 611 naturally. Therefore, the amount of toner to be supplied into the conveying nozzle 611 is considered to become lower proportionately to the amount of the fallen toner. This is also considered one of the factors remarkable for a toner having a high flowability.

For the fourth factor, when the toner has a low flowability, it is considered inherently impossible for the toner to be discharged.

Therefore, it is difficult for such a toner to be replenished into the developing device, and the toner requires excessive stirring, to thereby cause the problem of the occurrence of aggregates, particularly when the toner has low temperature fixability.

It is possible to raise such factors as described above, and it is considered that these factors combine with each other and cause difference in the dischargeability of the toner to be discharged from inside the container to outside the container.

The toner dischargeability is a remarkable problem when the remaining amount of toner has become low.

When the remaining amount of toner is high, the toner is discharged by the momentum of the conveying force of the spiral conveying portion in the toner housing container. When the remaining amount of toner is low, it may be impossible for the toner to be poured into the nozzle opening 610, depending on the configuration of the uplifting portion and the pass-down portion.

Here, when the toner satisfying the conditions described above is used, for the first and second factors, it is considered that the toner particles have an appropriate aggregating force, which produces an effect of making them less susceptible to fall into a gap and making them get across a gap of a certain expanse. This allows the toner agent to be supplied into the nozzle even when there is a gap. Further, even if toner particles in a gap, they may not drop off and pass through the gap depending on the degree of aggregation, and it can be considered that the fallen toner particles may form an aggregate in the very region where they have fallen to thereby perform the function of filling the gap.

For the third factor, it is considered that an appropriate aggregating force of the toner particles makes the toner less likely to fall off to thereby improve the uplifting efficiency.

For the fourth factor, it is considered that increased flowability will make the toner smooth for conveying.

When the toner housing container 32 is in the set position shown in FIG. 19D, the container shutter end surface 332*h* is pushed by the conveying nozzle end surface 611*a* within the region of the nozzle opening 610. At this time, the nozzle opening 610, and the conveying nozzle end surface 611*a* and the container shutter end surface 332*h* as well are located below the uplifting portion 304. Therefore, the toner uplifted above the conveying nozzle 611 falls into the nozzle opening 610, and into between the container shutter end surface 332*h* and the conveying nozzle end surface 611*a* as well. Furthermore, the fallen toner may float up and deposit between the container shutter 332 and the container shutter support member 340.

Here, if it is assumed that the container shutter end surface 332*h* and the conveying nozzle end surface 611*a* are flat surfaces, the container shutter end surface 332*h* and the conveying nozzle end surface 611*a* contact each other by surface slide, and they are heavily loaded as a result. It is difficult for them to have an ideally perfect interfacial slide due to errors in assembly and variations in parts, and they have a slight gap between them. Therefore, the toner may enter this gap, and be frictioned along with the surface slide.

Further, assume a case where the toner floating up in the toner housing container deposits between the container shutter 332 and the container shutter support member 340. In the state that the toner housing container 32 is mounted on the toner replenishing device 60, a braking force is applied to the container shutter because the leading end cylindrical portion 332*c* of the container shutter 332 is pushed onto the conveying nozzle end surface 611*a* by the container shutter spring 336. Consequently, it is considered that the container shutter 332 does not rotate in conjunction with the container shutter support member 340 that is fixed on the container body 33 and is rotating synchronously with the spiral projection 302. In this case, it is predicted that the toner between the container shutter 332 and the container shutter support member 340 may be frictioned by the container shutter 332.

In this case, the toner that is frictioned and applied a load as a result may form an aggregate that is larger than the particle diameter of a toner that is not applied a load. If the aggregate is conveyed into the developing device 50 through the toner replenishing device 60, abnormal images such as undesired black spots may be produced. This phenomenon of forming an aggregate is more often the case with, particularly, a low melting point toner that can form an image at a low fixing temperature, among toners.

Hence, in the present invention, it is preferable to provide an aggregation suppressing unit configured to suppress aggregation of a toner that may occur along with rotation of the container body 33, as will be explained below.

As the aggregation suppressing unit, the container shutter 332 is let to rotate in conjunction with the container shutter support member 340 even when the leading end cylindrical portion 332*c* of the container shutter 332 is pushed onto the conveying nozzle 611 by being pushed in the longer direction thereof by the container shutter spring 336 and is applied a braking force as the result of being pushed. This preventing effect reduces the sliding load to be applied to the toner between the container shutter 332 and the container shutter support member 340. As a conjunctive rotation, a rotation of the container shutter 332 about the axis of the guide rod 332*e* is assumed. A state that the container shutter 332 rotates in conjunction and the container shutter support member 340 means a state that both of them rotate simultaneously, in other words, a state that the container shutter 332 does not rotate relative to the container shutter support member 340. As the region between the container shutter 332 and the container shutter support member 340, the region between the external circumferential surface of the sliding portion 332*d* and the internal circumferential surface of the shutter support opening portion 335*b*, and the region between the guide rod sliding portion 332*g* and a rear end opening 335*d* are assumed.

The sliding load to the toner is much larger in a rotation operation about the axis than in an opening/closing operation of the container shutter 332 in the axial direction, because an opening/closing operation occurs only when the toner housing container 32 is mounted or demounted, whereas a rotation operation occurs every time a replenishing operation is performed.

Figure 20A:
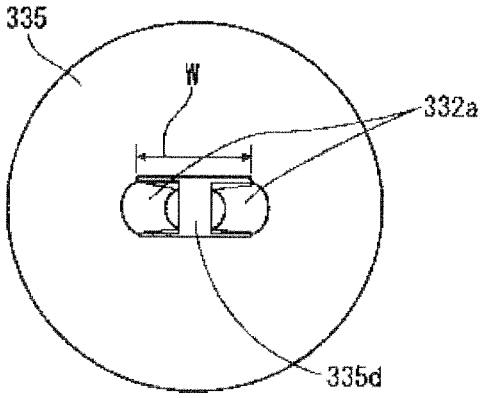
FIG. 20A is an enlarged diagram showing a relationship among a rear end opening, shutter slip-off preventing claws, and a planar guide seen from a container rear end side in one embodiment.
Figure 20B:
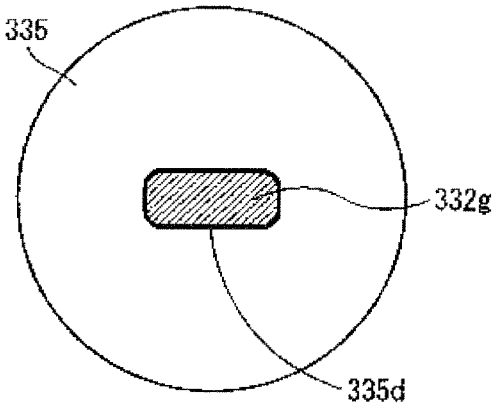
FIG. 20B is an enlarged diagram showing a relationship among a rear end opening, shutter slip-off preventing claws, and a planar guide seen from a container rear end side in one embodiment.

FIG. 20A is a plan view showing a relationship between a rear end opening 335*d* as a through-hole in the center of the opening/closing member rear end support portion and the shutter slip-off preventing claws 332*a* seen from the left-hand side of FIG. 17 (from the container rear end side). FIG. 20B is a cross-sectional diagram of the guide rod sliding portion 332*g* showing an engaging relationship between the rear end opening 335*d* and the guide rod sliding portion 332*g* in the state of FIG. 19C.

The guide rod 332*e* is constituted by a cylindrical portion 332*i*, the guide rod sliding portion 332*g*, the cantilevers 332*f*, and the shutter slip-off preventing claws 332*a*. As shown in FIG. 17, the guide rod 332*e* of the container shutter 332 is divided into two at the container rear end side thereof to thereby form the pair of cantilevers 332*f*. The shutter slip-off preventing claws 332*a* are provided on the external circumferential surfaces of the cantilevers respectively. As shown in FIG. 17 and FIG. 20A, the shutter slip-off preventing claws 332*a* protrude more outward than the external edges of the longer-direction length W of the rear end opening 335*d*. The rear end opening 335*d* has a function of letting the cantilevers 332*f* and the guide rod sliding portion 332*g* slide relative to the rear end opening 335*d* to guide the container shutter 332 to move. As shown in FIG. 20B, the guide rod sliding portion 332*g* has flat surfaces facing the top and bottom sides of the rear end opening 335*d*, and has curving surfaces conforming to the left and right sides of the rear end opening 335*d*. The cylindrical portion 332*i* forms a cylindrical shape, of which width in the left-right direction in FIG. 20A and FIG. 20B is the same as that of the guide rod sliding portion 332*g*. The cantilevers 332*f* and the guide rod sliding portions 332*g* are engaged with the rear end opening 335*d* in such a relationship as not to be inhibited from moving when the container shutter 332 moves as shown in FIG. 19A to FIG. 19D. In this way, the rear end opening 335*d* has the cantilevers 332*f* and the guide rod sliding portion 332*g* inserted therethrough and guides the container shutter 332 to move, and regulates rotation of the container shutter 332 about the rotation axis as well.

When assembling the container shutter 332 on the container shutter support member 340, the guide rod 332*e* is inserted through the container shutter spring 336, and the pair of cantilevers 332*f* of the guide rod 332*e* are warped toward the axial center of the guide rod 332*e* to let the shutter slip-off preventing claws 332*a* pass through the rear end opening 335*d*. As a result, the guide rod 332*e* is assembled on the nozzle receiving member 330 as shown in FIG. 15 to FIG. 17. At this time, the container shutter 332 is pressured by the container shutter spring 336 in the direction to close the nozzle receiving port 331, and the container shutter is prevented from slipping off by the shutter slip-off preventing claws 332*a*. The guide rod 332*e* is preferably made of a resin such as polystyrene so that the cantilevers 332*f* may have elasticity to warp.

When the toner housing container 32 is set in the set position, the guide rod sliding portion 332*g* passes through the rear end opening 335*d*, and comes to a position at which the flat portions of the guide rod sliding portion 332*g* as a driving force receiving portion and the sides of the rear end opening 335*d* as a driving force transmitting portion face and contact each other as shown in FIG. 19D and FIG. 20B. At this position, the internal circumferential surfaces of the shutter side surface support portions 335*a* (protruding portions) face the external circumferential surfaces of the leading end cylindrical portion 332*c* and the sliding portion 332*d*.

Accordingly, even though the container shutter end surface 332*h* is pushed onto the conveying nozzle end surface 611*a* by being pushed by the container shutter spring 336, the container shutter 332 is fixed to the rotating container shutter support member 340 in the direction of rotation about the longer axis thereof (i.e., the center axis of the guide rod 332*e*, and at the same time, the axis of rotation of the container body 33), by means of the surface contact between the flat portions of the guide rod sliding portion 332*g* and the sides of the rear end opening 335*d*. As a result, a rotational force is transmitted to the guide rod 332*e* of the container shutter 332 from the container shutter support member 340 that is rotating. Because this rotational force is greater than the braking force described above, the container shutter 332 rotates along with the rotation of the container shutter support member 340. In other words, the container shutter 332 is in conjunction with the rotation of the container shutter support member 340 (at this time, both of them are restricted from relative rotation). That is, the guide rod sliding portion 332*g* and the rear end opening 335*d* function as a driving transmitting unit that transmits a rotational force from the container shutter support member 340 to the container shutter 332. At the same time, they can be described as the aggregation suppressing unit. This aggregation suppressing unit suppresses sliding friction of the toner between the container shutter 332 and the container shutter support member 340 in the direction of rotation about the axis of the guide rod 332*e*. This makes it possible to suppress toner aggregation between the container shutter 332 and the container shutter support member 340 along with the rotation of the container body 33.

The aggregation suppressing unit is not limited to the guide rod sliding portion 332*g*, but may be the cantilevers 332*f*. In this case, the length and position of the cantilevers 332*f* may be determined such that they are positioned at the rear end opening 335*d* when the toner housing container 32 is in the set position.

Another aggregation suppressing unit will be explained. First, the problem to be solved by this aggregation suppressing unit will be described. When the container shutter 332 rotates simultaneously with the toner housing container 32 (container body 33), the container shutter end surface 332*h* rotates relative to the conveying nozzle end surface 661*a*. The leading end cylindrical portion 332*c* of the container shutter 332 is pushed onto the conveying nozzle 611 in the longer direction thereof by being pushed by the container shutter spring 336. When this relative rotation occurs in this state, the container shutter end surface 332*h* applies an extremely heavy sliding load to the conveying nozzle end surface 661*a*, which may be the cause of occurrence of a toner aggregate.

Hence, there is proposed a second aggregation suppressing unit, which suppresses toner aggregation that may be caused along with rotation of the container shutter 332 as an opening/closing member, and which aims to suppress occurrence of a toner aggregate in a region different from the region in the embodiment described above. The aggregation suppressing unit described below reduces a sliding load on the toner in a region where the conveying nozzle end surface 611*a* and the facing leading end cylindrical portion 332*c* abut on each other.

As shown in FIG. 9 and FIG. 14, the container shutter end surface 332*h* includes an abutment part 342 that projects from the end surface 332*h* toward the facing end surface 611*a* of the conveying nozzle 611 (or outward from the container leading end) and abuts on the end surface 611*a* of the conveying nozzle 611 when the toner housing container is mounted on an image forming apparatus. The abutment part 342 is a projecting portion functioning as the aggregation suppressing unit (second aggregation suppressing unit) of the present embodiment. The external circumferential surface of the abutment part 342 has a shape that includes a circular circumferential surface concentric with the axis of rotation of the toner housing container 32 and reduces its diameter toward the conveying nozzle end surface 611*a* (e.g., a hemispherical shape), and the abutment part 342 is provided to have a point contact with the conveying nozzle end surface 611*a* at the top of the hemispherical shape as shown in FIG. 9. This allows rotation to occur in a state that the sliding load when the abutment part 342 abuts on the conveying nozzle end surface 611*a* is low. Hence, the contact area can be much less than when the container shutter end surface 332*h* and the conveying nozzle end surface 611*a* have flat surfaces. This makes it possible to reduce a sliding load to be applied to the toner between the container shutter end surface 332*h* and the conveying nozzle end surface 611*a* along with the rotation of the container body 33, and thereby to suppress aggregation of the toner.

The material of the abutment part 342 may be the same as the container shutter 332, e.g., polystyrene resin, when formed integrally with the container shutter 332. Since the container shutter 332 is a component assembled on the toner housing container 32, it is replaced together with the toner housing container 32. Therefore, on the premise that be replaced, the material of the abutment part 342 that is to rotate by keeping in contact with the conveying nozzle end surface 611*a* is in terms of durability, preferably a material softer than the material of the conveying nozzle 611 (end surface 611*a*) that is set in the printer section 100 and is not to be replaced in principle.

As shown in FIG. 9 and FIG. 14, the abutment part 342 is arranged roughly in the center of the container shutter end surface 332*h*, so as to be present on the axis of rotation of the toner housing container 32, in other words, on the axis of rotation of the container shutter 332. With such an arrangement, the locus of rotation of the top of the abutment part 342 when the container shutter end surface 332*h* rotates relative to the conveying nozzle end surface 661*a* is ideally a point. Because components different from each other, namely, the toner housing container and an image forming apparatus, are mounted on each other, they cannot avoid being positionally misaligned from each other within an allowable error, and there may also be variation due to mass production. Even in consideration of these factors, it is possible to make the locus of rotation infinitesimal. By doing so, it is possible to save the contact area between the container shutter end surface 332*h* and the conveying nozzle end surface 611*a*, and to suppress aggregation of the toner due to a sliding load.

Figure 21:
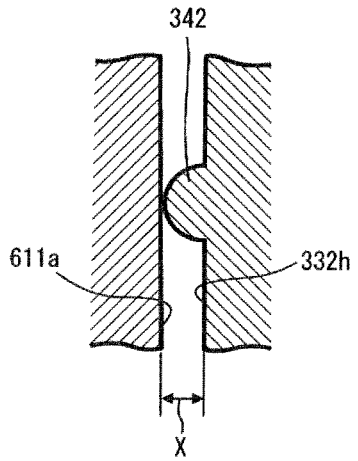
FIG. 21 is an enlarged cross-sectional diagram showing a state of an opening/closing member and a conveying pipe abutting on each other in another embodiment.

Next, an interfacial gap between the container shutter end surface 332*h* and the conveying nozzle end surface 611*a* formed by the abutment part 342 will be explained. As shown in FIG. 21, this gap is set by the amount X of projection of the abutment part 342 from the container shutter end surface 332*h* to the top thereof.

Figure 22:
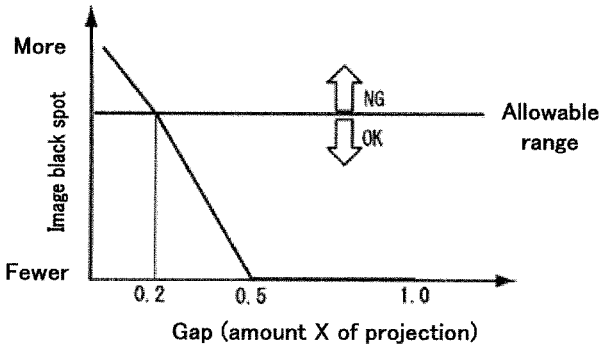
FIG. 22 is a diagram showing an expected relationship between an amount of projection of an aggregation suppressing unit and occurrence of black spots in an image in another embodiment.

The present inventors have studied the relationship between the amount X of projection and occurrence of black spots in the images, i.e., the relationship between a sliding area of the abutment region and occurrence of black spots in the images, and found the tendency shown in FIG. 22. In the present embodiment, the amount X of projection (the interfacial gap) is set to 1 mm. Hence, the toner that enters the interfacial gap receives a less sliding load, and easily falls out of the range of the surfaces and scarcely remains there, which makes it difficult for an aggregate to occur. In this way, the load to the toner is suppressed, because the sliding load applied to the toner when the toner enters the gap between the container shutter end surface 332*h* and the conveying nozzle end surface 611*a* is suppressed. Therefore, it is possible to minimize a load to be applied to the toner, and to thereby suppress occurrence of an aggregate and abnormal images.

As shown in FIG. 22, it is safe if the amount X of projection (interfacial gap) is 0.5 mm or greater. It is estimated that such a level of an aggregate that could be recognized on an output image would be likely to occur when the amount of projection is roughly 0.2 mm or less. Hence, the amount X of projection (interfacial gap) is preferably from about 0.5 mm to 1 mm.

Figure 23:
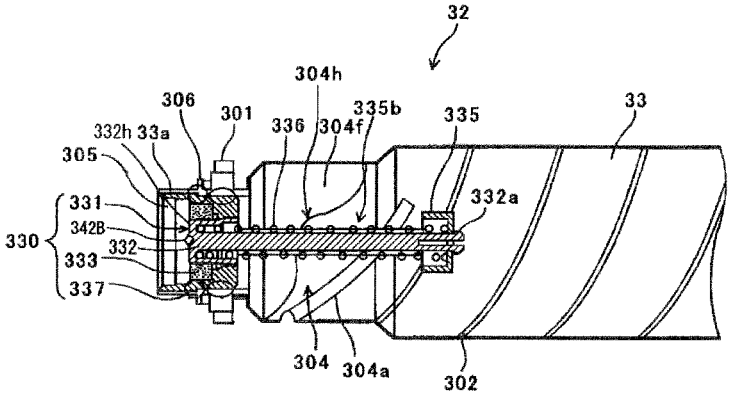
FIG. 23 is an enlarged diagram showing another configuration of an aggregation suppressing unit in another embodiment.

The aggregation suppressing unit is not limited to the one obtained by integrally molding the abutment part 342 and the container shutter 332 as shown in FIG. 21. For example, the aggregation suppressing unit may be separated from the container shutter 332 as shown in FIG. 23. Also in this case, the same effect as that described above can be obtained as long as the amount X of projection is secured. The aggregation suppressing unit shown in FIG. 23 includes an abutment part 342B, which is a sphere made of a resin and provided roughly in the center of the container shutter end surface 332*h* free to roll.

Also with this configuration, the sliding load to be applied to the toner that enters the interfacial gap between the container shutter end surface 332*h* and the conveying nozzle end surface 611*a* is suppressed. Therefore, it is less likely for an aggregate to occur. In this way, a load to the toner is suppressed, because the sliding load when the toner enters the interfacial gap between the container shutter end surface 332*h* and the conveying nozzle end surface 611*a* is suppressed. This makes it possible to minimize the load to the toner, and to thereby suppress occurrence of an aggregate and abnormal images.

Figure 24:
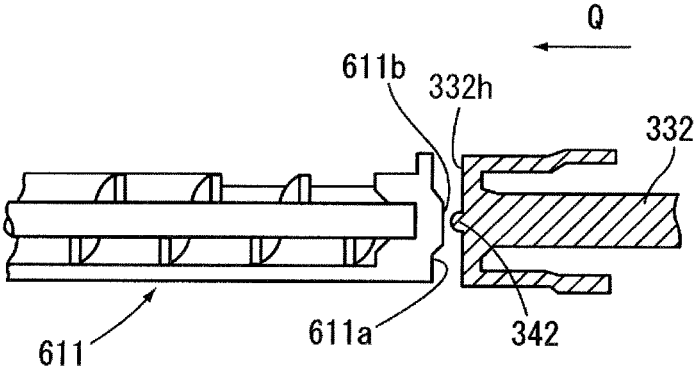
FIG. 24 is an enlarged diagram showing a modified example of an end surface of a conveying pipe.

The conveying nozzle end surface 611*a* is a flat planar end surface. However, as shown in FIG. 24, the end surface 611*a* may be formed such that only a portion 611*b* of the conveying nozzle end surface 611*a* that faces the abutment part 342 projects toward the abutment part 342.

Another aggregation suppressing unit will be explained.

The aggregation suppressing unit described above is provided between the container shutter end surface 332*h* and the conveying nozzle end surface 611*a*, and is therefore particularly effective for suppressing generation of a toner aggregate. However, it is predicted that when the toner housing container 32 is demounted from the toner replenishing device 60, the toner deposited between the surfaces may fall into the image forming apparatus or onto the floor to thereby contaminate them.

Hence, the present aggregation suppressing unit includes a seal member 350 that is provided on a non-abutment region R of the container shutter end surface 332*h* that is not to abut on the conveying nozzle end surface 611*a*. This makes it possible to prevent the toner from remaining in the interfacial gap between the container shutter end surface 332*h* and the conveying nozzle end surface 611*a*.

Figure 25:
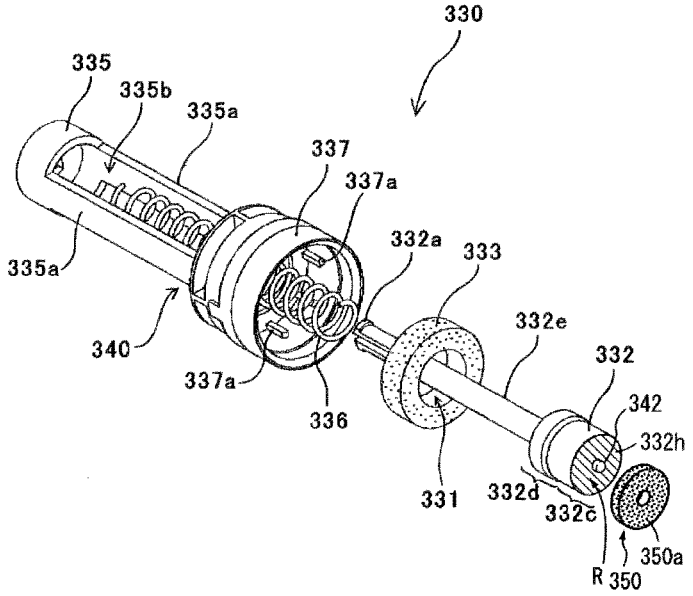
FIG. 25 is an enlarged perspective diagram showing a configuration of main portions in another embodiment.
Figure 26:
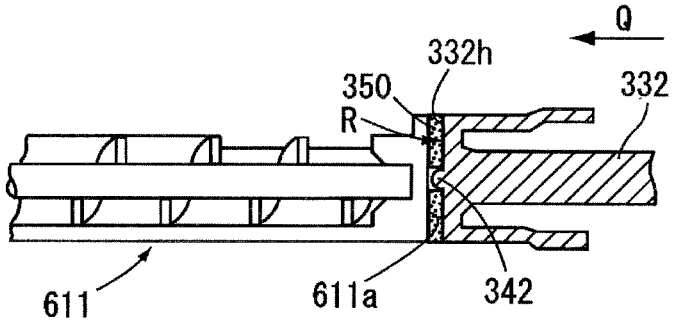
FIG. 26 is an enlarged cross-sectional diagram showing a state of an opening/closing member and a conveying pipe abutting on each other in another embodiment.
Figure 27:
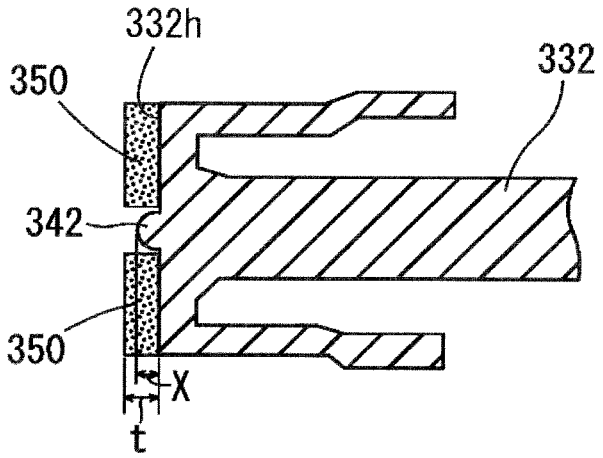
FIG. 27 is an enlarged cross-sectional diagram explaining a configuration of a seal member provided at an end surface of an opening/closing member and an aggregation suppressing unit in another embodiment.

The seal member 350 is made of an elastic material such as polyurethane foam. As shown in FIG. 25 and FIG. 26, the seal member 350 is formed in an annular shape so as to be located on the external side of the abutment part 342. The seal member 350 is configured to compress by from 0.1 mm to 0.5 mm in the direction of the thickness of the seal member 350, when the container shutter 332 comes to the opening position of opening the nozzle receiving port 331 along with the conveying nozzle 611 being inserted into the toner housing container 32. Specifically, when the amount X of projection of the abutment part 342 is 1 mm as shown in FIG. 27, the thickness t of the seal member 350 is set to from 1.1 mm to 1.5 mm. The seal member 350 is designed to collapse and thereby allow the conveying nozzle end surface 611*a* and the abutment part 342 to abut on each other when a facing surface 350*a* of the seal member 350 and the conveying nozzle end surface 611*a* contact each other.

Providing the seal member 350 in this way makes it difficult for the toner to the interfacial gap, because the facing surface 350*a* of the seal member 350 contacts the conveying nozzle end surface 611*a* before the conveying nozzle end surface 611*a* and the abutment part 342 abut on other, as shown in FIG. 26. This makes it possible to suppress the interior of the image forming apparatus or the floor from being contaminated by toner that would otherwise fall there when the toner housing container 32 is demounted from the toner replenishing device 60.

Figure 29:
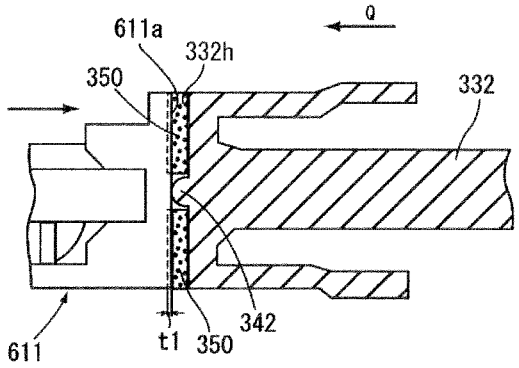
FIG. 29 is an enlarged cross-sectional diagram explaining an amount of collapse of a seal member in another embodiment.

As shown in FIG. 29, the amount of collapse t1 of the seal member 350 is set to about from 0.1 mm to 0.5 mm. When the amount of collapse was set to, for example, 1 mm or greater, it was observed that a large sliding load occurred to thereby make it likely for a toner aggregate to occur between the facing surface 350*a* of the seal member 350 and the conveying nozzle end surface 611*a*. Therefore, the amount of collapse t1 is preferably 0.5 mm or less. In the present embodiment, the amount of collapse t1 is set to 0.2 mm. By minimizing the amount of compression of the seal member 350 in this way, it is possible to suppress the rotation load of the toner housing container 32 (container body 33). A toner that has deposited on the surface of the seal member 350 does receive a slight compression force. However, this toner is not sandwiched between the stiff materials, i.e., the container shutter end surface 332*h* and the end surface 611*a* of the conveying nozzle 611, but is pushed onto the end surface 611*a* of the conveying nozzle 611 by the flexible seal member 350. Therefore, it is estimated that the flexibility of the seal would absorb the pushing force to thereby reduce the sliding load to the toner.

By providing the seal member 350, it is possible to suppress the toner from entering the interfacial gap, which makes it possible to suppress occurrence of an aggregate due to the rotation of the container body 33 more securely.

Figure 28:
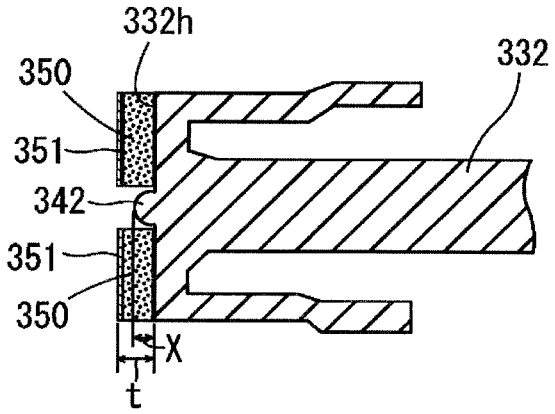
FIG. 28 is an enlarged cross-sectional diagram showing a configuration of a seal member in another embodiment.

As shown in FIG. 26, the facing surface 350*a* of the seal member 350 rotates simultaneously with the container shutter 332 while compressively contacting the conveying nozzle end surface 611*a*. Hence, a sheet material 351 made of a high molecular polyethylene sheet or a polyethylene terephthalate (PET) material may be bonded to the facing surface 350*a* of the seal member 350 as shown in FIG. 28, to thereby form the surface facing the conveying nozzle end surface 611*a* as a lowly frictional surface. By being formed as a lowly frictional surface, the facing surface 350*a* to face the conveying nozzle end surface 611*a* can suppress a load to be applied to the toner due to sliding relative to the conveying nozzle end surface 611*a*.

Figure 31:
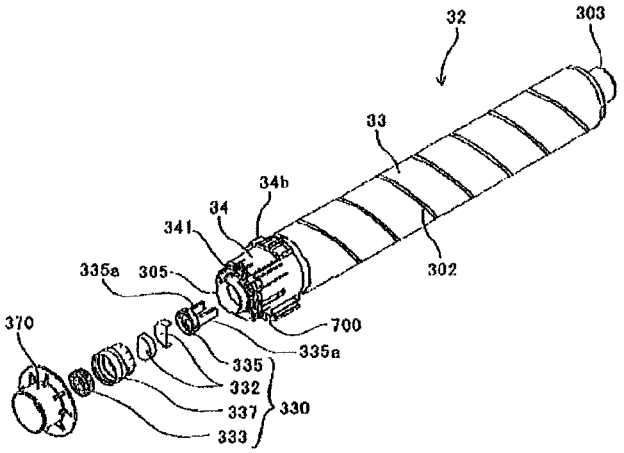
FIG. 31 is a perspective explanatory diagram showing a configuration of a toner housing container of the present invention.

The present invention is also feasible when the protruding portions are, as shown in FIG. 31, not the shutter side surface support portions 335*a* configured to support the shutter that is biased by the container shutter spring. Specifically, the container shutter 332 to close the container opening portion is formed by overlaying together a plurality of (two, in the present embodiment) elastically deformable thin film members in a manner of leaving them partially not overlaid, and the container opening portion is opened by elastic deformation of the overlaid portions.

The conveying nozzle pushes away the overlaid portions of the thin film members and is inserted into the container opening portion.

In this case, there is no shutter of the above-described embodiment that is biased by the biasing member.

However, there are a pair of flat plate-shaped members that protrude from the container opening portion toward the container rear end side and function as toner pass-down portions for passing the toner from the uplifting portion into the nozzle opening, like the shutter side surface support portions 335*a* of the above-described embodiment.

The other members than those described above are the same as the embodiment described above.

Like this, the shape and configuration of the protruding portions may be anything as long as the effect of the present invention can be obtained.

Figure 36:
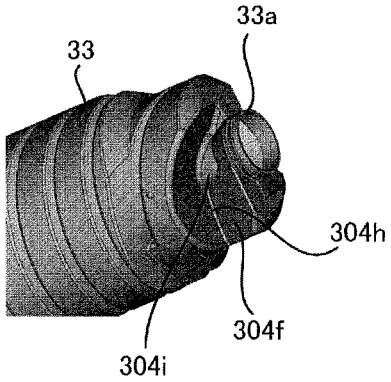
FIG. 36 is a perspective diagram showing another mode of a toner housing container of the present invention.
Figure 37:
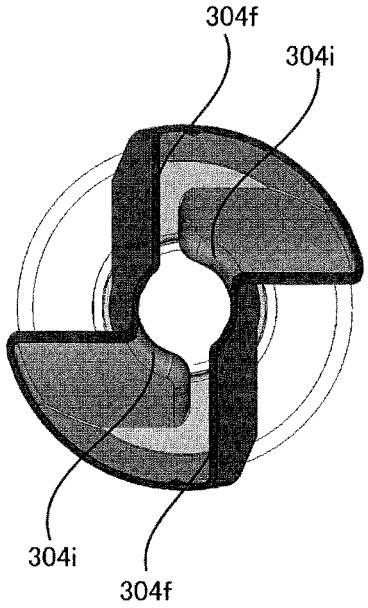
FIG. 37 is a cross-sectional diagram showing another mode of a toner housing container of the present invention.

FIG. 36 and FIG. 37 show a toner housing container, in which the container body includes a large circumference portion that adjoins the uplifting portion 304, and the curving portions 304*i* are larger than those shown in FIG. 30. Such a configuration is also possible. In FIG. 37, the container opening portion 33*a* exists at the deeper side of the drawing sheet.

Next, an example manufacturing step of filling the toner housing container 32 with a toner will be explained with reference to FIG. 38A and FIG. 38B.

First, a hole 33*d*2 (through-hole) to lead into the container body 33 is formed at the gripping portion 303 of an empty toner housing container 32 (a machining step).

After this, a cleaning nozzle is inserted from the hole 33*d*2 to clean the interior of the container body 33.

Figure 38A:
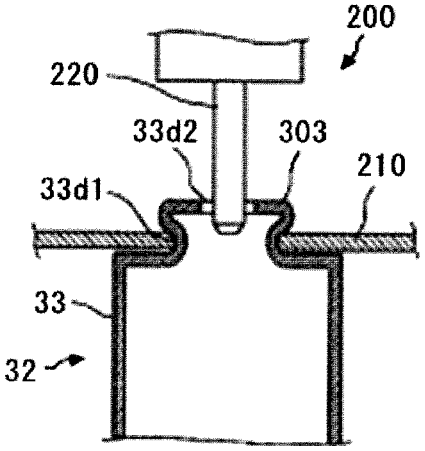
FIG. 38A is a diagram explaining an example manufacturing process for filling a toner housing container with a toner.

After this, the toner housing container 32 in which the hole 33*d*2 is formed is set on a filling machine 200 as shown in FIG. 38A.

Specifically, a constricted portion 33*d*1 of the gripping portion 303 as a hooking portion is engaged with a support portion 210 of the filling machine 200, and the toner housing container 32 is suspended such that the gripping portion 303 cornea to the top.

Then, a nozzle 220 of the filling machine 200 is inserted into the hole 33*d*2 of the toner housing container 32, and the filling machine 200 fills the toner housing container 32 with the toner (a filling step).

Figure 38B:
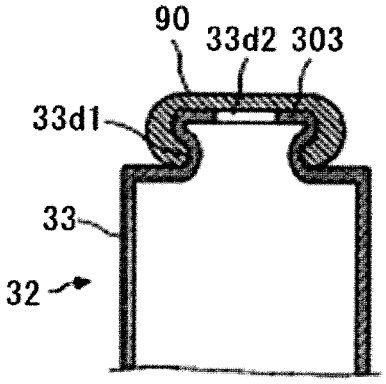
FIG. 38B is a diagram explaining an example manufacturing process for filling a toner housing container with a toner.
Figure 39:
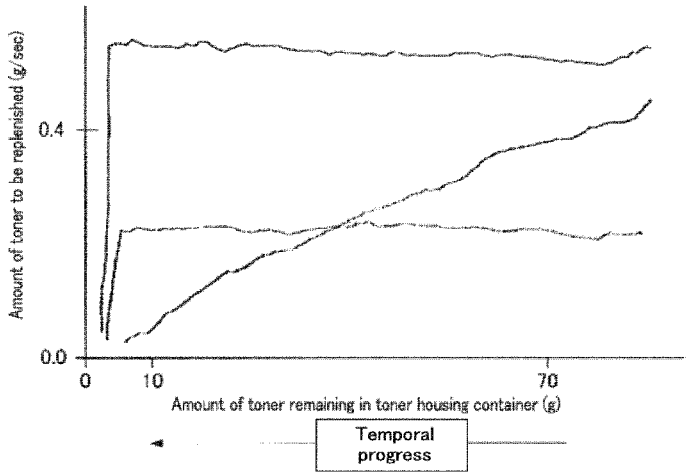
FIG. 39 is a graph showing a relationship between an amount of toner remaining in a toner housing container and an amount of toner to be replenished.

Then, with reference to FIG. 38B, when filling of the toner is completed, the hole 32*d*2 is sealed with a sealing cap or the like as a sealing member.

This ensures sealedness of the toner housing container 32 after filled with the toner.

In the present embodiment, a cap 90 to be placed over the gripping portion 303 is used as the sealing member. However, a plug to be inserted into the hole 33*d*2 may be used as a sealing member, or a seal member such as polyurethane foam to be placed over the hole 33*d*2 for cover may be used as a sealing member. That is, the toner housing container of the present embodiment is completed as a toner housing container having a hole opened in the container body and having this hole sealed with a sealing member.

As described above, in the present embodiment, when filling the toner housing container 32 with a toner, it is unnecessary to disassemble the nozzle receiving member 330 from the container body 33 to fill the toner housing container 32 with the toner.

This improves the work efficiency in the manufacturing process.

<Toner>

The toner housed in the toner housing container of the present invention will be explained.

The toner contains a crystalline polyester resin (A) and a non-crystalline resin (B), has a molecular weight distribution having a main peak in the range of from 1,000 to 10,000 when measured by gel permeation chromatography (GPC) of a THF soluble content thereof, and has a peak height ratio (C/R) of from 0.03 to 0.55 between a peak height C of a characteristic spectrum attributed to the crystalline polyester resin (A) and a peak height R of a characteristic spectrum attributed to the non-crystalline resin (B) when the toner is measured with a Fourier-transform infrared spectroscopic analyzer according to total reflection method after stored in a thermostatic bath of 45° C. for 12 hours.

When the toner satisfies these requirements, occurrence of toner aggregates can be prevented.

In recent years, electrophotographic image forming toners (hereinafter may be referred to simply as toners) for electrophotography have been required to have increased low temperature fixability. This increasing requirement is due not only to the demand for energy saving by reducing the energy required for fixing, but also to the demand for electrophotographic image forming apparatuses to operate at higher speed and produce images of higher quality, and this rising requirement is multiplied by the diversification of the purposes for which the electrophotographic image forming apparatuses are used.

To simply make a toner low-temperature-fixable, it is only necessary to impart a low softening temperature (T½) to the toner. However, when the softening temperature is lowered, the glass transition temperature of the toner is also lowered, which degrades heat resistant storage stability. Furthermore, along with the lowering of the lower limit of the fixable temperature (minimum fixing temperature) at which problems would not occur in the image quality, the upper limit of the fixable temperature (maximum fixing temperature) is also lowered, which degrades hot offset resistance. In addition, a resin having a low softening temperature has a low molecular weight, and hence is soft inevitably. Therefore, when the means for lowering the softening temperature is simply to add a low softening temperature resin at a higher ratio, the toner would deform and agglutinate when it receives a stress due to pressure, etc., and would likely form aggregates. Particularly, when the toner is conveyed with the toner housing container having the configuration described above, the toner may get stacked up at the uplifting portion while the toner is moved toward the powder receiving port, and may be pressurized in the housing container by being compressed by the following toner to be conveyed there afterwards, often resulting in occurrence of toner aggregates. When aggregates occur in the toner, abnormal streaky images due to clogging in the developing device or abnormal dotted images due to fall down of the aggregates may occur. Hence, to satisfy low temperature fixability, hot offset resistance, and suppression of aggregates at the same time is a major subject in using the toner housing container described above.

The present inventors have conducted earnest studies for the above subject, and as a result, found the following technological concept and come to the resolution of the problems described above.

When a crystalline polyester resin (A) is used as a binder resin to be used in an electrophotographic image forming toner, it can impart sufficient low temperature fixability to the toner based on the sharp melting property thereof, while suppressing the blending ratio of a low molecular weight resin. Therefore, the toner can be suppressed from forming aggregates when the toner is pressurized while being conveyed with the toner housing container having the configuration described above.

However, simply using the crystalline polyester resin (A) as a binder resin would result in significant degradation of the hot offset resistance, and hence in a very narrow fixing temperature range. Therefore, the toner would not be able to endure actual use.

Hence, the present inventors have conducted earnest studies, and estimated that use of a noncrystalline resin (B) in combination with the crystalline polyester resin (A) would improve the hot offset resistance, and broaden the range of fixable temperatures.

However, when only the crystalline polyester resin (A) and the non-crystalline resin (B) are prescribed, the low temperature fixability may be poor if the non-crystalline resin (B) is added in a larger amount, whereas if the crystalline polyester resin (A) is added in a larger amount, it would dissolve compatibly with the non-crystalline resin (B), particularly, with components of the non-crystalline resin (B) other than a chloroform insoluble content thereof when melt-kneaded in the manufacturing process to thereby make the glass transition temperature of the non-crystalline resin (B) significantly low, which would result in very poor heat resistant storage stability.

The present inventors have conducted further studies, and discovered that by imparting to the toner a molecular weight distribution having a main peak in the range of from 1,000 to 10,000 when measured by gel permeation chromatography (GPC) of a THF soluble content of the toner, and by adding the crystalline polyester resin (A) in a smaller amount to thereby suppress compatible dissolution thereof, it is possible to reinforce the low temperature fixability of the crystalline polyester resin (A) while not inhibiting the hot offset resistance.

In the present invention, it is possible to use a composite resin (C) in addition to the crystalline polyester resin (A) and the non-crystalline resin (B).

However, even when the crystalline polyester resin (A), the non-crystalline rein (B), and the composite resin (C) described above are used in combination, their advantages attributed to the thermal characteristics of the material resins may not be exerted, when they are melt-kneaded in a pulverization toner manufacturing process. A main cause is that the linkages of the molecules of the resins are disconnected in the melt-kneading process, to thereby change the molecular weight. Particularly, when the linkages of the molecules of the chloroform insoluble content of the non-crystalline resin are disconnected, the molecular weight distribution of the toner as a whole becomes broad, resulting in degradation of the low temperature fixability.

The present inventors have conducted earnest studies, and as a result, discovered that it is possible to provide a toner that is excellent in low temperature fixability, heat resistant storage stability, and hot offset resistance, contains a low molecular weight content in a large absolute quantity and at the same time has a sharp molecular weight distribution, and takes advantage of the characteristics of both of the crystalline polyester resin (A) and the non-crystalline resin (B) described above, by employing a method of, as described later, optimizing the shear to be applied the material resins by melt-kneading them at an appropriate temperature, and at the same time, fostering recrystallization of the crystalline polyester resin (A) in a cooling step, to thereby impart to the toner a molecular weight distribution having a main peak in the range of from 1,000 to 10,000 when measured by GPC of a THF soluble content thereof.

Particularly, the effects and side effects of the crystalline polyester resin (A) are largely dependent on the abundance of the crystalline polyester resin (A) in the surface of the toner. Therefore, by optimizing the abundance ratio of the crystalline polyester resin (A) in the surface of the toner by balancing the degree of dispersion of the crystalline polyester resin (A) based on the amount of prescription of the crystalline polyester resin (A), the method in the kneading process, etc., it is possible to ensure low temperature fixability and maintain a very favorable heat resistant storage stability at the same time, and in addition, to suppress filming over an OPC (Organic Photo Conductor) during image formation.

The abundance ratio of the crystalline polyester resin (A) in the surface of the toner can be indicated with a spectral peak height ratio obtained according to total reflection method (ATR method) using a Fourier-transform infrared spectroscopic analyzer (FT-IR). By taking into consideration the heat resistant storage stability, the present inventors have conducted studies, and as a result, discovered that the peak height of a spectrum obtained after storage at 45° C. for 12 hours is relevant to a state of the toner after high temperature storage (high temperature stock) assuming transportation by ship, and that it is possible to ensure low temperature fixability and maintain a very favorable heat resistant storage stability at the same time, by setting a ratio C/R of from 0.03 to 0.55 between the peak height C of a characteristic spectrum attributed to the crystalline polyester resin (A) after stored at 45° C. for 12 hours and the peak height R of a characteristic spectrum attributed to the noncrystalline resin (B) after stored under the same conditions.

When the peak height ratio (C/R) is greater than 0.55, the amount of crystalline polyester resin (A) in the surface of the toner is excessive, and the heat resistant storage stability is poor. When it is less than 0.03, the abundance of the crystalline polyester resin (A) in the surface of the toner is too low, and the low temperature fixing efficiency is poor.

As described above, it is possible to control the abundance ratio of the crystalline polyester resin (A) in the surface of the toner, i.e., the peak height ratio (C/R), based on the amount of prescription and the degree of dispersion of the crystalline polyester resin (A), the method employed in the kneading process, etc. For example, when the amount of prescription of the crystalline polyester resin (A) is increased, the ratio C/R is increased. When the dispersibility is improved by increasing the amount of the composite resin (C), the ratio C/R is reduced. When a cooling time increased in the kneading process, the ratio C/R is increased, as the recrystallization is encouraged. The method for controlling the ratio C/R is not limited to those described above, and any method may be used as long as such a method can set the ratio C/R to within the range of from 0.03 to 0.55.

The peak height ratio (C/R) between the peak height C of a characteristic spectrum of the crystalline polyester resin and the peak height R of a characteristic spectrum of the non-crystalline resin was obtained from an ATR spectrum of ATR method (total reflection method), using FT-IR (Fourier-transform infrared spectroscopic analyzer "AVATAR 370 (manufactured by Thermo Electron Co., Ltd.)"). In the ATR method, it is necessary to measure a smooth surface. Therefore, the toner was measured in its pellet form obtained by pressure compaction. For the pressure compaction, the toner (0.6 g) was loaded with 1,000 kg for 30 seconds, and compacted into a pellet having a diameter of 20 mm.

Figure 40:
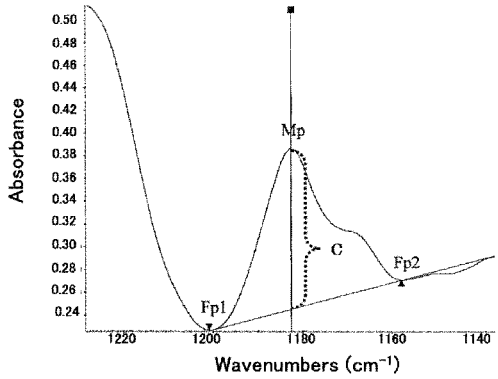
FIG. 40 is a graph showing a peak height C (1,183 $cm^{-1}$, baseline: from 1,158 $cm^{-1}$ to 1,201 $cm^{-1}$) of a characteristic spectrum of a crystalline polyester resin (A) in a crystalline state.

FIG. 40 shows an example infrared absorption spectrum of the crystalline polyester resin.

As shown in FIG. 40, the infrared absorption spectrum of a crystalline polyester resin has a falling peak point at which the absorbance is the minimum (hereinafter referred to as "first falling peak point Fp1") and a falling peak point at which the absorbance is the second minimum (hereinafter referred to as "second falling peak point Fp2"), and between them, a maximum sing peak point Mp at which the absorbance is the maximum, the wavenumber range of from 1,130 $cm^{-1}$ to 1,220 $cm^{-1}$. A line segment that links the first falling peak point Fp1 to the second falling peak point Fp2 is defined as a baseline. A perpendicular line is drawn down to the horizontal axis from the maximum rising peak point Mp. The absolute value of the difference between the absorbance at the intersection of the perpendicular line and the baseline and the absorbance at the maximum rising peak point Mp is defined as the height C of the maximum rising peak point Mp.

In the example shown in FIG. 40, Fp1 is at 1,201 $cm^{-1}$ and Fp2 is at 1,158 $cm^{-1}$, (i.e., the baseline is from 1,158 $cm^{-1}$ to 1,201 $cm^{-1}$), and Mp1 is at 1,183 $cm^{-1}$.

Figure 41:
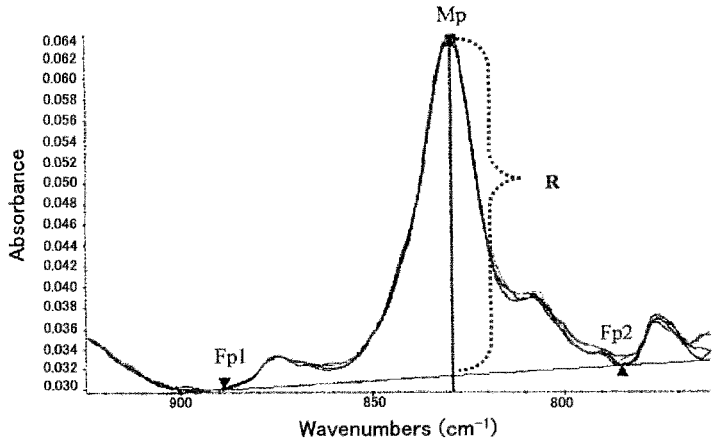
FIG. 41 is a graph showing a peak height R (829 $cm^{-1}$, baseline: from 784 $cm^{-1}$ to 889 $cm^{-1}$) of a characteristic spectrum of a non-crystalline resin (B) when it is a non-crystalline polyester.

FIG. 41 shows an example infrared absorption spectrum of a non-crystalline polyester resin.

As shown in FIG. 41, the infrared absorption spectrum of the non-crystalline polyester resin has a maximum rising peak point Mp, a first falling peak point Fp1 at which the absorbance is the minimum, and a second falling peak point Fp2 at which the absorbance is the second minimum in the wavenumber range of from 780 $cm^{-1}$ to 900 $cm^{-1}$. The maximum rising peak point Mp is located between the first falling peak point Fp1 and the second falling peak point Fp2. A line segment that links the first falling peak point Fp1 to the second falling peak point Fp2 is defined as a baseline. A perpendicular line is drawn down to the horizontal axis from the maximum rising peak point Mp. The absolute value of the difference between the absorbance at the intersection of the perpendicular line and the baseline and the absorbance at the maximum rising peak point Mp is defined as the height R of the maximum rising peak point Mp. Further, the ratio C/R is the ratio between the peaks (C/R value).

In the example shown in FIG. 41, Fp1 is at 889 $cm^{-1}$ and Fp2 is at 784 $cm^{-1}$, (i.e., the baseline is from 784 $cm^{-1}$ to 889 $cm^{-1}$), and Mp is at 829 $cm^{-1}$.

Figure 42:
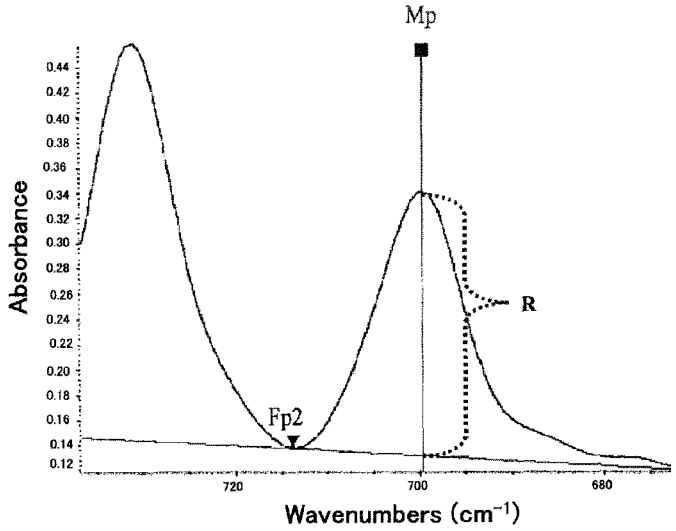
FIG. 42 is a graph showing a peak height R (699 $cm^{-1}$, baseline: from 714 $cm^{-1}$ to 670 $cm^{-1}$) of a characteristic spectrum of a non-crystalline resin (B) when it is a non-crystalline styrene-acrylic based resin.

FIG. 42 shows an example infrared absorption spectrum of a non-crystalline styrene-acrylic based resin.

As shown in FIG. 42, the infrared absorption spectrum of the non-crystalline styrene-acrylic based resin has a maximum rising peak point Mp, a first falling peak point Fp1 at which the absorbance is the minimum, and a second falling peak point Fp2 at which the absorbance is the second minimum in the wavenumber range of from 660 $cm^{-1}$ to 720 $cm^{-}$. The maximum rising peak point Mp is located between the first falling peak point Fp1 and the second falling peak point Fp2. A line segment that links the first falling peak point Fp1 to the second falling peak point Fp2 is defined as a baseline. A perpendicular line is drawn down to the horizontal, axis from the maximum rising peak point Mp. The absolute value of the difference between the absorbance at the intersection of the perpendicular line and the baseline and the absorbance at the maximum rising peak point Mp is defined as the height R of the maximum rising peak point Mp. Further, the ratio C/R is the so ratio between the peaks (C/R value).

In the example shown in FIG. 42, Fp1 is at 670 $cm^{-1}$ and Fp2 is at 714 $cm^{-1}$, (i.e., the baseline is from 670 $cm^{-1}$ to 714 $cm^{-1}$), and Mp is at 699 $cm^{-1}$.

When both of the non-crystalline polyester resin and the non-crystalline styrene-acrylic based resin are used as the non-crystalline resin an R value obtained from a maximum rising peak point Mp in the wavenumber range of from 780 $cm^{-1}$ to 900 $cm^{-1}$ is compared with an R value obtained from a maximum rising peak point Mp in the wavenumber range of from 660 $cm^{-1}$ to 720 $cm^{-1}$. Then, based on the R value having the higher intensity, the peak ratio (C/R value) is obtained.

GPC (Gel Permeation Chromatography) is performed as follows.

A column is stabilized in a heat chamber of 40° C. THF as a solvent is let to flow at a flow rate of 1 ml/minute through the column at this temperature, and a THE sample solution of a resin prepared at a sample concentration of from 0.05% by mass to 0.6% by mass (from 50 μl to 200 μl) is injected and measured.

For the measurement of the molecular weight of the sample, the molecular weight distribution of the sample is calculated from a relationship between logarithmic values of the calibration curves generated based on several kinds of monodisperse polystyrene standard samples and the counted values.

As the standard polystyrene samples for generation of the calibration curves, samples having a molecular weight of $6\times10^2$, $2.1\times10^2$, $4\times10^3$, $1.75\times10^4$, $5.1\times10^4$, $1.1\times10^6$, $3.9\times10^5$, $8.6\times10^9$, $2\times10^6$, and $4.48\times10^6$ manufactured by Pressure Chemical Co, or by Tosoh Corporation are used. It is adequate to use at least about 10 standard polystyrene samples. A RI (Refraction Index) detector is used as the detector.

It is preferable to use as the non-crystalline resin (B), a non-crystalline resin (B-1) and a non-crystalline resin (B-2), of which softening temperature (T½) is lower than that of the non-crystalline resin (B-1) by 25° C. or more. Use of the two kinds of non-crystalline resins, namely the non-crystalline resin (B-1) and the non-crystalline resin (B-2) is preferable because the ratio of the crystalline polyester resin (A) is reduced to thereby suppress compatible dissolution thereof, the low temperature fixability of the crystalline polyester resin (A) is reinforced by the non-crystalline resin (B-2), and at the same time, hot offset resistance attributable to the chloroform insoluble content of the noncrystalline resin (B-1) is not inhibited.

The content of the crystalline polyester resin (A) in the toner is preferably from 1% by mass to 15% by mass, and more preferably from 1% by mass to 10% by mass. The content of the non-crystalline resin (B-1) is preferably from 10% by mass to 40% by mass. The content of the non-crystalline resin (B-2) is preferably from 50% by mass to 90% by mass. The content of the composite resin (C) is preferably from 3% by mass to 20% by mass.

The softening temperature (T½) of the binder resin is measured with an elevated flow tester CFT-500 (manufactured by Shimadzu Corporation) as a temperature corresponding to ½ of the difference between a temperature at which a sample starts to flow out and a temperature at which the sample finishes flowing out, when the sample (1 $cm^2$) is made to flow out by being melted under the conditions of a die throat diameter of 1 mm, an applied pressure of 20 $kg/cm^2$, and a temperature elevating ratio of 6° C./min.

The crystalline polyester resin (A) of the present invention may be a publicly-known conventional one, but more preferably contains an ester bond represented by the following General Formula (1) in the main chain of the molecule.

$$[\text{—OCO—R—COO—}(CH_2)_n\text{—}] \qquad \text{General Formula (1)}$$

(In the Formula, R represents a straight-chain unsaturated aliphatic divalent carboxylic acid residue having 2 to 20 carbon atoms, and n represents an integer of from 2 to 20.)

The presence of the structure represented by General Formula (1) can be confirmed according to solid $^{13}C$ NMR.

Specific examples of the straight-chain unsaturated aliphatic group include straight-chain unsaturated aliphatic groups derived from straight-chain unsaturated divalent carboxylic acid such as maleic acid, fumaric acid, 1,3-n-propenedicarboxylic acid, and 1,4-n-butenedicarboxylic acid.

In General Formula (1), $(CH_2)_n$ represents a straight-chain aliphatic dihydric alcohol residue. In this case, specific examples of the straight-chain aliphatic dihydric alcohol residue include derivatives of straight-chain aliphatic dihydric alcohol such as ethylene glycol, 1,3-propylene glycol, 1,4-butanediol, and 1,6-hexanediol.

It is advantageous if the acid component of the crystalline polyester resin (A) is not an aromatic dicarboxylic acid but a straight-chain unsaturated aliphatic dicarboxylic acid, because this makes it easier for the crystalline polyester resin to form a crystalline structure and to exert its functions more effectively.

The crystalline polyester resin (A) can be produced by, for example, a polycondensation reaction of (i) a polyvalent carboxylic acid component composed of a straight-chain unsaturated aliphatic divalent carboxylic acid or a reactive derivative thereof (e.g., acid anhydride, lower alkyl ester having 1 to 4 carbon atoms, and acid halide), with (ii) a polyhydric alcohol component composed of a straight-chain aliphatic diol. In this case, a small amount of another polyvalent carboxylic acid may be added to the polyvalent carboxylic acid component according to necessity.

In this case, the polyvalent carboxylic acid includes: (i) unsaturated aliphatic divalent carboxylic acid having a branched chain; (ii) saturated aliphatic polyvalent carboxylic acid such as saturated aliphatic divalent carboxylic acid and saturated aliphatic trivalent carboxylic acid; (iii) aromatic polyvalent carboxylic acid such as aromatic divalent carboxylic acid and aromatic trivalent carboxylic acid; and the like.

The additive amount of these polyvalent carboxylic acids is typically 30 mol % or less, and preferably 10 mol % or less relative to the total amount of carboxylic acids, and they are added appropriately within a range in which the polyester to be obtained has crystallinity.

Specific examples of the polyvalent carboxylic acid that can be added according to necessity include: divalent carboxylic acid such as malonic acid, succinic acid, glutaric acid, adipic acid, suberic acid, sebacic acid, citraconic acid, phthalic acid, isophthalic acid, and terephthalic acid; and trivalent or higher carboxylic acid such as trimellitic anhydride, 1,2,4-benzenetricarboxylic acid, 1,2,5-benzentricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

A small amount of aliphatic branched dihydric alcohol, cyclic dihydric alcohol, and trihydric or higher polyhydric alcohol may be added to the polyhydric alcohol component according to necessity.

The additive amount thereof is 30 mol % or less, and preferably 10 mol % or less relative to the total amount of alcohols, and they are added appropriately within a range in which the polyester to be obtained has crystallinity.

Examples of the polyhydric alcohol to be added according to necessity include 1,4-bis(hydroxymethyl)cyclohexane, polyethylene glycol, bisphenol A-ethylene oxide adduct, bisphenol A-propylene oxide adduct, and glycerin.

The molecular weight distribution of the crystalline polyester resin (A) is preferably sharp in terms of low temperature fixability, and the molecular weights in the distribution are preferably relatively low.

As for the molecular weight of the crystalline polyester resin (A), the weight average molecular weight (Mw) thereof is preferably from 5,500 to 6,500, and the number average molecular weight (Mn) thereof is preferably from 1,300 to 1,500 in the molecular weight distribution of an o-dichlorobenzene soluble content thereof obtained by GPC. The ratio Mw/In is preferably from 2 to 5.

The above molecular weight distribution of the crystalline polyester resin (A) is based on a molecular weight distribution diagram expressing log(M: molecular weight) on the horizontal axis and % by mass on the vertical axis. The crystalline polyester resin (A) used in the present invention preferably has a molecular weight peak in the range of from 3.5% by as to 4.0% by mass in this molecular weight distribution diagram, and the half value width of the peak is preferably 1.5 or less.

The glass transition temperature (Tg) and the softening temperature (T½) of the crystalline polyester resin (A) are preferably low temperatures within a range in which the heat resistant storage stability of the toner would not be poor. Tg is typically from 80° C. to 130° C., and preferably from 80° C. to 125° C. T½ is typically from 80° C. to 130° C., and preferably from 80° C. to 125° C. When Tg and T½ are higher than these ranges, the minimum fixing temperature of the toner will be high to degrade the low temperature fixability. When Tg and T½ are lower than these ranges, the heat resistant storage stability of the toner will be poor.

It is possible to confirm whether or not the crystalline polyester resin (A) of the present invention has crystallinity, based on whether or not a peak is present in an X-ray diffraction pattern obtained with a powder X-ray diffractometer.

The crystalline polyester resin (A) used in the present invention preferably has in the diffraction pattern thereof, at least one diffraction peak at a 2θ position of from 19° to 25°, and more preferably has diffraction peaks at 2θ positions of (i) from 19° to 20°, (ii) from 21° to 22°, (iii) from 23° to 25°, and (iv) from 29° to 31°. When the resulting toner also has a diffraction peak at a 2θ position of from 19° to 25°, it means that the crystalline polyester resin (A) has been keeping crystallinity, which is preferable because the functions of the crystalline polyester resin (A) can be exerted securely.

Powder X-ray diffractometry is performed with RINT 1100 manufactured by Rigaku Corporation, and a wide-angle goniometer under the conditions of a Cu tube, and tube voltage-tube current of 50 kV-30 mA.

Figure 43:
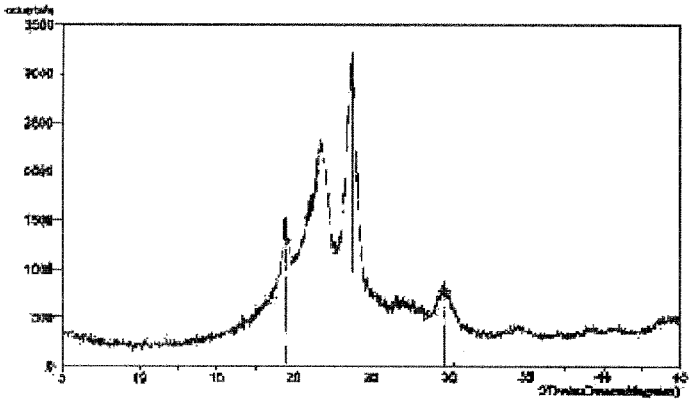
FIG. 43 is a graph showing a result of X ray diffractometry of a crystalline polyester resin a6 used in Examples.
Figure 44:
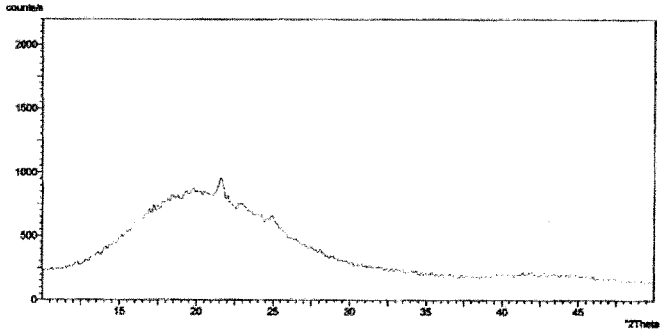
FIG. 44 is a graph showing a result of X-ray diffractometry of a toner of Example 30.

FIG. 43 shows the results of X-ray diffractometry of a crystalline polyester resin a6 (described later in detail) used in Examples, and FIG. 44 shows the results of X-ray diffractometry of a toner of Example 30.

According to FIG. 43 and FIG. 44, it was confirmed that the crystalline polyester resin a6 and the toner of Example 30 had crystallinity.

The non-crystalline resin (B) used in the present invention preferably contains a chloroform insoluble content. The non-crystalline resin (B) preferably contains the non-crystalline resin (B-1) and the non-crystalline resin (B-2), and it is more preferably if the non-crystalline resin (B-1) contains a chloroform insoluble content. It is particularly preferable if the non-crystalline resin (B-1) contains the chloroform insoluble content in an amount of from 5% by mass to 10% by mass, because this makes it easier for hot offset resistance to be exhibited. It is also preferable if the resulting toner contains a chloroform insoluble content in an amount of from 1% by mass to 30% by mass, because this ensures the toner hot offset resistance, and at the same time ensures that the toner also contains the resins other than the non-crystalline resin (B-1). When the chloroform insoluble content in the toner is less than 1% by mass, hot offset resistance attributable to the chloroform insoluble content will be poor. When the chloroform insoluble content in the toner is greater than 30% by mass, low temperature fixability will be poor, because the ratio of a content of the binder resin that contributes to the low temperature fixability is relatively low.

The chloroform insoluble content is measured as follows.

The toner (or binder resin) is weighed out in an amount of about 1.0 g, to which about 50 g of chloroform is added. A solution in which they are sufficiently dissolved is subjected to separation by centrifugation, and filtered through a 5 type C qualitative filter compliant with a JIS standard (P3801) at normal temperature. The residue on the filter is the insoluble content, and the amount of content of the chloroform insoluble content is expressed with the ratio between the mass of the toner used and the mass of the residue on the filter (% by mass).

For the measurement of the chloroform insoluble content in the resulting toner, the same method as used for the measurement of the binder resin is performed by weighing out the toner in an amount of about 1.0 g. However, the residue on the filter will contain such solid materials as a pigment, etc. Therefore, thermal analysis is separately necessary to obtain the chloroform insoluble content.

The non-crystalline resin (B-2) used in the present invention preferably has a softening temperature (T½) that is lower than that of the non-crystalline resin (B-1) by 25° C. or more. This is because the non-crystalline resin (B-1) and the non-crystalline resin (B-2) should take their own roles and realize functional separation such that the non-crystalline resin (B-2) exerts the function of reinforcing the low temperature fixability of the crystalline polyester resin (A) to contribute to the lower limit of fixing while the non-crystalline resin (B-1) exerts hot offset resistance attributable to the chloroform insoluble content thereof, i.e., to thereby exert the function of contributing to the upper limit of fixing.

It is preferable if the non-crystalline resin (B-2) has a molecular weight distribution having a main peak in the range of from 1,000 to 10,000 when measured by GPC of a THF soluble content thereof, and if the half value width of the main peak is 15,000 or less. The non-crystalline resin (B-2) satisfying these conditions exhibits a very favorable low temperature fixability. Therefore, when it is prescribed in a toner in which the amount of the crystalline polyester resin (A) is suppressed, it can make up for the low temperature fixability sufficiently. Further, although paradoxical, when it is possible that the toner has a molecular weight distribution having a main peak in the range of from 1,000 to 10,000 and the half value width of the main peak is 15,000 or less even when the toner is manufactured with the use of the non-crystalline resin (B-2) having the molecular weight distribution described above, the ratio of the non-crystalline resin (B-2) in the binder resins constituting the toner is high. The present inventors have conducted studies, and discovered that the prescription for manufacturing the toner made up of the crystalline polyester resin (A), the non-crystalline resin (B-1), the non-crystalline resin (B-2), and the composite resin (C) has the best balance when the ratio of the non-crystalline resin (B-2) is high, in which case, side effects due to an excessive crystalline polyester resin and an excessive THF insoluble content or adverse influences to the lower limit of fixing due to the composite resin (C) will not become effective, but the functions of the respective resins will become positively effective, to thereby result in favorable low temperature fixability, heat resistant storage stability, and hot offset resistance.

Hence, it is preferable if the electrophotographic image forming toner according to the present invention has a molecular weight distribution having a main peak in the range of from 1,000 to 10,000 when measured by GPC of a THF soluble content thereof, and if the half value width of the main peak is 15,000 or less.

In the present invention, the non-crystalline resin (B-1) and the non-crystalline resin (B-2) are preferable if the non-crystalline resin (B-1) contains a chloroform insoluble content, the non-crystalline resin (B-2) has an appropriate molecular weight distribution, and the softening temperatures of the non-crystalline resin (B-1) and the non-crystalline resin (B-2) satisfy the higher-lower relationship. Conventional publicly-known materials can be used as these resins. For example, the resins listed below can be used. These resins may be used alone, or two or more of these may be used in combination.

Examples of these resins include styrene-based resins (styrene, or homopolymer or copolymer containing a styrene substitute) such as polystyrene, chloropolystyrene, poly(α-methylstyrene), styrene/chlorostyrene copolymer, styrene/propylene copolymer, styrene/butadiene copolymer, styrene/vinyl chloride copolymer, styrene/vinyl acetate copolymer, styrene/maleic acid copolymer, styrene/acrylic acid ester copolymer (e.g., styrene/methyl acrylate copolymer, styrene/ethyl acrylate copolymer, styrene/butyl acrylate copolymer, styrene/octyl acrylate copolymer, and styrene/phenyl acrylate copolymer), styrene/methacrylic acid ester copolymer (e.g., styrene/methyl methacrylate copolymer, styrene/ethyl methacrylate copolymer, styrene/butyl methacrylate copolymer, and styrene/phenyl methacrylate copolymer), styrene/methyl α-chloroacrylate copolymer, and styrene/acrylonitrile/acrylic acid ester copolymer; and petroleum resins and hydrogenated petroleum resins such as vinyl chloride resin, resin modified maleic acid resin, phenol resin, epoxy resin, polyethylene resin, polypropylene resin, ionomer resin, polyurethane resin, silicone resin, ketone resin, ethylene/ethyl acrylate copolymer, xylene resin, and polyvinyl butyral resin.

The method for producing these resins is not particularly limited, and any of bulk polymerization, solution polymerization, emulsion polymerization, and suspension polymerization may be used.

The non-crystalline resin (B) used in the present invention is more preferably a polyester resin in terms of low temperature fixability. For example, it may a polyester resin typically obtained by condensation polymerization of an alcohol and a carboxylic acid.

Examples of the alcohol include: glycols such as ethylene glycol, diethylene glycol, triethylene glycol, and propylene glycol; ethylated bisphenols such as 1,4-bis(hydroxymethyl) cyclohexane and bisphenol A; dihydric alcohol monomer; and trihydric or higher polyhydric alcohol monomer.

Examples of the carboxylic acid include: divalent organic acid monomer such as maleic acid, fumaric acid, phthalic acid, isophthalic acid, terephthalic acid, succinic acid, and malonic acid; and trivalent or higher polyvalent carboxylic acid monomer such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

Particularly, the polyester resin preferably has a glass transition temperature Tg of 55° C. or higher, and more preferably 60° C. or higher, in terms of heat conservation.

The composite resin (C) is a resin in which a condensation-polymerizable monomer and an addition-polymerizable monomer are chemically bonded with each other (may also be referred to as hybrid resin).

That is, the composite resin (C) contains a condensation-polymerized resin unit and an addition-polymerized resin unit.

The composite resin (C) can be obtained by allowing a mixture of the material condensation-polymerizable monomer and the material addition-polymerizable monomer to undergo a condensation polymerization reaction and an addition polymerization reaction simultaneously in one reaction vessel, or undergo a condensation polymerization reaction and an addition polymerization reaction or an addition polymerization reaction and a condensation polymerization reaction by turns. That is, the composite resin (C) is a resin that contains a condensation-polymerized unit and an addition-polymerized unit.

Examples of the condensation-polymerizable monomer include: combination of polyhydric alcohol and polyvalent carboxylic acid for forming a polyester resin unit; and combination of polyvalent carboxylic acid and amine or amino acid for forming a polyamide resin unit or a polyester-polyamide resin unit.

Examples of dihydric alcohol component include 1,2-propanediol, 1,3-propanediol, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, and hydrogenated bisphenol A or diol obtained by polymerizing bisphenol A with cyclic ether such as ethylene oxide and propylene oxide.

Examples of trihydric or higher polyhydric alcohol include sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxybenzene.

Among these, an alcohol component having a bisphenol A skeleton, such as hydrogenated bisphenol A and diol obtained by polymerizing bisphenol A with cyclic ether such as ethylene oxide and propylene oxide, is preferable, because it parts heat resistant storage stability and mechanical strength to the resin.

Examples of carboxylic acid component include: benzenedicarboxylic acids such as phthalic acid, isophthalic acid, and terephthalic acid, or anhydride thereof alkyldicarboxylic acids such as succinic acid, adipic acid, sebacic acid, and azelaic acid, or anhydride thereof, unsaturated dibasic acid such as maleic acid, citraconic acid, itaconic acid, alkenylsuccinic acid, fumaric acid, and mesaconic acid; unsaturated dibasic acid anhydride such as maleic anhydride, citraconic anhydride, itaconic anhydride, and alkenylsuccinic anhydride.

Examples of trivalent or higher polyvalent carboxylic acid component include: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxy)methane, 1,2,7,8-octanetetracarboxylic acid, and enpol trimer acid, or anhydride thereof; and partially lower alkyl ester.

Among these, aromatic polyvalent carboxylic acid component such as phthalic acid, isophthalic acid, terephthalic acid, and trimellitic acid is preferable, in terms of heat resistant storage stability and mechanical strength of the resin.

Examples of amine component or amino acid component include, diamine (B1), trihydric or higher polyamine (B2), amino alcohol (B3), amino mercaptan (B4), amino acid (B5), and product (B6) obtained by blocking amino group of B1 to B5.

Examples of the diamine (B1) include aromatic diamine (e.g., phenylenediamine, diethyltoluenediamine, and 4,4'-diaminodiphenylmethane), alicyclic diamine (e.g., 4,4'-diamino-3,3'-dimethyldicyclohexylmethane, diaminocyclohexane, and isophoronedamine), and aliphatic diamine (e.g., ethylenediamine, tetramethylenediamine, and hexamethylenediamine).

Examples of the trihydric or higher polyamine (B2) include diethylenetriamine and triethylenetetramine.

Examples of the amino alcohol (B3) include ethanol amine and hydroxyethyl aniline.

Examples of the amino mercaptan (B4) include aminoethyl mercaptan and aminopropyl mercaptan.

Examples of the amino acid (B5) include amino propionic acid, amino caproic acid, and ϵ-caprolactam.

Examples of the product (B6) obtained by blocking amino group of (B1) to (B5) above include: ketimine obtained from the amines of (B1) to (B5) and ketones (e.g., acetone, methyl ethyl ketone, and methyl isobutyl ketone); and oxazolidine compound.

The molar ratio of the condensation-polymerizable monomer component in the composite resin (C) is preferably from 5 mol % to 40 mol %, and more preferably from 10 mol % to 25 mol %.

When the molar ratio thereof is less than 5 mol %, dispersibility thereof in the polyester-based resins will be poor. When the molar ration thereof is greater than 40 mol %, it may degrade dispersibility of a releasing agent.

An esterification catalyst or the like may be used in the condensation polymerization reaction. Any of well-known commonly-used catalysts may be used.

The addition-polymerizable monomer in the composite resin (C) is not particularly limited and may be appropriately selected according to the purpose. A representative example thereof is a vinyl-based monomer.

Examples of the vinyl-based monomer include: styrene-based vinyl monomer such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-4-dichlorostyrene, m-nitrostyrene, o-nitrostyrene, and p-nitrostyrene; acrylic-based monomer of acrylic acid, such as acrylic acid, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate; methacrylic acid-based vinyl monomer such as methacrylic acid, methyl methacrylate, ethyl methacrylate, propyl methacrylate, n-butyl methacrylate, 2-ethylhexyl methacrylate, stearyl methacrylate, phenyl methacrylate, dimethylaminoethyl methacrylate, and diethylaminoethyl methacrylate; and other vinyl monomers or other monomers forming a copolymer.

Examples of other vinyl monomers or other monomers forming a copolymer include: monoolefins such as ethylene, propylene, butylene, and isobutylene; polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compound such as N-vinylpyrrole, N-vinylcarbazole, N-vinylindole, and N-vinylpyrrolidone; vinyl naphthalin acrylic acid or methacrylic acid derivatives such as acrylonitrile, methacrylonitrile, and acrylamide; unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated dibasic acid monoesters such as maleic acid monomethyl ester, maleic acid monoethyl ester, maleic acid monobutyl ester, citraconic acid monomethyl ester, citraconic acid monoethyl ester, citraconic acid monobutyl ester, itaconic acid monomethyl ester, alkenylsuccinic acid monomethyl ester, fumaric acid monomethyl ester, and mesaconic acid monomethyl ester; esters of unsaturated dibasic acid such as dimethyl maleic acid and dimethyl fumaric acid: α,β-unsaturated acids such as crotonic acid and cinnamic acid; α,β-unsaturated acid anhydrides such as crotonic anhydride and cinnamic anhydride; anhydrides of the α,β-unsaturated acids with lower fatty acids; carboxyl group-containing monomers such as alkenylmalonic acid, alkenylglutaric acid, alkenyladipic acid, or acid anhydrides thereof or monoesters thereof, acrylic acid or methacrylic acid hydroxyalkyl esters such as 2-hydroxyethyl acrylate, 2-hydroxyethyl methacrylate, and 2-hydroxypropyl methacrylate; and hydroxy group-containing monomers such as 4-(1-hydroxy-1-methylbutyl)styrene and 4-(1-hydroxy-1-methylhexyl)styrene.

Among these, styrene; acrylic acid, n-butyl acrylate, 2-ethylhexyl acrylate, methacrylic acid, n-butyl methacrylate, and 2-ethylhexyl methacrylate are preferable. A combination of at least styrene and acrylic acid is particularly preferable, because this makes the dispersibility of a releasing agent very favorable.

A cross-linking agent for the addition-polymerizable monomer may also be added according to necessity.

Examples of the cross-linking agent include aromatic divinyl compound, examples of which include divinyl benzene and divinyl naphthalene.

Examples of diacrylate compounds linked with alkyl chain include ethyleneglycol diacrylate, 1,3-butyleneglycol diacrylate, 1,4-butanediol diacrylate, 1,5-pentanediol diacrylate, 1,6-hexanediol diacrylate, neopentylglycol diacrylate, and products obtained by replacing acrylate of these compounds with methacrylate.

Examples of diacrylate compounds linked with alkyl chain containing an ether bond include diethyleneglycol diacrylate, triethyleneglycol diacrylate, tetraethyleneglycol diacrylate, polyethyleneglycol #400 diacrylate, polyethyleneglycol #600 diacrylate, dipropyleneglycol diacrylate, and products obtained by replacing acrylate of these compounds with methacrylate.

Other examples include diacrylate compounds and dimethacrylate compounds linked with a chain containing an aromatic group and an ether bond.

Examples of polyester-type diacrylates include product name MANDA (manufactured by Nippon Kayaku Co., Ltd.).

Examples of multifunctional cross-linking agent include pentaerythritol triacrylate, trimethylolethane triacrylate, trimethylolpropane triacrylate, tetramethylolmethane tetraacrylate, oligoester acrylate, and products obtained by replacing acrylate of the above components with methacrylate, triallylcyanurate, and triallyltrimellitate.

The additive amount of the cross-linking agent is preferably from 0.01 parts by mass to 10 parts by mass, and more preferably from 0.03 parts by mass to 5 parts by mass relative to 100 parts by mass of the addition-polymerizable monomer used.

A polymerization initiator used for polymerizing the addition-polymerizable monomer is not particularly limited and may be appropriately selected according to the purpose. Examples thereof include: azo-based polymerization initiator such as 2,2'-azobisisobutyronitrile, 2,2'-azobis(4-methoxy-2,4-dimethylvaleronitrile), and 2,2'-azobis(2,4-dimethylvaleronitrile); and peroxide-based polymerization initiator such as methyl ethyl ketone peroxide, acetyl acetone peroxide, 2,2-bis(tert-butyl peroxy)butane, tert-butylhydroperoxide, benzoylperoxide, and n-butyl-4,4-di-(tert-butylperoxy)valerate.

Two or more of these may be used in mixture with a view to adjusting the molecular weight and molecular weight distribution of the resin.

The additive amount of the polymerization initiator is preferably from 0.01 parts by mass to 15 parts by mass, and more preferably from 0.1 parts by mass to 10 parts by mass relative to 100 parts by mass of the addition-polymerizable monomer used.

For example, a monomer reactive by both of condensation polymerization and addition polymerization (double reactive monomer) is used in order to chemically bond the condensation-polymerized resin unit and the addition-polymerized resin unit with each other.

Examples of such a double reactive monomer include: unsaturated carboxylic acid such as acrylic acid and methacrylic acid; unsaturated dicarboxylic acid such as fumaric acid, maleic acid, citraconic acid, and itaconic acid, or anhydride thereof; and hydroxy group-containing vinyl-based monomer.

The additive amount of the double reactive monomer is preferably from 1 part by mass to 25 parts by mass, and more preferably from 2 parts by mass to 20 parts by mass relative to 100 parts by mass of the addition-polymerizable monomer used.

The composite resin (C) can be obtained by promotion, termination or both thereof of both of the condensation polymerization reaction and the addition polymerization reaction simultaneously in one reaction vessel, or by separate promotion and termination of the respective reactions based on selection of respective reaction temperatures and times.

For example, there a method of dropping a mixture of the addition-polymerizable monomer and the polymerization initiator into a condensation-polymerizable monomer mixture in a reaction vessel to mix them previously, promoting a radical polymerization reaction to thereby terminate the addition polymerization reaction first, and then promoting condensation polymerization by raising the reaction temperature.

In this way, by promoting the two independent reactions in the reaction vessel, it is possible to effectively disperse and bond two kinds of resin units.

The composite resin (C) is preferably a composite resin containing a polyester condensation-polymerized resin unit and vinyl-based resin addition-polymerized unit, in which case, the function of the composite resin (C) can be exerted more effectively.

The softening temperature (T½) of the composite resin (C) is preferably from 90° C. to 130° C., and more preferably from 100° C. to 120° C.

When the softening temperature (T½) is lower than 90° C., heat resistant storage stability and hot offset resistance may be poor. When it is higher than 130° C., low temperature fixability may be poor.

The glass transition temperature of the composite resin (C) is preferably from 45° C. to 80° C., more preferably from 50° C. to 70° C., and yet more preferably from 53° C. to 65° C., in terms of fixability, storageability, and durability.

The acid value of the composite resin (C) is preferably from 5 mgKOH/g from 80 mgKOH/g, and more preferably from 15 mgKOH/g to 40 mgKOH/g in terms of chargeability and environmental stability.

The toner of the present invention may contain a charge controlling agent according to necessity.

Examples of the charge controlling agent include: modified product modified with nigrosine, fatty acid metal salt, etc.; onium salt such as phosphonium salt, and lake pigment thereof triphenylmethane dye and lake pigment thereof higher fatty acid metal salt; diorganotin oxide such as dibutyltin oxide, dioctyltin oxide, and dicyclohexyltin oxide; diorganotin borate such as dibutyltin borate, dioctyltin borate, and dicyclohexyltin borate; metallo-organic complex; chelate compound; monoazo metal complex; acetyl acetone metal complex; aromatic hydroxycarboxylic acid; aromatic dicarboxylic acid-based metal complex; quaternary ammonium salt; and salicylic acid metal compound. Other examples include: aromatic hydroxycarboxylic acid; aromatic mono or poly carboxylic acid and metal salt thereof anhydride; esters; and phenol derivatives such as bisphenol. Any of these publicly-known conventional charge controlling agents (polarity controlling agents) may be used alone or in mixture.

The amount of use of these charge controlling agents is from 0.1 parts by mass to 10 parts by mass, and preferably from 1 part by mass to 5 parts by mass relative to 100 parts by mass of the toner resin components.

Among these charge controlling agents, salicylic acid metal compound is preferable, because it can improve hot offset resistance at the same time. Particularly, a complex containing a trivalent or higher metal that may take a hexa-coordinated structure is effective for hot offset resistance, because it reacts with highly reactive sites of the binder resins and wax and forms a mild cross-linked structure. Further, when used in combination with the composite resin (C), it can have improved dispersibility, and can exert the charge polarity controlling function more effectively.

Examples of the trivalent or higher metal include Al, Fe, Cr, and Zr.

The salicylic acid metal compound may be the compound represented by the formula below. Examples of metal complex in which M is zinc include BONTRON E-84 manufactured by Orient Chemical Industries Co., Ltd.

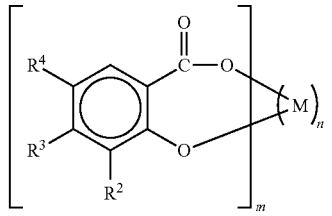

(In the formula, $R^2$, $R^3$, and $R^4$ independently represent hydrogen atom, straight-chain or branched-chain alkyl group having 1 to 10 carbon atoms, or alkenyl group having 2 to 10 carbon atoms, M represents chromium, zinc, calcium, zirconium, or aluminum, m represents an integer of 2 or greater, and n represents an integer of 1 or greater.)

The electrophotographic image forming toner of the present invention preferably has an endothermic peak attributable to the crystalline polyester resin (A) in the range of from 90° C. to 130° C. in an endothermic peak measurement of the toner by DSC (Differential Scanning calorimetry). When there is an endothermic peak attributable to the crystalline polyester resin (A) in the range of from 90° C. to 130° C., the crystalline polyester resin does not melt at normal temperature, and the toner can melt in a relative low fixing temperature range and fix on a recording medium. Therefore, heat resistant storage stability and low temperature fixability can be exerted more effectively.

The endothermic amount of the endothermic peak is preferably from 1 J/g to 15 J/g.

When the endothermic amount is less than 1 J/g, the amount of crystalline polyester resin that works effectively in the toner is very small, and the function of the crystalline polyester resin cannot be exerted sufficiently. When the endothermic amount is greater than 15 J/g, the amount of effective crystalline polyester resin in the toner is excessive, which means that the absolute amount of crystalline polyester resin to dissolve compatibly with the non-crystalline polyester resin is large, which would lower the glass transition temperature of the toner, leading to degradation of heat resistant storage stability.

In the present invention, DSC measurement (endothermic peak, glass transition temperature Tg) is performed with a differential scanning calorimeter ("DSC-60" manufactured by Shimadzu Corporation), by raising the temperature from 20° C. to 150° C. at a rate of 10° C./minute.

In the present invention, an endothermic peak attributable to the crystalline polyester resin is present nearly in the range of from 80° C. to 130° C., which is the range of the melting point of the crystalline polyester resin. An endothermic amount is obtained from the area of a range enclosed by a baseline and the endothermic curve. In a DSC measurement, an endothermic amount is typically measured after temperature raising is performed twice. However, in the present invention, an endothermic peak and a glass transition temperature are measured from an endothermic peak obtained after the first temperature raising.

When the endothermic peak attributable to the crystalline polyester resin (A) overlaps with the endothermic peak attributable to a wax, an endothermic amount attributable to the wax is subtracted from the endothermic amount of the overlapping peaks. The endothermic amount attributable to the wax is calculated from the endothermic amount of the wax only and the content of the wax in the toner.

The toner of the present invention preferably contains a fatty acid amide compound.

During the toner manufacturing process, when a fatty acid amide compound is added together with the crystalline polyester resin (A) to the toner composition to be subjected to a pulverizing step that also involves a melt-kneading step, the crystalline polyester resin (A) that melts in the kneading step is, when cooled, encouraged to recrystallize in the kneaded product, to thereby become less susceptible to compatible dissolution with the resins, which makes it possible to suppress lowering of the glass transition temperature of the toner and improve heat resistant storage stability. When the fatty acid amide compound is used in combination with a releasing agent, it can hold the releasing agent on the surface of a fixed image, and can hence provide friction resistance improve smear resistance).

The content of the fatty acid amide compound in the toner is preferably from 0.5% by mass to 10% by mass.

The fatty acid amide compound is preferably a compound represented as $R^{10}$—CO—$NR^{12}R^{13}$.

$R^{10}$ represents aliphatic hydrocarbon group having 10 to 30 carbon atoms. $R^{12}$ and $R^{13}$ independently represent hydrogen atom, alkyl group having 1 to 10 carbon atoms, aryl group having 6 to 10 carbon atoms, or aralkyl group having 7 to 10 carbon atoms. Here, alkyl group, aryl group, and aralkyl group represented by $R^{12}$ and $R^{13}$ are may be substituted for by normally inactive substituent groups such as fluorine atom, chlorine atom, cyano group, alkoxy group, and alkylthio group. No substitution is more preferable.

Preferable examples of the compound include stearic acid amide, stearic acid methylamide, stearic acid diethylamide, stearic acid benzylamide, stearic acid phenylamide, behenic acid amide, behenic acid dimethyladmie, myristic acid amide, and palmitic acid amide.

In the present invention, among others, alkylenebis fatty acid amide is particularly preferably used as the fatty acid amide compound.

Alkylenebis fatty acid amide is a compound represented by General Formula (II) below.

$$R^{14}—CO—NH—R^{15}—NH—CO—R^{16} \qquad \text{General Formula (II)}$$

(In General Formula (II), $R^{14}$ and $R^{16}$ represent alkyl group or alkenyl group having 5 to 21 carbon atoms, and $R^{15}$ represents alkylene group having 1 to 20 carbon atoms.)

Examples of alkylenebis saturated fatty acid amide represented by General Formula (II) above include methylenebis stearic acid amide, ethylenebis stearic acid amide, methylenebis palmitic acid amide, ethylenebis palmitic acid amide, methylenebis behenic acid amide, ethylenebis behenic acid amide, hexamethylenebis stearic acid amide, hexaethylenebis palmitic acid amide, and hexamethylenebis behenic acid amide. Among these, ethylenebis stearic acid amide is the most preferable.

When these fatty acid amide compounds have a softening temperature (T½) lower than the temperature of the surface of a fixing member during fixing, they can also function as a releasing agent o the surface of the fixing member.

Other specific usable examples of alkylenebis fatty acid amide-based compound include alkylenebis fatty acid amide-based compounds of saturated, or mono- or di-valent unsaturated fatty acid, such as propylenebis stearic acid amide, butylenebis stearic acid amide, methylenebis oleic acid amide, ethylenebis oleic acid amide, propylenebis oleic acid amide, butylenebis oleic acid amide, methylenebis lauric acid amid, ethylenebis lauric acid amide, propylenebis lauric acid amide, butylenebis lauric acid amide, methylenebis myristic acid amide, ethylenebis myristic acid amide, propylenebis myristic acid amide, butylenebis myristic acid amide, propylenebis palmitic acid amide, butylenebis palmitic acid amide, methylenebis palmitoleic acid amide, ethylenebis palmitoleic acid amide, propylenebis palmitoleic acid amide, butylenebis palmitoleic acid amide, methylenebis arachidic acid amide, ethylenebis arachidic acid amide, propylenebis arachidic acid amide, butylenebis arachidic acid amide, methylenebis eicosenoic acid amide, so ethylenebis eicosenoic acid amide, propylenebis eicosenoic acid amide, butylenebis eicosenoic acid amide, methylenebis behenic acid amide, ethylenebis behenic acid amide, propylenebis behenic acid amide, butylenebis behenic acid amide, methylenebis erucamide, ethylenebis erucamide, propylenebis erucamide, and butylenebis erucamide.

Examples of a colorant that can be used in the toner of the present invention include all publicly-known conventional dyes and pigments such as carbon black, lampblack, iron black, aniline blue, phthalocyanine blue, phthalocyanine green, Hanza yellow, rhodamine 6C lake, calco oil blue, chrome yellow, quinacridone, benzidine yellow, rose bengal, and triarylmethane dye, which may be used alone or in mixture, and may be used both as black toner and full-color toner.

Carbon black has a particularly favorable black coloring performance. However, it is a favorable electroconductive material at the same time. Therefore, when it is used in a large amount or present in the toner in an aggregated state, it may degrade the electric resistance and incur a transfer failure in the transfer step. Particularly, when carbon black is used in combination with the crystalline polyester resin (A), and the dispersion diameter of the crystalline polyester resin (A) in the toner is large, the concentration of the carbon black particles will be higher in the other resins than in the crystalline polyester resin (A), because the carbon black particles cannot enter the domain of the crystalline polyester resin (A). Therefore, the carbon black particles tend to be trapped in the toner in the aggregated state as is, which may lead to significant degradation of the electric resistance.

In the present invention, the carbon will be dispersed well because it is used in combination with the composite resin (C), and the above risk can be reduced. Further, addition of carbon black can make the viscosity of the melted toner high when the toner is fixed on a recording medium. Therefore, carbon black can also provide an effect of suppressing hot offset that may occur due to degradation of viscosity that arises when the non-crystalline resin (B-1) is prescribed in a large amount.

The amount of use of such colorants is typically from 1% by mass to 30% by mass, and preferably from 3% by mass to 20% by mass.

A releasing agent of the toner of the present invention may be a publicly-known conventional one. Examples of the releasing agent include: synthetic hydrocarbon-based wax such as low molecular weight polyolefin wax (e.g., low molecular weight polyethylene and low molecular weight polypropylene) and Fischer-Tropsch wax; natural wax such as beeswax, carnauba wax, candelilla wax, rice wax, and montan wax; petroleum wax such as paraffin wax and microcrystalline wax; higher fatty acid such as stearic acid, palmitic acid, and myristic acid, and metal salt of the higher fatty acid; higher fatty acid amide; synthetic ester wax; and modified wax of those above.

Among these releasing agents, carnauba wax and its modified wax, polyethylene wax, and synthetic ester-based wax are preferably used. Particularly, carnauba wax is very preferable, because it shows adequate fine dispersion in polyester resin and polyol resin and makes it easier for the toner to have all of excellent hot offset resistance, excellent transferability, and excellent durability. Further, when used in combination with the fatty acid amide compound, it significantly increases the capability of clinging to the surface of a fixed image and further improves smear resistance.

One of these releasing agents may be used alone, or two or more of these may be used in combination. The amount of use of these releasing agents is preferably from 2% by mass to 15% by mass relative to the toner. When it is less than 2% by mass, the effect of preventing hot offset will be insufficient. When it is greater than 15% by mass, transferability and durability be poor.

The melting point of the releasing agent is preferably from 70° C. to 150° C. When it is lower than 70° C., heat resistant storage stability of the toner will be poor. When it is higher than 150° C., releaseability cannot be exerted well.

The particle diameter of the toner of the present invention is preferably from 4 μm to 10 μm in terms of volume average particle diameter, in order to obtain a high image quality excellent in fine line reproducibility.

When it is smaller than 4 μm, cleanability in the developing step and transfer efficiency in the transfer step will be disturbed, which leads to degradation of image quality. When it is greater than 10 μm, fine line reproducibility on the image will be poor.

The volume average particle diameter of the toner can be measured according to various methods. In the present invention, COULTER COUNTER TAII manufactured by Coulter Electronics Inc. in U.S. is used.

It is preferable if the toner of the present invention is a pulverized toner that is manufactured according to so-called pulverization method that includes at least a melt-kneading step in the manufacturing process, because such a toner allows control of the peak ratio C/R.

The pulverization method is a method of dry-blending the toner materials which at least include the crystalline polyester resin (A) and the non-crystalline resin (B), and include the composite resin (C), a colorant and a releasing agent, and other materials such as a charge controlling agent according to necessity, melt-kneading them with a kneader, and pulverizing them to thereby obtain a pulverized toner.

First, in the melt-kneading step, the toner materials are mixed, and the mixture is melt-kneaded with a melt-kneader. Usable examples of the melt-kneader include a uniaxial continuous kneader, a biaxial continuous kneader, and a batch type kneader with a roll mill. Preferable specific examples include KTK TYPE BIAXIAL EXTRUDER manufactured by Kobe Steel, Ltd., TEM TYPE EXTRUDER manufactured by Toshiba Machine Co., Ltd., BIAXIAL EXTRUDER manufactured by KCK Engineering Co., Ltd., PCM TYPE BIAXIAL EXTRUDER manufactured by Ikegai Corp., and CO-KNEADER manufactured by Buss Inc.

It is preferable to perform melt-kneading under appropriate conditions so as not to disconnect the molecular chains of the binder resins. Specifically, melt-kneading is performed at a temperature that is determined based on the softening point of the binder resins. When the temperature is extremely higher than the softening point, disconnection will be heavy. When the temperature is extremely low, dispersion may not advance.

In the pulverizing step, the kneaded product obtained in the kneading is pulverized. In this pulverization, it is preferable to pulverize the kneaded product coarsely first, and finely next. Preferable methods used for this include a method of making the kneaded product collide on an impact board in a to thereby pulverize it, a method of making the particles of the kneaded product collide on themselves in a jet stream to thereby pulverize it, and a method of pulverizing the kneaded product in a narrow gap between a mechanically rotating rotor and a stator.

In a classifying step, the pulverized product obtained in the pulverizing step is classified and adjusted to particles of a predetermined particle diameter. Classification can be performed by removing fine particles with, for example, cyclone, decanter, and centrifugation.

When the pulverization and the classification are completed, the pulverized product is classified in an air stream with a centrifugal force or the like, to thereby manufacture a toner (toner base particles) having a predetermined particle diameter.

The toner of the present invention is preferably a pulverized toner that has undergone a melt-kneading step in the manufacturing process. When the kneaded product obtained by melt-kneading the raw materials has a thickness of 2.5 mm or greater in a cooling step performed after the melt-kneading, the kneaded product will be cooled slowly, and the time for which recrystallization of the crystalline polyester resin (A) melted in the kneaded product occurs will be long, which fosters the recrystallization and allows the crystalline polyester resin (A) to exert the functions more effectively. The above-described technique of adding the fatty acid amide is also effective for fostering the recrystallization, while such an adjustment of the manufacturing process as above is also effective. There is no upper limit to the thickness of the kneaded product, but when it is greater than 8 mm, the efficiency of the pulverizing step will be significantly degraded, and the peak ratio C/R will be high. Therefore, it is preferable to keep the thickness equal to or less than 8 mm.

The kneaded product undergone the melt-kneading step will be discharged in a block form, if nothing is done. Therefore, it takes an extremely long time to be cooled, and significantly degrades the efficiency of the pulverizing step. Hence, the kneaded product is typically formed into a thin plate shape through a rolling step. In the present invention, the thickness of the kneaded product (the thin plate-shaped product obtained in the rolling step) is preferably adjusted to 2.5 mm or greater, because this inhibits quenching but allows slow cooling, and can foster recrystallization of the crystalline polyester resin (A).

In order to improve flowability, storage stability, developability, and transferability of the toner, it is possible to further add and mix inorganic particles such as hydrophobic silica particles to the toner base particles manufactured as described above.

A typical powder mixer used for mixing such an additive. It is preferable to fit the mixer with a jacket or the like to enable adjustment of the internal temperature. It is possible to, for example, add the additive from the middle of the process, or in a gradual manner, in order to change the history of the load to be applied to the additive.

It is also possible to change rotation speed, rolling speed, time, and temperature of the mixer appropriately. It is possible to apply a heavy load first, and then a relatively light load next, and vice versa.

Examples of the mixing equipment that can be used in the additive mixing step include V type mixer, rocking mixer, Lodige mixer, Nauta mixer, and Henschel mixer.

After the mixing step, the resulting product may be passed through a sieve of 250 mesh or greater, to remove coarse particles and aggregated particles.

When the toner of the present invention is used as a developer, it may be used as one-component developer containing only the toner, or may be mixed with a carrier and used as a two-component developer. Although not limited, the toner is preferably used as a two-component developer in terms of improvement of the life, etc., when used in a high-speed printer or the like that is adapted to the recent improvement in the information processing speed.

EXAMPLES

The present invention will now be explained based on Examples and Comparative Examples. The present invention is not limited to the Examples presented below. In the following description, "part" represents part by mass.

Example 1

Production of Pulverized Toner

<Prescription of Pulverized Toner 1>

| | |
|---|---|
| Crystalline polyester resin: a-1 | 4 parts by mass |
| Non-crystalline resin: b1-1 | 35 parts by mass |
| Non-crystalline resin: b2-1 | 55 parts by mass |
| Composite resin: c-1 | 10 parts by mass |
| Colorant: p-1 | 14 parts by mass |
| Releasing agent: carnauba wax (melting point: 81° C.) | 6 parts by mass |

-continued

| | |
|---|---|
| Charge controlling agent: monoazo metal complex (BONTRON S-34 manufactured by Orient Chemical Industries Co., Ltd.) | 2 parts by mass |

According to the above prescription, the raw materials described in Tables 1 to 5 below, and the tone a materials give above, namely, the releasing agent and the charge controlling agent were previously mixed with a Henschel mixer (FM20B manufactured by Mitsui Miike Machinery Co., Ltd.), and after this, melted and kneaded with a biaxial kneader (PCM-30 manufactured by Ikegai Corp.) at the temperature of from 100° C. to 130° C. The obtained kneaded product was rolled with a roller to a thickness of 2.7 mm, and after this, cooled to room temperature with a cooler, and coarsely pulverized with a hammer mill to from 200 μm to 300 μm. Next, the resultant was finely pulverized with a supersonic speed jet pulverizer LABJET (MDS-I manufactured by Nippon Pneumatic Mfg. Co., Ltd.), and after this, classified with an air stream classifier (MDS-I manufactured by Nippon Pneumatic Mfg. Co., Ltd.) with appropriate adjustment of the louver position to obtain a weight average particle diameter of from 6.9±0.2 μm, to thereby obtain toner base particles. Next, the toner base particles (100 pats by mass) were stirred and mixed with an additive (HDK-2000 manufactured by Clariant K.K.) (1.0 part by mass) with a Henschel mixer, to thereby produce a pulverized toner 1.

The produced pulverized toner 1 (5% by mass) was mixed uniformly with a coating ferrite carrier (95% by mass) with a Turbula mixer (manufactured by Willy A. Bachofen (WAB) AG) at 48 rpm for 5 minutes, to thereby produce a pulverized toner developer 1.

Examples 2 to 30 and Comparative Examples 1 to 8

In the same manner as Example 1, toners 2 to 38 and pulverized toner developers 2 to 38 were produced by mixing, kneading, pulverizing, and mixing with an additive, the raw materials described in Tables 1 to 5 below, and the releasing agent and charge controlling agent described in Tables 6, and depending on Production Examples, fatty acid amide in an amount described in Tables 6 (part by mass), and with the rolling thickness described in Tables 6.

As for the toner 33, dispersion of a pigment in the resins was poor. Therefore, before mixed with other raw materials, a colorant p-2 was previously kneaded with a non-crystalline resin b2-3 and pure water, to be formed as a master batch, with which the toner was produced. The ratio of the raw materials to be compounded in the final toner product was adjusted to be as shown in Table 6-4, when calculated back from the amount of the non-crystalline resin b2-3 contained in the master batch.

<Production of Master Batch of Pulverized Toner 33>

| | |
|---|---|
| Non-crystalline resin: b2-3 | 100 parts by mass |
| Colorant: p-2 | 50 parts by mass |
| Pure water | 50 parts by mass |

Needless to say, in the present invention, the method for manufacturing the master batch is not limited to the one described above.

The salicylic acid metal compound as the charge controlling agent used in Examples 28 to 30 was a metal complex (BONTRON E-84 manufactured by Orient Chemical Industries Co., Ltd.), which was a zinc salicylate compound.

TABLE 1

| Crystalline polyester (A) | Glass transition temp. Tg [° C.] | Softening temp. T½ [° C.] | Presence/absence of ester bond in General Formula (1) | Alcohol component | Carboxylic acid component |
|---|---|---|---|---|---|
| a-1 | 98 | 104 | Absent | 1,5-pentanediol | Fumaric acid |
| a-2 | 81 | 86 | Absent | 1,4-butanediol | Terephthalic acid |
| a-3 | 84 | 89 | Absent | 1,5-pentanediol | Maleic acid |
| a-4 | 116 | 122 | Absent | 1,6-hexanediol | Terephthalic acid |
| a-5 | 119 | 126 | Absent | 1,5-pentanediol | Terephthalic acid |
| a-6 | 100 | 106 | Present | 1,6-hexanediol | Fumaric acid |

The crystalline polyesters a-1 to a-6 presented above were resins obtained by using a compound selected from 1,4-butanediol, 1,5-pentanediol, and 1,6-hexanediol as the alcohol component, and a compound selected from fumaric acid, maleic acid, and terephthalic acid as the carboxylic acid component.

Specifically, the monomers for the alcohol component and for the carboxylic acid component shown in Table 1 were allowed to undergo esterification reaction at normal pressure at from 170° C. to 260° C. without a catalyst. After this, antimony trioxide was added to the reaction system in an amount of 400 ppm relative to the total amount of carboxylic acid component, and they were polycondensed under vacuum of 3 Torr at 250° C. while removing glycol to the outside of the system, to thereby obtain a crystalline resin. Cross-linking reaction was promoted until the stirring torque became 0 kg·cm (100 ppm), and the reaction was terminated by releasing the reaction system from the reduced pressure state.

The crystalline polyesters a-1 to a-6 were confirmed to be crystalline polyesters, because they had at least one diffraction peak at the 20 position of from 19° to 25° in an X-ray diffraction pattern obtained with a powder X-ray diffractometer. The result of X-ray diffractometry of the crystalline polyester resin a-6 is shown in FIG. 43.

TABLE 2

| Non-crystalline rein (B-1) | Material | Softening temp. [° C.] | Chloroform insoluble content [% by mass] | Acid component | Alcohol component |
|---|---|---|---|---|---|
| b1-1 | Polyester | 140 | 21 | Fumaric acid, Trimellitic anhydride | Bisphenol A (2,2) propylene oxide, Bisphenol A (2,2) ethylene oxide |
| b1-2 | Polyester | 145 | 4 | Isophthalic acid, Trimellitic anhydride | Bisphenol A (2,2) propylene oxide, Bisphenol A (2,2) ethylene oxide |
| b1-3 | Polyester | 140 | 6 | Fumaric acid, Trimellitic anhydride | Bisphenol A (2,2) propylene oxide, Bisphenol A (2,2) ethylene oxide |
| b1-4 | Polyester | 151 | 39 | Dodecenyl succinic anhydride, Trimellitic anhydride | Bisphenol A (2,2) propylene oxide, Bisphenol A (2,2) ethylene oxide |
| b1-5 | Polyester | 141 | 41 | Fumaric acid, Trimellitic anhydride | Ethylene glycol, Bisphenol A (2,2) propylene oxide, Bisphenol A (2,2) ethylene oxide |
| b1-6 | Styrene acrylic | 165 | 13 | Styrene/methyl acrylate copolymer resin | |

TABLE 3

| Non-crystalline resin (B-2) | Material | Softening temp. [° C.] | Glass transition temp. [° C.] | Molecular weight distribution | | Acid component | Alcohol component |
|---|---|---|---|---|---|---|---|
| | | | | Main/ peak | Half value width | | |
| b2-1 | Polyester | 100 | 63 | 5,000 | 17,000 | Fumaric acid | Bisphenol A (2,2) propylene oxide, |

TABLE 3-continued

| Non-crystalline resin (B-2) | Material | Softening temp. [° C.] | Glass transition temp. [° C.] | Molecular weight distribution Main/peak | Molecular weight distribution Half value width | Acid component | Alcohol component |
|---|---|---|---|---|---|---|---|
| | | | | | | | Bisphenol A (2,2) ethylene oxide |
| b2-2 | Styrene acrylic | 135 | 60 | 14,000 | 31,000 | Styrene/methyl acrylate copolymer resin | |
| b2-3 | Polyester | 89 | 62 | 4,000 | 13,000 | Terephthalic acid, Dodecenyl succinic anhydride, Trimellitic anhydride | Bisphenol A (2,2) propylene oxide, Bisphenol A (2,2) ethylene oxide |

TABLE 4

| Composite resin (C) | Condensation polymerized unit | Addition polymerized unit |
|---|---|---|
| c-1 | Polyester-based | Vinyl-based |
| c-2 | Polyamide-based | Vinyl-based |

The non-crystalline resins b1-1 to b1-5 and b2-1 to b2-3 were resins obtained as follows.

The monomers described in Tables 2 and 3 above were allowed to undergo esterification reaction at normal pressure at from 170° C. to 260° C. without a catalyst. After this, antimony trioxide was added to the reaction system in an amount of 400 ppm relative to the total amount of carboxylic acid component, and they were polycondensed under vacuum of 3 Torr at 250° C. while removing glycol to the outside of the system, to thereby obtain a resin. Cross-linking reaction was promoted until the stirring torque became 10 kg·cm (100 ppm), and the reaction was terminated by releasing the reaction system from the reduced pressure state.

The non-crystalline resins b-1 to b-6 and b2-1 to b2-3 were confirmed to be non-crystalline, because they had no diffraction peak in an X-ray diffraction pattern.

The non-crystalline resins b2-1 and b2-3 were confirmed to be dissolved completely in chloroform and contain no chloroform insoluble content.

(Synthesis of Composite Resin c)

Terephthalic acid (0.8 mol), fumaric acid (0.6 mol), trimellitic anhydride (0.8 mol), bisphenol A (2.2) propylene oxide (1.1 mol), and bisphenol A (2,2) ethylene oxide (0.5 mol) as condensation-polymerizable monomers, and dibutyltin oxide as an esterification catalyst (9.5 mol) were put into a 5-liter four-necked flask equipped with a nitrogen introducing pipe, a dehydrating pipe, a stirrer, a dropping funnel, and a thermocouple, and heated under nitrogen atmosphere to 135° C.

While they were stirred, a mixture of styrene (10.5 mol), acrylic acid (3 mol), and 2-ethylhexyl acrylate (1.5 mol) as addition-polymerizable monomers, and t-butylhydroperoxide as a polymerization initiator (0.24 mol), which was put in the dropping funnel, was dropped into the flask in 5 hours. The resultant was reacted for 6 hours.

Next, the resultant was raised to 210° C. in 3 hours, and reacted at 210° C. at 10 kPa until it had a desired softening point, to thereby synthesize the composite resin c-1.

The obtained composite resin c-1 had a softening temperature of 115° C., a glass transition temperature of 58° C., and an acid value of 25 mgKOH/g.

The composite resin c-2 was synthesized in the same manner as the composite resin c-1, except that hexamethylenediamine and ϵ-caprolactam were used as condensation-polymerizable monomers, and styrene, acrylic acid, and 2-ethylhexyl acrylate were used as addition-polymerizable monomers.

TABLE 5

| Colorant | Material |
|---|---|
| p-1 | Carbon black |
| p-2 | Phthalocyanine blue |

TABLE 6-1

| | | Crystalline polyester (A) Material/[part by mass] | Non-crystalline resin (B-1) Material/[part by mass] | Non-crystalline resin (B-2) Material/[part by mass] | Composite resin (C) Material/[part by mass] | Colorant Material/[part by mass] | Releasing agent Material/[part by mass] | Charge controlling agent Material/part by mass] | Fatty acid amide Material/[part by mass] | Kneaded product thickness when cooled [mm] |
|---|---|---|---|---|---|---|---|---|---|---|
| Ex. 1 | Toner 1 | a-1/[4] | b1-1/[35] | b2-1/[55] | c-1/[10] | p-1/[14] | Carnauba wax/[6] | Monoazo metal complex/[2] | — | 2.7 |
| Comp. Ex. 1 | Toner 2 | — | b1-1/[35] | b2-1/[55] | c-1/[10] | p-1/[14] | Carnauba wax/[6] | Monoazo metal complex/[2] | — | 2.7 |

TABLE 6-1-continued

| | | Crystalline polyester (A) Material/ [part by mass] | Non-crystalline resin (B-1) Material/ [part by mass] | Non-crystalline resin (B-2) Material/ [part by mass] | Composite resin (C) Material/ [part by mass] | Colorant Material/ [part by mass] | Releasing agent Material/ [part by mass] | Charge controlling agent Material/ part by mass] | Fatty acid amide Material/ [part by mass] | Kneaded product thickness when cooled [mm] |
|---|---|---|---|---|---|---|---|---|---|---|
| Comp. Ex. 4 | Toner 5 | a-1/[4] | b1-1/[45] | b2-1/[45] | c-1/[10] | p-1/[14] | Carnauba wax/[6] | Monoazo metal complex/[2] | — | 2.7 |
| Ex. 2 | Toner 6 | a-1/[4] | b1-1/[40] | b2-1/[50] | c-1/[10] | p-1/[14] | Carnauba wax/[6] | Monoazo metal complex/[2] | — | 2.7 |
| Ex. 3 | Toner 7 | a-1/[4] | b1-1/[25] | b2-1/[65] | c-1/[10] | p-1/[14] | Carnauba wax/[6] | Monoazo metal complex/[2] | — | 2.7 |
| Comp. Ex. 5 | Toner 8 | a-1/[4] | b1-1/[20] | b2-1/[70] | c-1/[10] | p-1/[14] | Carnauba wax/[6] | Monoazo metal complex/[2] | — | 2 7 |
| Ex. 4 | Toner 9 | a-1/[4] | b1-1/[28] | b2-1/[62] | c-1/[5] | p-1/[14] | Carnauba wax/[6] | Monoazo metal complex/[2] | — | 2.7 |
| Comp. Ex. 7 | Toner 11 | a-1/[0.8] | b1-1/[35] | b2-1/[55] | c-1/[10] | p-1/[14] | Carnauba wax/[6] | Monoazo metal complex/[2] | — | 2.7 |

TABLE 6-2

| | | Crystalline polyester (A) Material/ [part by mass] | Non-crystalline resin (B-1) Material/ [part by mass] | Non-crystalline resin (B-2) Material/ [part by mass] | Composite resin (C) Material/ [part by mass] | Colorant Material/ [part by mass] | Releasing agent Material/ [part by mass] | Charge controlling agent Material/ [part by mass] | Fatty acid amide Material/ [part by mass] | Kneaded product thickness when cooled [mm] |
|---|---|---|---|---|---|---|---|---|---|---|
| Ex. 5 | Toner 12 | a-1/[1.5] | b1-1/[35] | b2-1/[55] | c-1/[10] | p-1/[14] | Carnauba wax/[6] | Monoazo metal complex/[2] | — | 2.7 |
| Ex. 6 | Toner 13 | a-1/[14] | b1-1/[35] | b2-1/[55] | c-1/[10] | p-1/[14] | Carnauba wax/[6] | Monoazo metal complex/[2] | — | 2.7 |
| Comp. Ex. 8 | Toner 14 | a-1/[16] | b1-1/[35] | b2-1/[55] | c-1/[10] | p-1/[14] | Carnauba wax/[6] | Monoazo metal complex/[2] | — | 2 7 |
| Ex. 7 | Toner 15 | a-1/[4] | b1-3/[10] | b2-3/[80] | c-1/[10] | p-1/[14] | Carnauba wax/[6] | Monoazo metal complex/[2] | — | 2.7 |
| Ex. 8 | Toner 16 | a-1/[4] | b1-3/[14] | b2-3/[76] | c-1/[10] | p-1/[14] | Carnauba wax/[6] | Monoazo metal complex/[2] | — | 2.7 |
| Ex. 9 | Toner 17 | a-1/[4] | b1-4/[70] | b2-3/[20] | c-1/[10] | p-1/[14] | Carnauba wax/[6] | Monoazo metal complex/[2] | — | 2.7 |
| Ex. 10 | Toner 18 | a-1/[4] | b1-4/[78] | b2-3/[12] | c-1/[10] | p-1/[14] | Carnauba wax/[6] | Monoazo metal complex/[2] | — | 2.7 |
| Ex. 11 | Toner 19 | a-2/[4] | b1-1/[35] | b2-1/[55] | c-1/[10] | p-1/[14] | Carnauba wax/[6] | Monoazo metal complex/[2] | — | 2.7 |

TABLE 6-3

| | | Crystalline polyester (A) Material/ [part by mass] | Non-crystalline resin (B-1) Material/ [part by mass] | Non-crystalline resin (B-2) Material/ [part by mass] | Composite resin (C) Material/ [part by mass] | Colorant Material/ [part by mass] | Releasing agent Material/ [part by mass] | Charge controlling agent Material/ [part by mass] | Fatty acid amide Material/ [part by mass] | Kneaded product thickness when cooled [mm] |
|---|---|---|---|---|---|---|---|---|---|---|
| Ex. 12 | Toner 20 | a-3/[4] | b1-1/[35] | b2-1/[55] | c-1/[10] | p-1/[14] | Carnauba wax/[6] | Monoazo metal complex/[2] | — | 2.7 |
| Ex. 13 | Toner 21 | a-1/[1] | b1-1/[35] | b2-1/[55] | c-1/[10] | p-1/[14] | Carnauba wax/[6] | Monoazo metal complex/[2] | — | 2.7 |

TABLE 6-3-continued

| | | Crystalline polyester (A) Material/ [part by mass] | Non-crystalline resin (B-1) Material/ [part by mass] | Non-crystalline resin (B-2) Material/ [part by mass] | Composite resin (C) Material/ [part by mass] | Colorant Material/ [part by mass] | Releasing agent Material/ [part by mass] | Charge controlling agent Material/ [part by mass] | Fatty acid amide Material/ [part by mass] | Kneaded product thickness when cooled [mm] |
|---|---|---|---|---|---|---|---|---|---|---|
| Ex. 14 | Toner 22 | a-1/[15] | b1-1/[35] | b2-1/[55] | c-1/[10] | p-1/[14] | Carnauba wax/[6] | Monoazo metal complex/[2] | — | 2.7 |
| Ex. 15 | Toner 23 | a-4/[4] | b1-1/[35] | b2-1/[55] | c-1/[10] | p-1/[14] | Carnauba wax/[6] | Monoazo metal complex/[2] | — | 2.7 |
| Ex. 16 | Toner 24 | a-5/[4] | b1-1/[35] | b2-1/[55] | c-1/[10] | p-1/[14] | Carnauba wax/[6] | Monoazo metal complex/[2] | — | 2.7 |
| Ex. 17 | Toner 25 | a-1/[4] | b1-1/[90] | — | c-1/[10] | p-1/[14] | Carnauba wax/[6] | Monoazo metal complex/[2] | — | 2.7 |
| Ex. 18 | Toner 26 | a-1/[4] | b1-1/[35] | b2-2/[55] | c-1/[10] | p-1/[14] | Carnauba wax/[6] | Monoazo metal complex/[2] | — | 2.7 |
| Ex. 19 | Toner 27 | a-1/[4] | b1-6/[35] | b2-3/[55] | c-1/[10] | p-1/[14] | Carnauba wax/[6] | Monoazo metal complex/[2] | — | 2.7 |

TABLE 6-4

| | | Crystalline polyester (A) Material/ [part by mass] | Non-crystalline resia (B-1) Material/ [part by mass] | Non-crystalline resin (B-2) Material/ [part by mass] | Composite resin (C) Material/ [part by mass] | Colorant Material/ [part by mass] | Releasing agent Material/ [part by mass] | Charge controlling agent Material/ [part by mass] | Fatty acid amide Material/ [part by mass] | Kneaded product thickness when cooled [mm] |
|---|---|---|---|---|---|---|---|---|---|---|
| Ex. 20 | Toner 28 | a-1/[4] | b1-2/[35] | b2-3/[55] | c-1/[10] | p-1/[14] | Carnauba wax/[6] | Monoazo metal complex/[2] | — | 2.7 |
| Ex. 21 | Toner 29 | a-1/[4] | b1-3/[35] | b2-3/[55] | c-1/[10] | p-1/[14] | Carnauba wax/[6] | Monoazo metal complex/[2] | — | 2.7 |
| Ex. 22 | Toner 30 | a-1/[4] | b1-4/[35] | b2-3/[55] | c-1/[10] | p-1/[14] | Carnauba wax/[6] | Monoazo metal complex/[2] | — | 2.7 |
| Ex. 23 | Toner 31 | a-1/[4] | b1-5/[35] | b2-3/[55] | c-1/[10] | p-1/[14] | Carnauba wax/[6] | Monoazo metal complex/[2] | — | 2.7 |
| Ex. 24 | Toner 32 | a-1/[4] | b1-1/[35] | b2-3/[55] | c-1/[10] | p-1/[14] | Carnauba wax/[6] | Monoazo metal complex/[2] | N,N'-ethylene-bisstearic acid amide/[2] | 2.7 |
| Ex. 25 | Toner 33 | a-1/[4] | b1-1/[35] | b2-3/[55] | c-1/[10] | p-2/[14] | Carnauba wax/[6] | Monoazo metal complex/[2] | N,N'-ethylene-bisstearic acid amide/[2] | 2.7 |
| Ex. 26 | Toner 34 | a-6/[4] | b1-1/[35] | b2-3/[55] | c-1/[10] | p-1/[14] | Carnauba wax/[6] | Monoazo metal complex/[2] | N,N'-ethylene-bisstearic acid amide/[2] | 2.7 |
| Ex. 27 | Toner 35 | a-6/[4] | b1-1/[35] | b2-3/[55] | c-1/[10] | p-1/[14] | Carnauba wax/[6] | Monoazo metal complex/[2] | N,N'-ethylene-bisstearic acid amide/[2] | 2.7 |

TABLE 6-5

| | | Crystalline polyester (A) Material/ [part by mass] | Non-crystalline resin (B-1) Material/ [part by mass] | Non-crystalline resin (B-2) Material/ [part by mass] | Composite resin (C) Material/ [part by mass] | Colorant Material/ [part by mass] | Releasing agent Material/ [part by mass] | Charge controlling agent Material/ [part by mass] | Fatty acid amide Material/ [part by mass] | Kneaded product thickness when cooled [mm] |
|---|---|---|---|---|---|---|---|---|---|---|
| Ex. 28 | Toner 36 | a-6/[4] | b1-1/[35] | b2-3/[55] | c-1/[10] | p-1/[14] | Carnauba wax/[6] | Salicylic acid metal compound/[2] | N,N'-ethylene-bisstearic acid amide/[2] | 2.3 |
| Ex. 29 | Toner 37 | a-6/[4] | b1-1/[35] | b2-3/[55] | c-1/[10] | p-1/[14] | Carnauba wax/[6] | Salicylic acid metal compound/[2] | N,N'-ethylene-bisstearic acid amide/[2] | 2.7 |
| Ex. 30 | Toner 38 | a-6/[4] | b1-1/[35] | b2-3/[55] | c-1/[10] | p-1/[14] | Carnauba wax/[6] | Salicylic acid metal compound/[2] | N,N'-ethylene-bisstearic acid amide/[2] | 2.7 |

Molecular weight main peak, molecular weight distribution main peak half value width, spectral peak height ratio (C/R) after storage at 45° C. for 12 hours measured by ATR method with the above Fourier-transform infrared spectroscopic analyzer (FT-IR), peak temperature/endothermic amount attributed to the crystalline polyester resin (A) measured by DSC in the range of from 90° C. to 130° C., and volume average particle diameter of the produced pulverized toners are shown in Tables 7.

TABLE 7-1

| | | | Toner molecular weight main peak | Toner molecular weight half value width | C/R | DSC peak temp. in range of from 90° C. to 130° C. [° C.] | DSC peak endothermic amount in range of from 90° C. to 130° C. [J/g] | Chloroform insoluble content [% by mass] | Volume average particle diameter [μm] |
|---|---|---|---|---|---|---|---|---|---|
| Production Ex. 1 | Ex. 1 | Toner 1 | 7,400 | 13,000 | 0.12 | 108 | 5 | 7 | 6.9 |
| Production Ex. 2 | Comp. Ex. 1 | Toner 2 | 7,400 | 13,000 | — | — | — | 8 | 6.9 |
| Production Ex. 5 | Comp. Ex. 4 | Toner 5 | 900 | 9,000 | 0.12 | 108 | 5 | 9 | 6.9 |
| Production Ex. 6 | Ex. 2 | Toner 6 | 1,100 | 10,000 | 0.12 | 108 | 5 | 8 | 6.9 |
| Production Ex. 7 | Ex. 3 | Toner 7 | 9,800 | 13,800 | 0.12 | 108 | 5 | 5 | 6.9 |
| Production Ex. 8 | Comp. Ex. 5 | Toner 8 | 11,000 | 14,100 | 0.12 | 108 | 5 | 4 | 6.9 |
| Production Ex. 9 | Ex. 4 | Toner 9 | 8,800 | 14,500 | 0.12 | 108 | 5 | 5 | 6.9 |
| Production Ex. 11 | Comp. Ex. 7 | Toner 11 | 7,400 | 13,000 | 0.02 | 108 | 0.6 | 7 | 6.9 |
| Production Ex. 12 | Ex. 5 | Toner 12 | 7,400 | 13,000 | 0.05 | 108 | 1.3 | 7 | 6.9 |
| Production Ex. 13 | Ex. 6 | Toner 13 | 7,400 | 13,000 | 0.51 | 108 | 14 | 7 | 6.9 |
| Production Ex. 14 | Comp. Ex. 8 | Toner 14 | 7,400 | 13,000 | 0.58 | 108 | 17 | 7 | 6.9 |
| Production Ex. 15 | Ex. 7 | Toner 15 | 3,500 | 8,500 | 0.12 | 108 | 5 | 0.6 | 6.9 |
| Production Ex. 16 | Ex. 8 | Toner 16 | 4,000 | 9,000 | 0.12 | 108 | 5 | 1.1 | 6.9 |

TABLE 7-2

| | | | Toner molecular weight main peak | Toner molecular weight half value width | C/R | DSC peak temp. in range of from 90° C. to 130° C. [° C.] | DSC peak endothermic amount in range of from 90° C. to 130° C. [J/g] | Chloroform insoluble content [% by mass] | Volume average particle diameter [μm] |
|---|---|---|---|---|---|---|---|---|---|
| Production Ex. 17 | Ex. 9 | Toner 17 | 9,300 | 12,800 | 0.12 | 108 | 5 | 27 | 6.9 |
| Production Ex. 18 | Ex. 10 | Toner 18 | 9,500 | 13,000 | 0.12 | 108 | 5 | 31 | 6.9 |
| Production Ex. 19 | Ex. 11 | Toner 19 | 7,400 | 13,000 | 0.10 | 88 | 5 | 7 | 6.9 |

TABLE 7-2-continued

| | | Toner molecular weight main peak | Toner molecular weight half value width | C/R | DSC peak temp. in range of from 90° C. to 130° C. [° C.] | DSC peak endothermic amount in range of from 90° C. to 130° C. [J/g] | Chloroform insoluble content [% by mass] | Volume average particle diameter [μm] |
|---|---|---|---|---|---|---|---|---|
| Production Ex. 20 | Ex. 12 Toner 20 | 7,400 | 13,000 | 0.11 | 92 | 5 | 7 | 6.9 |
| Production Ex. 21 | Ex. 13 Toner 21 | 7,400 | 13,000 | 0.04 | 108 | 0.8 | 7 | 8.9 |
| Production Ex. 22 | Ex. 14 Toner 22 | 7,400 | 13,000 | 0.53 | 108 | 16 | 7 | 6.9 |
| Production Ex. 23 | Ex. 15 Toner 23 | 7,400 | 13,000 | 0.13 | 127 | 5 | 7 | 6.9 |
| Production Ex. 24 | Ex. 16 Toner 24 | 7,400 | 13,000 | 0.14 | 131 | 5 | 7 | 6.9 |
| Production Ex. 25 | Ex. 17 Toner 25 | 9,800 | 14,700 | 0.12 | 108 | 5 | 16 | 6.9 |
| Production Ex. 26 | Ex. 18 Toner 26 | 9,500 | 14,000 | 0.12 | 108 | 5 | 7 | 6.9 |
| Production Ex. 27 | Ex. 19 Toner 27 | 7,700 | 13,000 | 0.12 | 108 | 5 | 4 | 6.9 |
| Production Ex. 28 | Ex. 20 Toner 28 | 3,400 | 8,900 | 0.12 | 108 | 5 | 2 | 6.9 |
| Production Ex. 29 | Ex. 21 Toner 29 | 3,800 | 9,500 | 0.12 | 108 | 5 | 2 | 6.9 |

TABLE 7-3

| | | Toner molecular weight main peak | Toner molecular weight half value width | C/R | DSC peak temp. in range of from 90° C. to 130° C. [° C.] | DSC peak endothermic amount in range of from 90° C. to 130° C. [J/g] | Chloroform insoluble content [% by mass] | Volume average particle diameter [μm] |
|---|---|---|---|---|---|---|---|---|
| Production Ex. 30 | Ex. 22 Toner 30 | 7,500 | 13,100 | 0.12 | 108 | 5 | 12 | 6.9 |
| Production Ex. 31 | Ex. 23 Toner 31 | 8,000 | 13,400 | 0.12 | 108 | 5 | 14 | 6.9 |
| Production Ex. 32 | Ex. 24 Toner 32 | 6,500 | 13,000 | 0.12 | 108 | 5 | 7 | 6.9 |
| Production Ex. 33 | Ex. 25 Toner 33 | 7,000 | 12,500 | 0.12 | 108 | 5 | 9 | 6.9 |
| Production Ex. 34 | Ex. 26 Toner 34 | 7,200 | 12,500 | 0.11 | 110 | 5 | 7 | 6.9 |
| Production Ex. 35 | Ex. 27 Toner 35 | 7,000 | 12,500 | 0.11 | 110 | 5 | 8 | 6.9 |
| Production Ex. 36 | Ex. 28 Toner 36 | 7,000 | 12,500 | 0.08 | 110 | 5 | 7 | 6.9 |
| Production Ex. 37 | Ex. 29 Toner 37 | 7,000 | 12,500 | 0.11 | 110 | 5 | 7 | 4.4 |
| Production Ex. 38 | Ex. 30 Toner 38 | 7,000 | 12,500 | 0.11 | 110 | 5 | 7 | 6.9 |

Examples 1 to 30 and Comparative Examples 1 to 8

Toner Housing Container

The toner housing container shown in FIG. 10 (having a cross-section shown in FIG. 30 at the container opening portion) was used. The container body was filled with the toner produced in Production Example 6.

The container body of the toner housing container shown in FIG. 10 had a protruding portion that protruded from the container body interior side of the container opening portion toward one end of the container body.

The uplifting portion had an uplifting wall surface that extended from the internal wall surface of the container body toward the protruding portion, and a curving portion that curved so as to conform to the protruding portion.

The uplifting portion also had a rising portion that rose from the internal wall surface of the container body toward the protruding portion. The rising portion had the curving portion that curved so as to conform to the protruding portion.

The protruding portion was provided such that when the toner housing container was mounted on a toner conveying device, the protruding portion may be present between the curving portion and a toner receiving port of a conveying pipe being inserted.

Further, in the toner housing container shown in FIG. 10, the protruding portion was a plate-shaped member, and provided such that a flat side surface of the plate-shaped member (i.e., the side surface thereof in the thickness direction) may be present between the curving portion and the toner receiving port of the toner conveying pipe being inserted.

Moreover, the toner housing container shown in FIG. 10 had two uplifting portions that each had the uplifting wall surface. The two uplifting portions were provided such that when the toner housing container was mounted on the toner conveying device, the protruding portion may be present between the curving portion of each uplifting portion and the toner receiving port of the conveying pipe being inserted.

In the toner housing container shown in FIG. 10, the uplifting portions were formed integrally with the container body, the protruding portion was fixed on the container body, and the uplifting portions were configured to uplift the toner from a lower side to an upper side along with rotation of the container body.

Results of testing of each toner filled in the toner housing container, and results of testing of occurrence of abnormal streaky/dotted images by filling the container with each toner are shown in Tables 8.

TABLE 8-1

| | | | Low temp. fixability | Hot offset resistance | Fine line reproducibility (initial) | Fine line reproducibility (over time) | Heat resistant storage stability | Smear resistance | Abnormal streaky/dotted image |
|---|---|---|---|---|---|---|---|---|---|
| Production Ex. 1 | Ex. 1 | Toner 1 | B | B | A | A | B | B | B |
| Production Ex. 2 | Comp. Ex. 1 | Toner 2 | D | B | A | A | C | D | D |
| Production Ex. 5 | Comp. Ex. 4 | Toner 5 | B | D | A | B | D | B | D |
| Production Ex. 6 | Ex. 2 | Toner 6 | B | C | A | B | BB | B | B |
| Production Ex. 7 | Ex. 3 | Toner 7 | C | B | A | A | B | B | B |
| Production Ex. 8 | Comp. Ex. 5 | Toner 8 | D | B | A | A | B | B | B |
| Production Ex. 9 | Ex. 4 | Toner 9 | C | B | A | A | B | B | B |
| Production Ex. 11 | Comp. Ex. 7 | Toner 11 | D | B | A | A | A | D | D |
| Production Ex. 12 | Ex. 5 | Toner 12 | C | B | A | A | A | C | B |
| Production Ex. 13 | Ex. 6 | Toner 13 | A | B | A | A | C | B | B |
| Production Ex. 14 | Comp. Ex. 8 | Toner 14 | A | B | A | A | D | B | B |
| Production Ex. 15 | Ex. 7 | Toner 15 | A | C | A | B | C | A | B |
| Production Ex. 16 | Ex. 8 | Toner 16 | A | BB | A | B | C | A | B |

TABLE 8-2

| | | | Low temp. fixability | Hot offset resistance | Fine line reproducibility (initial) | Fine line reproducibility (over time) | Heat resistant storage stability | Smear resistance | Abnormal streaky/dotted image |
|---|---|---|---|---|---|---|---|---|---|
| Production Ex. 17 | Ex. 9 | Toner 17 | BB | A | A | A | A | B | B |
| Production Ex. 18 | Ex. 10 | Toner 18 | C | A | A | A | A | C | B |
| Production Ex. 19 | Ex. 11 | Toner 19 | B | C | A | A | C | B | B |
| Production Ex. 20 | Ex. 12 | Toner 20 | B | BB | A | A | BB | B | B |
| Production Ex. 21 | Ex. 13 | Toner 21 | B | B | A | A | C | B | B |
| Production Ex. 22 | Ex. 14 | Toner 22 | A | B | A | A | C | B | B |
| Production Ex. 23 | Ex. 15 | Toner 23 | BB | B | A | A | B | B | B |
| Production Ex. 24 | Ex. 16 | Toner 24 | C | B | A | A | B | B | B |
| Production Ex. 25 | Ex. 17 | Toner 25 | C | A | A | A | B | C | B |
| Production Ex. 26 | Ex. 18 | Toner 26 | C | BB | A | A | BB | B | B |
| Production Ex. 27 | Ex. 19 | Toner 27 | A | BB | A | A | A | B | B |
| Production Ex. 28 | Ex. 20 | Toner 28 | B | C | A | B | BB | B | B |
| Production Ex. 29 | Ex. 21 | Toner 29 | B | BB | A | B | BB | B | B |

TABLE 8-3

| | | Low temp. fixability | Hot offset resistance | Fine line reproducibility (initial) | Fine line reproducibility (over time) | Heat resistant storage stability | Smear resistance | Abnormal streaky/dotted image |
|---|---|---|---|---|---|---|---|---|
| Production Ex. 22 Ex. 30 | Toner 30 | BB | A | A | A | A | B | B |
| Production Ex. 23 Ex. 31 | Toner 31 | C | A | A | A | A | B | B |
| Production Ex. 24 Ex. 32 | Toner 32 | A | B | A | A | B | A | B |
| Production Ex. 25 Ex. 33 | Toner 33 | A | BB | A | A | B | A | B |
| Production Ex. 26 Ex. 34 | Toner 34 | A | B | A | A | A | A | B |
| Production Ex. 27 Ex. 35 | Toner 35 | A | B | BB | C | BB | A | B |
| Production Ex. 28 Ex. 36 | Toner 36 | B | A | A | A | B | A | B |
| Production Ex. 29 Ex. 37 | Toner 37 | A | A | A | A | A | A | B |
| Production Ex. 30 Ex. 38 | Toner 38 | A | A | A | A | A | A | B |

<Low Temperature Fixability, Hot Offset Resistance, and Fine Line Reproducibility (Initial)>

With the image forming apparatus described above, image output of the pulverized toner developers 1 to 38 was performed. A solid image with an amount of deposition of 0.4 mg/cm$^2$ was output on sheets (TYPE 6200 manufactured by Ricoh Company Ltd.) through exposing, developing, and transfer steps. Linear velocity for fix 180 min/second. Solid images were sequentially output by changing the fixing temperature by 5° C. steps, and the lowest temperature at which no cold offset would occur (minimum fixing temperature: low temperature fixability), and the highest temperature at which no hot offset would occur (maximum fixing temperature: hot offset resistance) were measured. The nip width of the fixing device was 11 mm. Separately, a character chart (the size of one character: about 2 mm×2 mm) with an image occupation rate of 5% was output with the pulverized toners at a fixing temperature higher than the minimum fixing temperature by 20° C., and visually judged for evaluation of fine line reproducibility.

Evaluation Criteria of Low Temperature Fixability

A: lower than 130° C.

B: 130° C. or higher but lower than 140° C.

BB: 140° C. or higher but lower than 150° C.

C: 150° C. or higher but lower than 160° C.

D: 160° C. or higher

Evaluation Criteria of Hot Offset Resistance

A: 200° C. or higher

B: 190° C. or higher but lower than 200° C.

BB: 180° C. or higher but lower than 190° C.

C: 170° C. or higher but lower than 180° C.

D: lower than 170° C.

Evaluation Criteria of Fine Line Reproducibility

A: very good

B: good

BB: common level

C: no problem in actual use

D: unacceptable

<Smear Resistance>

A halftone image with an image occupation rate of 60% was output on sheets (TYPE 6200 manufactured by Ricoh Company Ltd.) at the minimum fixing temperature with an amount of toner deposition of. 0.40±0.1 mg/cm$^2$. With a crockmeter, a fixed image portion was frictioned 10 times with a white cotton cloth (JIS L0803 cotton #3), and ID of a stain clung to the cloth (hereinafter referred to as smear ID) was measured. Smear ID was measured with a colorimeter (X-RITE 938). The pulverized toner 33 was measured in cyan. The other toners were measured in black.

Evaluation Criteria of Smear Resistance

A: smear ID was 0.20 or less

B: smear ID was from 0.21 to 0.35

C: smear ID was from 0.36 to 0.55

D: smear ID was 0.56 or greater

<Fine Line Reproducibility (Over Time)>

After initial fine line reproducibility was evaluated, a chart with an image occupation rate of 5% was output continuously on 100 k sheets while replenishing the toner. After this, a character chart (the size of one character: about 2 mm×2 min) with an image occupation rate of 5% was again output with the pulverized toners at a fixing temperature higher than the minimum fixing temperature by 20° C., and visually judged for evaluation of fine line reproducibility over time. The criteria for judgment were the same as those for the evaluation of initial fine line reproducibility.

<Heat Resistant Storage Stability>

Each toner (10 g) was put in a 30 ml screw vial container, tapped 100 times with a tapping machine. After this, the toner was stored in a thermostatic bath at 50° C. for 24 hours, and returned to room temperature. After this, the penetration of the toner was measured with a penetrometer for evaluation of heat resistant storage stability.

Evaluation Criteria of Heat Resistant Storage Stability

A: penetrated

B: 20 min or greater

BB: 15 mm or greater but less than 20 mm

C: 10 mm or greater but less than 15 mm

D: less than 10 mm

<Abnormal Streaky/Dotted Image>

After fine line reproducibility over time was evaluated, a hundred halftone images with an image occupation rate per dot of 25%, and fifty solid images were output on A3 sheets, and the number of abnormal streaky or dotted images was counted visually.

Evaluation Criteria of Abnormal Streaky/Dotted Image

Abnormal streaky images: occurred on 15 or more sheets in halftone image output

Abnormal dotted images:

(A) the number of sheets with 6 or more abnormal dots of 0.25 mm or greater but less than 0.5 mm per sheet was 1 or more (B) the number of abnormal dots of 0.5 mm or greater was 3 or more in 50 sheets When either of the conditions (A) and (B) was met:

D (unacceptable)

When neither of the conditions (A) and (B) was met:

B (acceptable)

From Examples and Comparative Examples above, it was revealed that the present invention was able to provide a toner housing container that was able to prevent occurrence of toner aggregates even when a toner having low temperature fixability was used.

This application claims priority to Japanese application No 2013-107364, filed on May 21, 2013 and incorporated herein by reference.

What is claimed is:

1. A toner housing container, comprising:

a container body mountable on a toner conveying device and housing a toner to be supplied into the toner conveying device;

a conveying portion provided in the container body and configured to convey the toner from one end of the container body in a longer direction thereof to an other end thereof at which a container opening portion is provided;

a pipe receiving port provided at the container opening portion and capable of receiving a conveying pipe fixed to the toner conveying device; and an uplifting portion configured to uplift the toner conveyed by the conveying portion from a lower side of the container body to an upper side thereof and move the toner toward a toner receiving port of the conveying pipe, wherein the toner comprises a crystalline polyester resin (A) and a non-crystalline resin (B), wherein the toner has a molecular weight distribution having a main peak in a range of from 1,000 to 10,000 when measured by gel permeation chromatography (GPC) of a THF soluble content thereof, wherein the toner has a peak height ratio (C/R) of from 0.03 to 0.55 between a peak height C of a characteristic spectrum attributed to the crystalline polyester resin (A) and a peak height R of a characteristic spectrum attributed to the non-crystalline resin (B), when the toner is measured with a Fourier transform infrared spectroscopic analyzer according to total reflection method after stored in a thermostatic bath of 45° C. for 12 hours, wherein the container body comprises a protruding portion protruding into a container body interior side of the container opening portion toward the one end, wherein the uplifting portion comprises an uplifting wall surface extending from an internal wall surface of the container body toward the protruding portion, the uplifting wall surface inclining towards the container opening portion, and a curving portion that is a denting portion denting from an internal portion of the container body towards an external portion of the container body in a radial direction of the container so as to conform to the protruding portion, and wherein the protruding portion is provided such that when the toner housing container is mounted on the toner conveying device, the protruding portion is present between the curving portion and the toner receiving port of the conveying pipe being inserted.

2. The toner housing container according to claim 1, wherein the protruding portion has a plate-shaped member having a flat side surface, and wherein the flat side surface of the plate-shaped member is provided so as to be present between the curving portion and the toner receiving port of the conveying pipe being inserted.

3. The toner housing container according to claim 1, wherein the toner housing container comprises two uplifting portions, and wherein when the toner housing container is mounted on the toner conveying device, the protruding portion is present between the curving portions of respective ones of the two uplifting portions and the toner receiving port of the conveying pipe being inserted.

4. The toner housing container according to claim 1, wherein the uplifting portion and the protruding portion are fixed to the container body or formed integrally with the container body, and wherein the uplifting portion uplifts the toner from the lower side to the upper side by rotation of the container body.

5. The toner housing container according to claim 1, wherein the toner housing container comprises a shutter member capable of moving between a closing position to close the container opening portion and an opening position to open the container opening portion, wherein the shutter member moves from the closing position to the opening position by being pushed by the conveying pipe fixed to the toner conveying device, and wherein the protruding portion is provided so as to extend along a region in which the shutter member moves.

6. An image forming apparatus, comprising:

an image forming apparatus body in which the toner housing container according to claim 1 is set demountably.

7. A toner housing container, comprising:

a container body mountable on a toner conveying device and housing a toner to be supplied into the toner conveying device;

a conveying portion provided in the container body and configured to convey the toner from one end of the container body in a longer direction thereof to an other end thereof at which a container opening portion is provided;

a pipe receiving port provided at the container opening portion and capable of receiving a conveying pipe fixed to the toner conveying device; and an uplifting portion configured to uplift the toner conveyed by the conveying portion from a lower side of the container body to an upper side thereof and move the toner toward a toner receiving port of the conveying pipe, wherein the toner comprises a crystalline polyester resin (A) and a non-crystalline resin (B), wherein the toner has a molecular weight distribution having a main peak in a range of from 1,000 to 10,000 when measured by gel permeation chromatography (GPC) of a THF soluble content thereof, wherein the toner has a peak height ratio (C/R) of from 0.03 to 0.55 between a peak height C of a characteristic spectrum attributed to the crystalline polyester resin (A) and a peak height R of a characteristic spectrum attributed to the non-crystalline resin (B), when the toner is measured with a Fourier-transform infrared spectroscopic analyzer according to total reflection method after stored in a thermostatic bath of 45° C. for 12 hours, wherein the container body comprises a protruding portion protruding into a container body interior side of the container opening portion toward the one end, wherein the uplifting portion comprises a rising portion rising from an internal wall surface of the container body toward the protruding portion, the rising portion inclining towards the container opening portion, wherein the rising portion comprises a curving portion that is a denting portion denting from an internal portion of the container body towards an external portion of the container body in a radial-direction of the container so as to conform to the protruding portion, and wherein the protruding portion is provided such that when the toner housing container is mounted on the toner conveying device, the protruding portion is present between the curving portion and the toner receiving port of the conveying pipe being inserted.

8. The toner housing container according to claim 7, wherein the protruding portion has a plate-shaped member having a flat side surface, and wherein the flat side surface of the plate-shaped member is provided so as to be present between the curving portion and the toner receiving port of the conveying pipe being inserted.

9. The toner housing container according to claim 7, wherein the toner housing container comprises two uplifting portions, and wherein when the toner housing container is mounted on the toner conveying device, the protruding portion is present between the curving portions of respective ones of the two uplifting portions and the toner receiving port of the conveying pipe being inserted.

10. The toner housing container according to claim 7, wherein the uplifting portion and the protruding portion are fixed to the container body or formed integrally with the container body, and wherein the uplifting portion uplifts the toner from the lower side to the upper side by rotation of the container body.

11. The toner housing container according to claim 7, wherein the toner housing container comprises a shutter member capable of moving between a closing position to close the container opening portion and an opening position to open the container opening portion, wherein the shutter member moves from the closing position to the opening position by being pushed by the conveying pipe fixed to the toner conveying device, and wherein the protruding portion is provided so as to extend along a region in which the shutter member moves.

12. An image forming apparatus, comprising:

an image forming apparatus body in which the toner housing container according to claim 7 is set demountably.

* * * * *